US007632030B2

(12) United States Patent
Morikawa et al.

(10) Patent No.: US 7,632,030 B2
(45) Date of Patent: Dec. 15, 2009

(54) RECORDING APPARATUS, AND METHOD FOR INITIALIZING THE SAME

(75) Inventors: Jun Morikawa, Nagoya (JP); Kenji Samoto, Nagoya (JP)

(73) Assignee: Brother Kogyo Kabushiki Kaisha (JP)

( * ) Notice: Subject to any disclaimer, the term of this patent is extended or adjusted under 35 U.S.C. 154(b) by 504 days.

(21) Appl. No.: 11/190,126

(22) Filed: Jul. 27, 2005

(65) Prior Publication Data

US 2006/0024109 A1 Feb. 2, 2006

(30) Foreign Application Priority Data

Jul. 27, 2004 (JP) ..... 2004-219076

(51) Int. Cl.
*B41J 19/00* (2006.01)

(52) U.S. Cl. ..... 400/283; 400/291; 400/294; 400/315; 400/337; 400/341

(58) Field of Classification Search ..... 400/283, 400/286.3, 291, 294, 315, 337, 341
See application file for complete search history.

(56) References Cited

U.S. PATENT DOCUMENTS 6,390,698 B1 * 5/2002 Yoshida et al. ..... 400/356

FOREIGN PATENT DOCUMENTS

| | | |
|---|---|---|
| JP | 5330057 | 12/1993 |
| JP | 06-255195 | 9/1994 |
| JP | 6255195 | 9/1994 |
| JP | 9131937 | 5/1997 |
| JP | 10058781 | 3/1998 |
| JP | 2002248793 | 9/2002 |
| JP | 2003039796 | 2/2003 |
| JP | 2003211800 | 7/2003 |

* cited by examiner

*Primary Examiner*—Judy Nguyen
*Assistant Examiner*—Matthew G Marini
(74) *Attorney, Agent, or Firm*—Banner & Witcoff, Ltd.

(57) ABSTRACT

A recording apparatus includes: a carriage having a recording head, a movement unit that reciprocally moves the carriage, a carriage detection unit, a point-of-origin detection unit that detects the position of a point of origin of the carriage, a regulation unit capable of restricting the movement of the carriage, and a control unit that selectably performs one of a first initialization processing and a second initialization processing longer in time than the first initialization processing. The control unit selects one of the first initialization processing and the second initialization processing on the basis of whether movement of the carriage is restricted and whether a travel distance of the carriage corresponds to a predetermined distance, when the movement unit moves the carriage from a position of origin toward the regulation unit.

18 Claims, 36 Drawing Sheets

LEFTTMOST END WALL
RIGHTMOST END WALL (POSITION OF ORIGIN)

100a
3
100
60
8
STANDBY POSITION
D2
D1

RECORDING APPARATUS, AND METHOD FOR INITIALIZING THE SAME

BACKGROUND OF THE INVENTION

1. Field of the Invention

The present invention relates to a recording apparatus which performs, at power-on, initialization processing, including processing for detecting a home position of a carriage with a recording head mounted thereon, as well as to a method for performing initialization processing.

2. Background Art

A recording apparatus having a carriage on which is mounted a recording head capable of reciprocally moving in a predetermined direction; that is, a so-called serial printer, has hitherto performed, at power-on, processing for detecting a home position of a carriage with a recording head mounted thereon. For instance, Japanese Patent No. 3061091 describes a serial printer which reciprocally moves a carriage at power-on during initial operation of the printer. In this serial printer, when the initial operation is performed as a result of power having been turned on, a carriage remaining stationary at an unknown position is initially moved toward the home position provided at one end of a movable range. When the carriage has come to a standstill upon contact with a stopper or the like, the position is stored as a tentative home position. The carriage is then moved over only a predetermined distance within the movable range of the carriage in a direction opposite the home position. When the carriage has been able to move over the predetermined distance, the tentative home position is stored as a true home position, and the carriage is further moved to a standby position in the vicinity of the home position. In contrast, when the carriage has been unable to move over a predetermined distance, the tentative home position is determined to have been inaccurate, and therefore an error is reported.

SUMMARY OF THE INVENTION

In the serial printer described in Japanese Patent No. 3061091, the carriage reciprocally moves through the movable range without fail during the initial operation of the printer performed at power-on. Therefore, there is a problem of the reciprocal movement causing much inconvenience to a user who desires to perform recording of images, or the like, immediately after power-on.

Moreover, an error is reported even when detection of the home position has ended in a failure only once. Even in this regard, the user feels great inconvenience.

The present invention has been made in view of the above-described circumstances and aims at providing a recording apparatus which shortens a wait time of a user by simplifying initial operation to be performed at power-on and provides enhanced convenience to the user by retrying detection of a home position even when detection of the home position has ended in a failure.

The invention provides a recording apparatus, including: a carriage including a recording head that records an image on a recording medium; a movement unit that reciprocally moves the carriage in a main scanning direction with reference to a position of a point of origin provided at one end within a movable region of the carriage; a carriage detection unit that detects at least one of a travel distance, movement/stoppage of the carriage; a point-of-origin detection unit that detects the position of a point of origin of the carriage; a regulation unit provided at a first distance away from the point of origin within the movable region of the carriage, wherein the regulation unit is displaceable between a contact position where movement of the carriage is restricted as a result of coming into contact with the carriage and a spaced position where movement of the carriage is allowed as a result of being spaced apart from the carriage; and a control unit that selectably performs one of a first initialization processing and a second initialization processing requiring a longer time than that required by the first initialization processing, after the point-of-origin detection unit detects the position of origin; wherein the control unit selects one of the first initialization processing and the second initialization processing on the basis of whether movement of the carriage is restricted and whether a travel distance of the carriage is within a predetermined range, when the movement unit moves the carriage from a position of origin toward the regulation unit; and the predetermined range is within a distance from the point of origin to the contact position.

The invention provides a recording apparatus, including: a carriage including a recording head that records an image on a recording medium; a movement unit that reciprocally moves the carriage in a main scanning direction with reference to a position of a point of origin provided at one end within a movable region of the carriage; a carriage detection unit that detects at least one of a travel distance, movement/stoppage of the carriage; and a point-of-origin detection unit that detects the position of a point of origin of the carriage; and a status detection unit that detects a status of the recording apparatus acquired at the time of the last power turn-off operation, when power of the recording apparatus is turned on; and a control unit that selectably performs one of a first initialization processing and a second initialization processing requiring a longer time than that required by the first initialization processing, on the basis of a detected result by the status detection unit.

The invention provides a method for performing initialization processing in a recording apparatus, wherein the recording apparatus includes, a carriage including a recording head that records an image on a recording medium, a movement unit that reciprocally moves the carriage in a main scanning direction with reference to a position of a point of origin provided at one end within a movable region of the carriage, and a regulation unit provided away at a given distance from the point of origin within the movable region of the carriage, wherein the regulation unit is displaceable between a contact position where movement of the carriage is restricted as a result of coming into contact with the carriage and a spaced position where movement of the carriage is allowed as a result of being spaced apart from the carriage. The method includes: moving the carriage toward a point of origin; detecting the position of origin; moving the carriage from the position of origin toward the regulation unit; determining whether movement of the carriage is restricted and whether a travel distance of the carriage is within a predetermined range that is within a distance from the point of origin to the contact position; and selecting one of a first initialization processing serving as simple initialization processing and a second initialization processing requiring a longer time than that required by the first initialization processing performing, on the basis of results of the determination step.

The invention provides a method for performing initialization processing, including processing for detecting a position of a point of origin of a carriage in a recording apparatus, when power of a recording apparatus is turned on. The method includes: detecting a status of the recording apparatus acquired at the time of the last power turn-off operation when power of the recording apparatus is turned on; and performing, on the basis of a result of the detecting step, first initialization processing serving as simple initialization processing, or second initialization processing requiring a longer time than that required by the first initialization processing.

The invention provides a recording apparatus, including: a carriage including a recording head that records an image on a recording medium; a movement unit that reciprocally moves the carriage in a main scanning direction with reference to a position of a point of origin provided at one end within a movable region of the carriage; a carriage detection unit that detects at least one of a travel distance, movement/stoppage of the carriage; a point-of-origin detection unit that detects a position of a point of origin of the carriage; a maintenance unit provided at the one end and configured to perform maintenance on the recording head, the maintenance unit having a cover member that covers the recording head when in a standby status; and a control unit that performs one of a first initialization processing and a second initialization processing requiring a longer time than that required by the first initialization processing, on the basis of a status of the carriage acquired when the movement unit moves the carriage in a direction opposite to the direction toward the point of origin after the movement unit moves the carriage toward the point of origin and after the point-of-origin detection unit detects the position of origin when the recording apparatus is turned on.

The invention provides a method for performing initialization processing, including processing for detecting a position of a point of origin of a carriage in a recording apparatus, when power of a recording apparatus is turned on. The method includes: moving the carriage toward the position of the origin; detecting the position of the origin; moving the carriage in a direction opposite to the direction toward the origin; determining a status of the carriage; and selectably performing one of the first initialization processing and the second initialization processing requiring a longer time than that required by the first initialization processing on the basis of a result of the determining step.

The invention provides a recording apparatus, including: a carriage including a recording head that records an image on a recording medium; a movement unit that reciprocally moves the carriage in a main scanning direction with reference to a position of a point of origin provided at one end within a movable region of the carriage; a carriage detection unit that detects at least one of a travel distance, movement/stoppage of the carriage; a point-of-origin detection unit that detects a position of a point of origin of the carriage; and a maintenance unit that performs maintenance on the recording head and that has a cover member that covers the recording head when in a standby status; wherein the maintenance unit is disposed at the one end within the movable region of the carriage; and the recording unit performs an initialization processing including processing for detecting the position of a point of origin of the carriage when power is turned on.

BRIEF DESCRIPTION OF THE DRAWINGS

The present invention may be more readily described with reference to the accompanying drawings:

FIG. 27 is a flowchart showing flow of initialization processing to be performed when power of the multifunction device is turned on;

DETAILED DESCRIPTION OF THE PREFERRED EMBODIMENTS

An embodiment embodying the present invention will be described hereinbelow by reference to FIGS. 1 to 36G.

<Overall Configuration>

Figure 1:
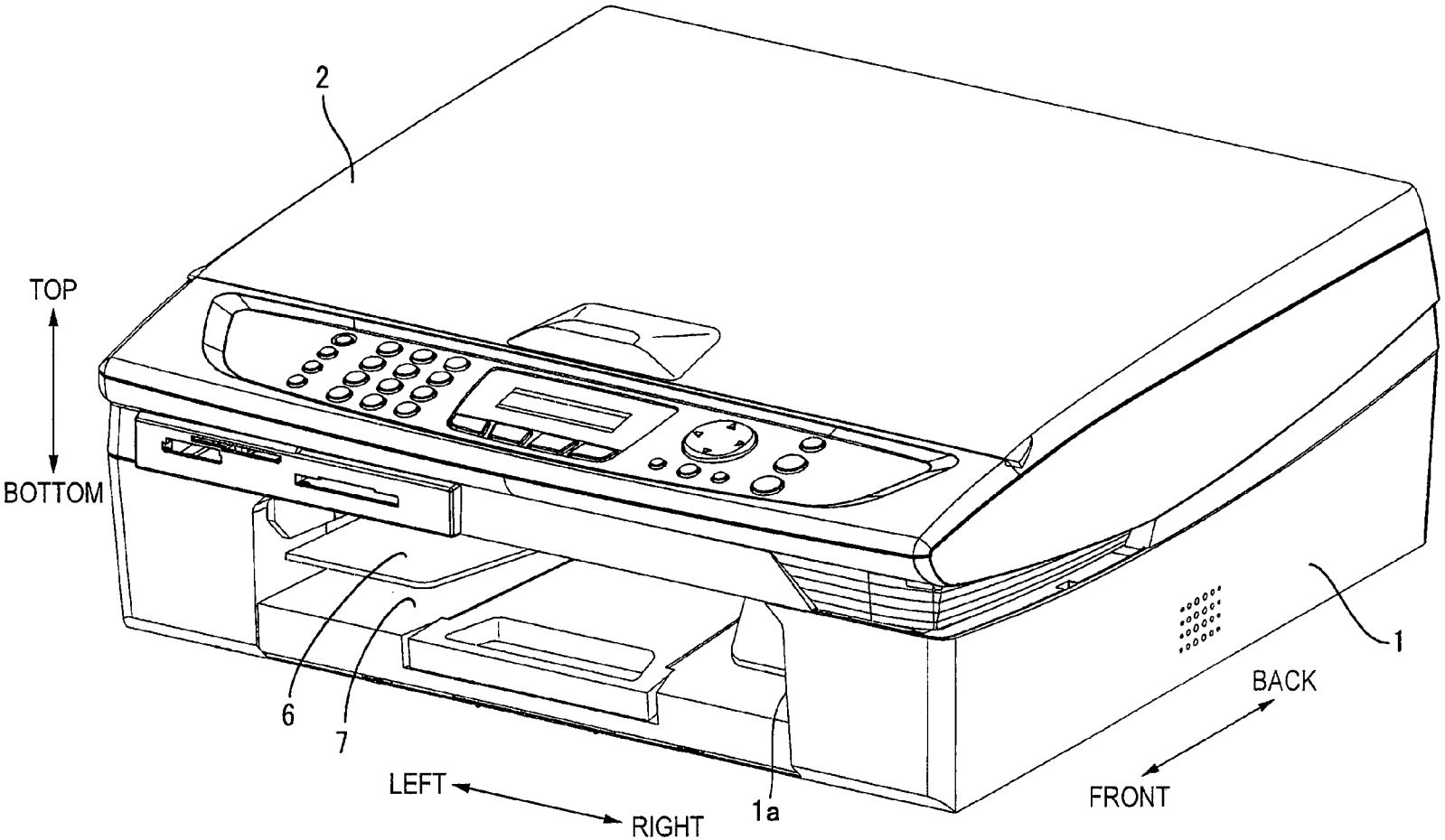
FIG. 1 is an external appearance perspective view of a multifunction device.
Figure 2:
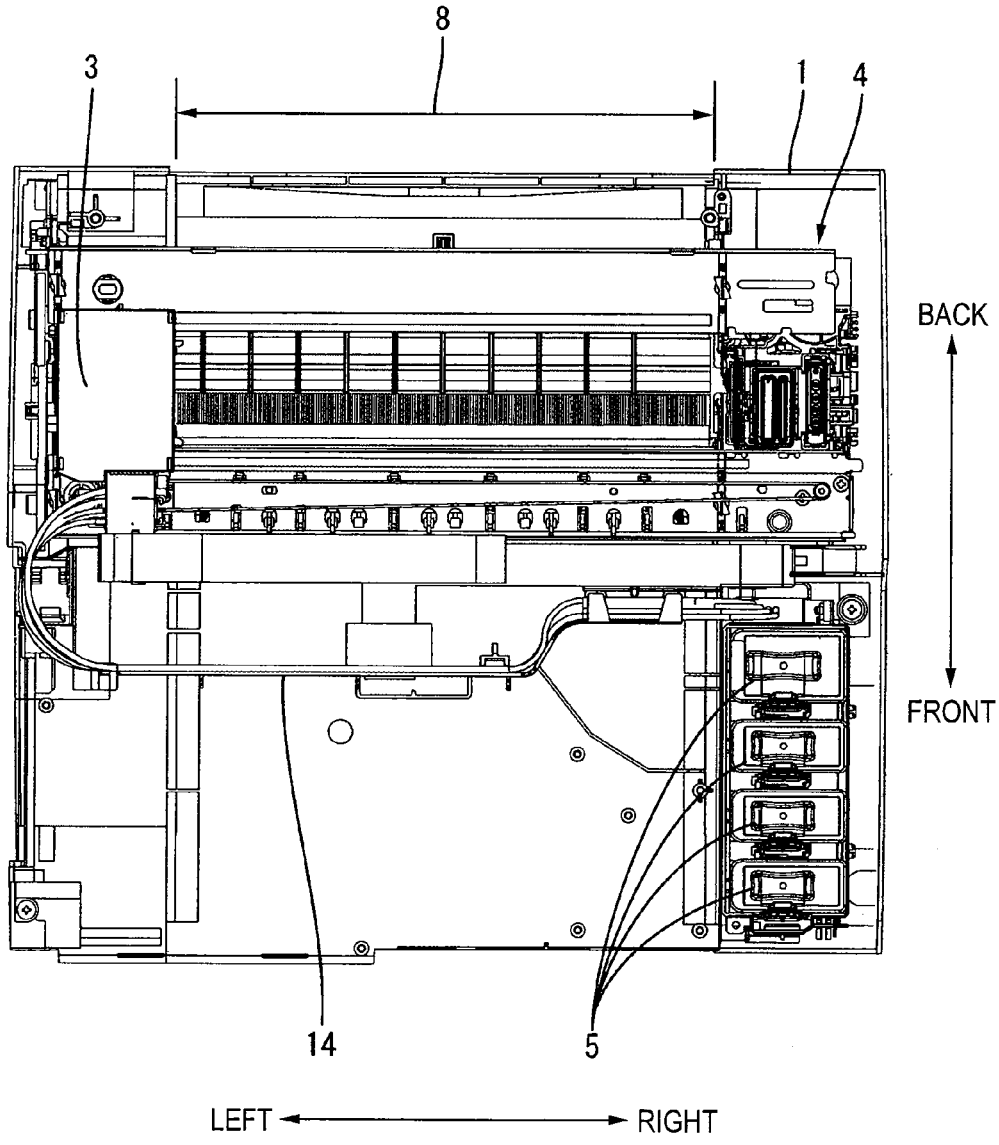
FIG. 2 is a plan view showing the overall configuration of an internal mechanism.
Figure 3:
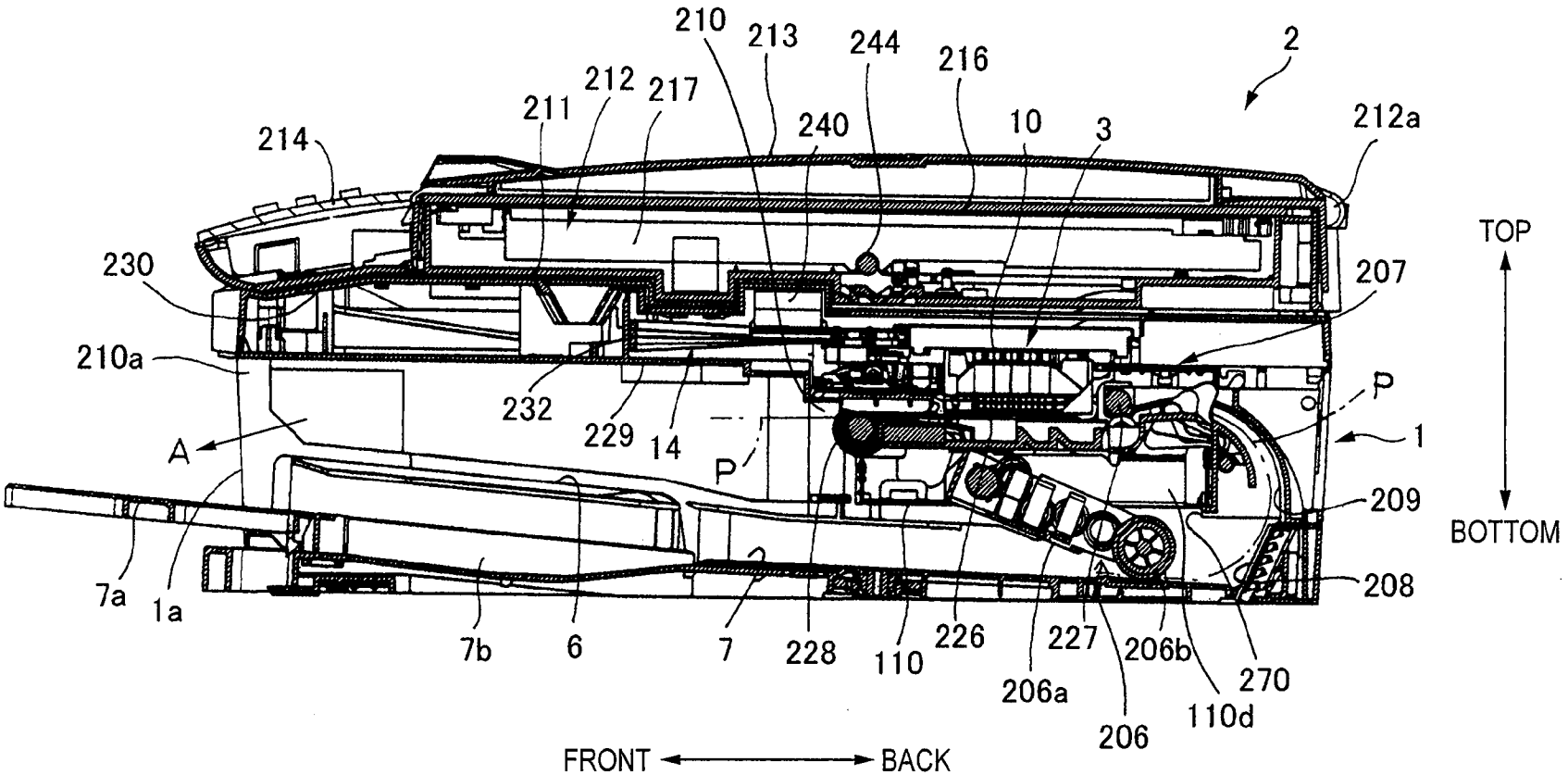
FIG. 3 is a cross-sectional view of the multifunction device cut along an essential center with respect to a horizontal direction.

An inkjet printer of a present embodiment is a multifunction device (hereinafter called an MFD: Multi-Function Device) having a printer function, a copier function, a scanner function, and a facsimile function. As shown in FIGS. 1 through 3, an image reader 2 to be used for effecting the copier function and the scanner function is provided on top of a main body frame 1 which is an article made from synthetic resin through injection molding. Disposed below the image reader 2 are a carriage 3 which can reciprocally move in a horizontal direction and carries a recording head 10 capable of recording an image on recording paper P which is a medium to be subjected to recording (hereinafter called a "recording medium"); a maintenance unit 4 used for recovering nozzles of the recording head 10 from clogging; and ink tanks 5 for supplying ink to the recording head 10. An opening section 1*a* in a front surface of the main body frame 1 is configured to enable removal insertion of a paper feed cassette 7 having a paper output tray 6. A long area extending from a point close to the left end to another point close to the right end of a travel path of the carriage 3 forms a recording zone 8. A maintenance position for the recording head 10 and the home position (the point of origin) of the carriage are provided at points in a rightward direction outside the recording zone 8; that is, the right-end portion of the travel path. Accordingly, the maintenance unit 4 is provided at the right-end portion of the travel path. Moreover, a flushing section 9 (see FIG. 4) for forcefully causing the respective nozzles of the recording head 10 to eject ink is provided at the left end of the travel path of the carriage 3. The ink tanks (ink cartridges) 5 are of four colors; i.e., black, cyan, magenta, and yellow, and are arranged in a line forward of (to the front of) the maintenance position.

In the present embodiment, the paper feed cassette 7 has a shape that enables housing of recording paper P which serves as the recording medium and is cut into a size, such as an A4-size, a letter size, a legal size, or a card size, in a multi-layered manner (in a stacked manner) such that shorter sides of the recording paper P extend in a direction (a main scanning direction or a horizontal direction) orthogonal to a paper transport direction (a sub-scanning direction or a longitudinal direction). An ancillary support member 7*a* for supporting a rear end portion of the long recording paper P, such as a legal size, is provide data front end portion of the paper feed cassette 7 so as to be movable in the front and rearward direction. FIG. 3 shows that the ancillary support member 7*a* is provided at a position where it projects outside the main body frame 1 (the opening section 1*a*). However, when the recording paper P of a size, such as A4-size, which fits into the paper feed cassette 7 (does not project outside the main body frame 1 by way of the opening section 1*a*), is used, the ancillary support section 7*a* can be housed in a housing section 7*b* so as not to hinder paper feeding.

A sloped section 208 used for separating paper is provided at a deep interior of the paper feed cassette 7 (a rear-end portion of the paper feed cassette 7 shown in FIG. 3). As will be described in detail later, a base-end portion of a paper feed arm 206*a* of a paper feed unit 206 is attached, in a vertically pivotable manner, to a bottom plate 111*a* (see FIG. 5) of a box-shaped main frame 110 made of a metal plate. The recording paper P, which is stacked (accumulated) in the paper feed cassette 7 and serves as a recording medium, is separated and transported one sheet at a time, by means of a paper feed roller 206*b* disposed at a lower end of the paper feed arm 206*a*, and the sloped section 208. The thus-separated paper P is fed to a recording section 207 by way of a U-turn path (feed passage) 209 oriented upward and forward, wherein the recording section 207 is disposed at a position above (or at a position higher than) the paper feed cassette 7. As will be described in detail later, the recording section 207 is constituted of the carriage 3, or the like—which carries the inkjet-type recording head 10 for implementing the printer function, or the like, and can reciprocally move—and records an image on the fed recording paper P.

The recording paper P on which an image has been recorded by the recording section 207 is output by way of a paper output section 210 with a recorded surface of the paper facing upward, and the paper output tray 6 on which the thus-output recording paper P is to be placed is formed integrally with an upper portion of the paper feed cassette 7. A paper output port 210*a* in communication with the paper output section 210 is opened as being common to the opening section 1*a* in the front surface of the main body frame 1.

A bottom wall 211 of the image reader 2 is superimposed on an upper cover body 230, which will be described later, from above the same with no essential clearance present therebetween. The image reader 2 is configured so as to be reclosably opened in a vertical direction with reference to the main body frame 1 by way of an unillustrated pivot section provided at a left side-edge of the image reader 2. Further, a rear end of a document cover body 213 which covers an upper face of the image reader 2 is attached to a rear end of the image reader 2 by way of a pivot shaft 212*a*, and hence the document cover body 213 is configured so as to be able to reclosably open with respect to the image reader 2.

A control panel section 214 is disposed at a position which is above the front portion of the main body frame 1 and forward of the image reader 2; and is provided with a variety of operation buttons, an LCD section, and the like. The recording section 207, the paper output section 210, and the ink tanks 5 disposed on one side of the paper output section 210 are arranged within a projected area of the image reader 2 and the control panel section 214 acquired when viewed in elevation. With the ancillary support member 7*a* of the paper feed cassette 7 being housed in the storage section 7*b*, the length of the paper feed cassette 7 in the front-rear direction thereof is substantially equal to the length of the image reader 2 in the front-rear direction thereof and the length of the control panel section 214 in the front-rear direction thereof. Accordingly, the MFD assumes the shape of a substantially-rectangular parallelepiped which is essentially square when viewed in elevation. Therefore, packaging is facilitated even in packaging operation for shipping the product, and a packaging box can also be miniaturized.

A placement glass plate 216 which enables a document to be placed with the document cover body 213 opened upward is provided on the upper surface of the image reader 2. An image scanner device (CIS: Contact Image Sensor) 217 for reading the document is provided beneath the document glass cover 216 so as to be able to reciprocally move along a guide shaft 244 extending in a direction perpendicular to the sheet plane of FIG. 3 (the main scanning direction, and the horizontal direction in FIGS. 1 and 2).

The four ink tanks 5 contain four colors of ink [black (BK), cyan (C), magenta (M), and yellow (Y)] for full-color recording and each assumes a substantially-rectangular box shape which is small in area when viewed in elevation and has a large height. These ink tanks 5 are arranged in a row in the front-rear direction, and become removable when the image reader 2 pivoted upward (opened) with respect to the main body frame 1.

The inkjet recording head 10 is configured so as to be supplied with ink from the respective ink tanks 5 by way of a plurality of ink supply tubes 14 (four ink tubes, which are equal in number to the colors of ink in the embodiment). Meanwhile, when ink—which is a greater in number of colors (six to eight colors) than four colors—is employed, the only requirement is to configure the main body frame so as to enable housing of the ink tanks 5 in accordance with the number of colors of ink, as well as to increase the number of ink supply tubes 14 in compliance with the number of ink tanks 5.

A flushing section 9 is provided outside the width (a shorter side) of the recording paper P to be transported at a position close to one side (the left side in FIGS. 1, 2, and 4 in the present embodiment) thereof. Further, the maintenance unit 4 functioning as a maintenance unit to be described later is provided on the other side (the right side in FIGS. 1, 2, and 4). By means of these elements, during recording operation the recording head 10 ejects ink for preventing clogging of the nozzles at a flushing position set in the flushing section 9. A maintenance position for the carriage 3 is set in the vicinity of the maintenance unit 4, and a nozzle cap 60 of the maintenance unit 4 covers a nozzle surface of the recording head 10 from below, to thus selectively suck black ink or ink of another color, or performs recovery processing, or the like, for removing air bubbles in a buffer tank 11 provided on the recording head 10. When the carriage 3 laterally moves in the neighborhood of the maintenance unit 4 at predetermined timing, a wiper 90, which will be described later, eliminates excessive ink or extraneous matters on the nozzle surface, thereby cleaning the nozzle surface.

Figure 5:
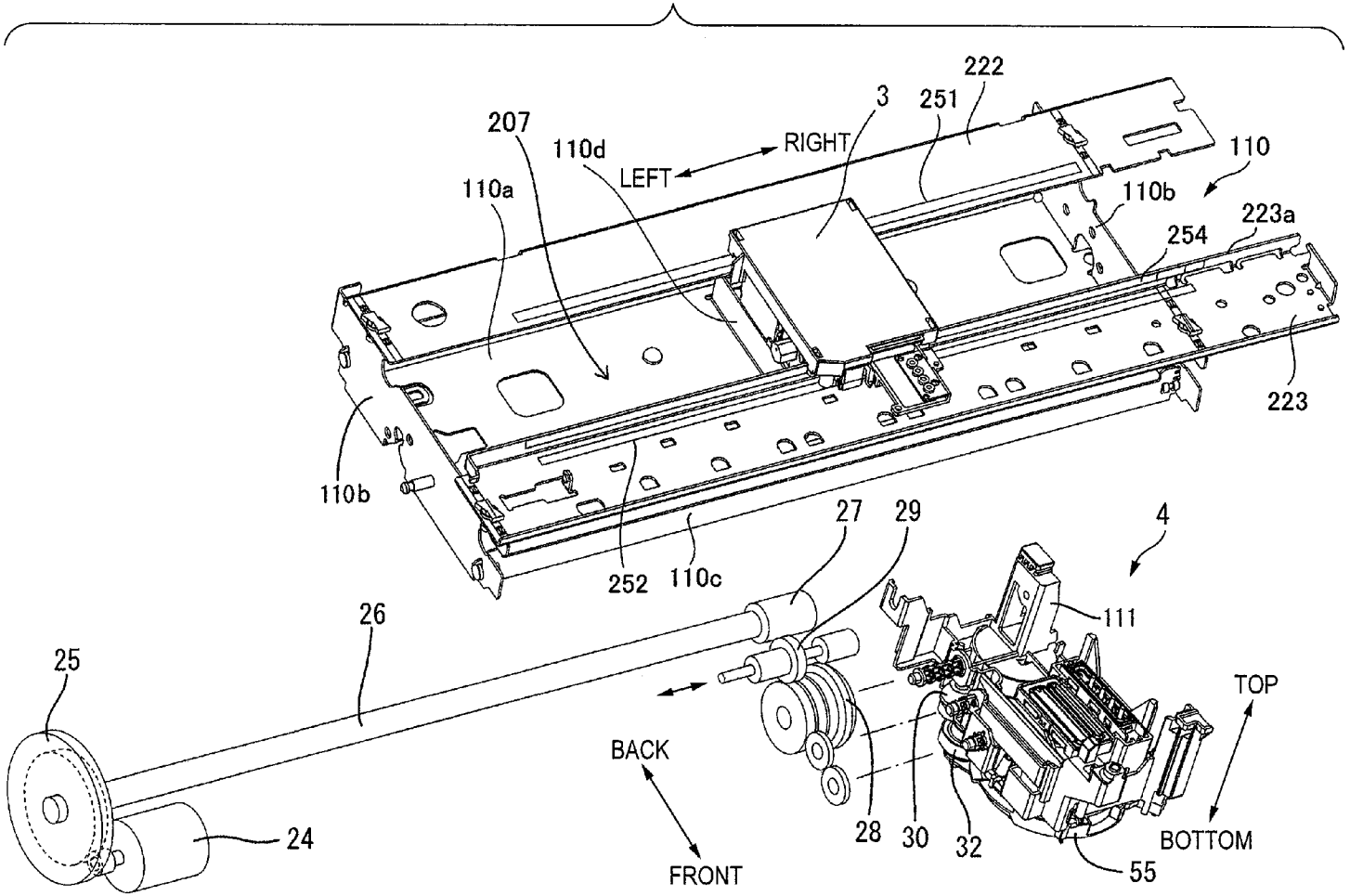
FIG. 5 is a perspective view showing a mechanism for transmitting rotational drive force to a maintenance mechanism.

As shown in FIGS. 3 and 5, the recording section 207 is supported by the box-shaped main frame 110 and formed between plate-like, horizontally-elongated first and second guide members 222, 223 which extend laterally (in the main scanning direction).

By reference to FIG. 5, the structure of the main frame 110 will be described briefly. The main frame 110 is formed by means of: punching a sheet of metal plate (steel plate) into a predetermined shape; and bending a pair of side plates 110*b* and a pair of reinforcing plates 110*c* with reference to a bottom plate 110*a* so as to assume the shape of an upwardly-open box. Accordingly, the assembly operation becomes considerably simple. The first guide member 222 is fixed to an upstream (rear) portion of the main frame 110 with reference to the paper transport direction, and the second guide member 223 is fixed to a downstream (front) portion of the same with reference to the paper transport direction. FIG. 5 shows only a reinforcing plate 110*c* located closer to the viewer among the pair of reinforcing plates 110*c*.

The carriage 3 on which the recording head 10 is mounted is slidably supported (carried) so as to straddle across the first and second guide members 222, 223, to thus become reciprocally movable.

An upwardly-bent, essentially-perpendicular (vertical) guide piece 223*a* is formed on an upstream (rear) portion of the second guide member 223 with respect to the paper transport direction.

Right ends of the first and second guide members 222, 223 project rightward beyond the right side plate 110*b*, and the maintenance unit 4 is provided so as to straddle across the thus-projecting ends of the first and second guide members and the right side plate 110*b*.

An opening section 270 (see FIG. 3) capable of housing the paper feed arm 206*a* and the paper feed roller 206*b* of the paper feed unit 206 is formed in the bottom plate 111*a* of the main frame 110. A pair of shaft support plates 110*d* (only one of the shaft support plates 110*d* is shown in FIGS. 3 and 5) are upwardly formed on respective sides of the opening section 270 so as to stand upright. Unillustrated shaft holes which enable rotatable support of base-end portions of the paper feed arm 206*a* are formed in the respective shaft support plates 110*d*.

Figure 6:
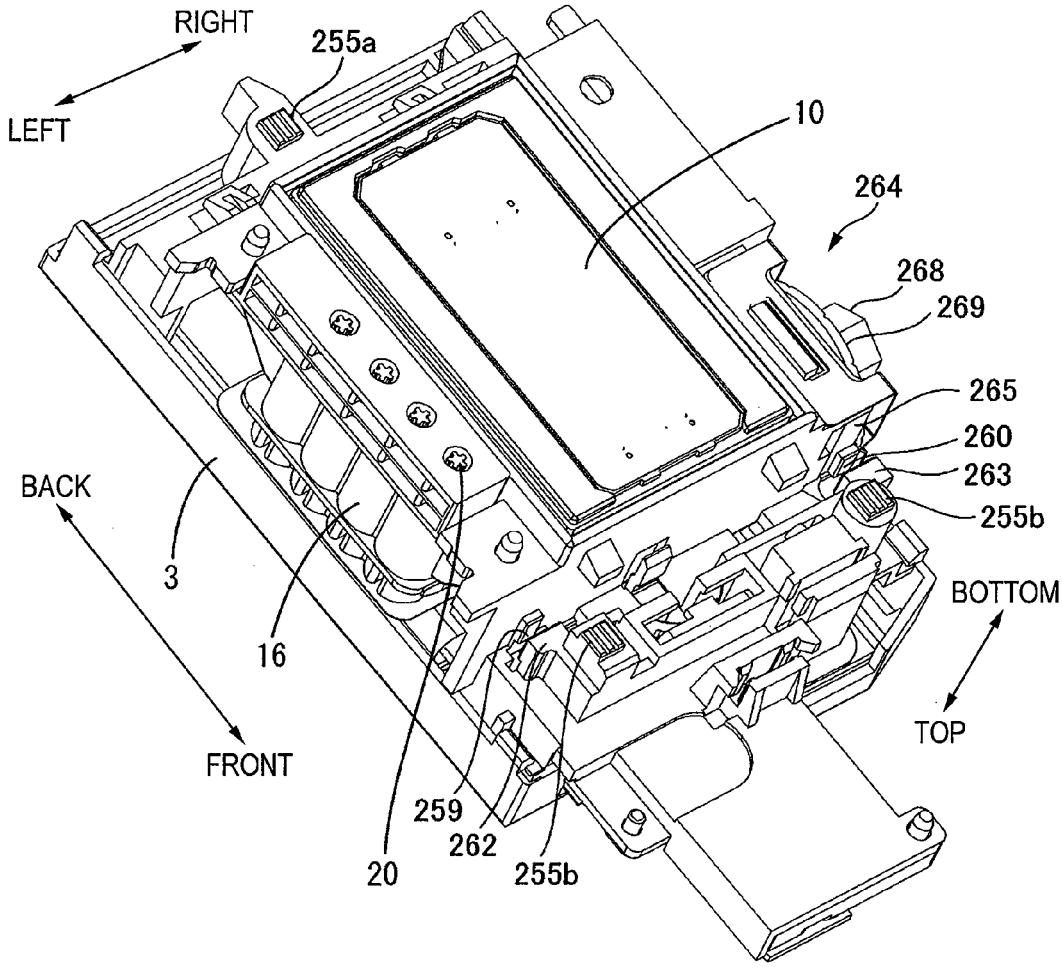
FIG. 6 is a perspective view of a carriage when inverted upside down.

As shown in FIG. 6, the carriage 3 is provided with first slidable projection sections 255*a*, 255*b* which protrude from the lower surface of the carriage 3 and come into contact with first slide surfaces 251, 252 of the guide members 222, 223.

In the embodiment, the single first slide projection section 255*a*, which comes into contact with the first slide surface 251 of the first guide member 222, is disposed in substantially the center of the carriage 3 with respect to the horizontal direction thereof (the main scanning direction). The two first slide projections 255*b*, which come into contact with the first slide surface 252 of the second guide member 223, are appropriately spaced apart from each other in the horizontal direction (the main scanning direction) of the carriage 3. Consequently, the three first slide projections 255*a*, 255*b*, and 255*b* are arranged in a triangular pattern (preferably an isosceles triangle) on the carriage 3 when viewed in plane, whereby the carriage 3 is stably supported in relation to the first and second guides 222, 223. Since the first slide projection sections 255*a*, 255*b* slide briskly over the guide members 222, 223 while receiving the weight of the carriage 3, a plurality of recessed grooves—which extend long in the front and rear direction and hold lubrication grease—are formed in the lower surfaces (the support and slide surfaces) of the first slide projections 255*a*, 255*b* while being spaced from each other at appropriate intervals, with reference to the main scanning direction (the horizontal direction).

Two second slide projection sections 259, 260, which are brought into contact with a second slide surface 254 of the guide piece 223*a* of the second guide member 223, are provided on the carriage 3. One second slide projection section 259 is formed integrally with a holder case of the carriage 3. The vertical guide piece 223*a* is sandwiched between a nipping piece 262 and the second slide projection section 259, and a space between the nipping piece 262 and the second slide projection section 259 is opened in a downward direction as well as in the main scanning direction.

The other second slide projection section 260 and a nipping piece 263 are provided by way of an attitude adjustment unit 264 for adjusting the attachment attitude of the carriage 3 on the guide piece 223*a* which is perpendicular to the second guide member 223. In this attitude adjustment unit 264, an adjustment body block 265 moves in the front-rear direction in accordance with a rotary position of an adjustment knob 268, and by extension, in accordance with a rotary position of a dial plate 269, so that the extent to which the second slide projection section 260 projects with respect to the guide piece 223*a* can be adjusted. Therefore, the inclination of the carriage 3 with reference to the horizontal direction thereof can be changed or adjusted around the location where the slide surface of the first slide projection section 259 remains in contact with the guide piece 223*a* when viewed from the top.

Figure 4:
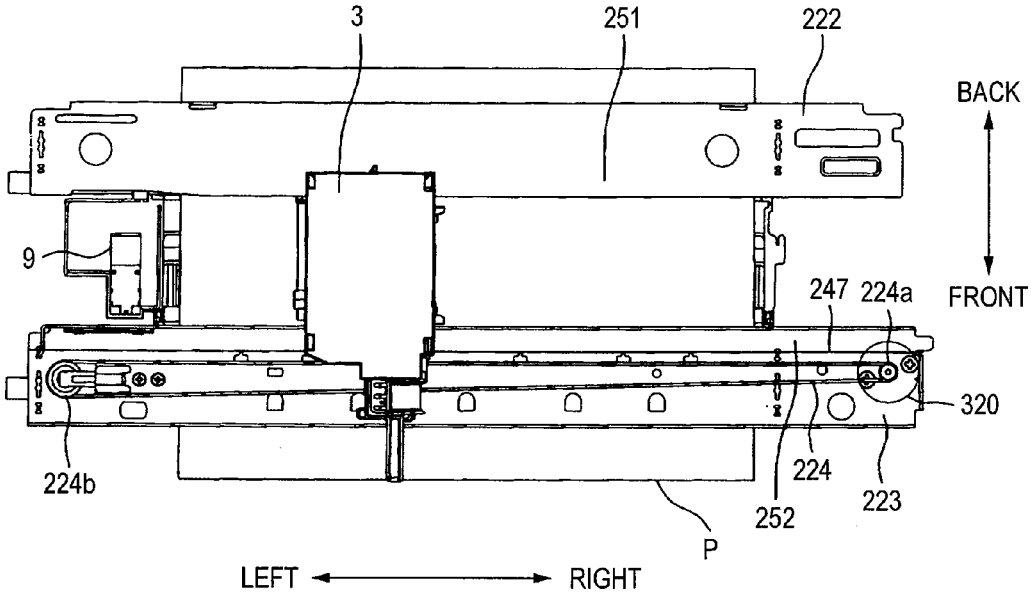
FIG. 4 is a plan view showing the configuration of a recording section.

As shown in FIG. 4, in order to reciprocally actuate the carriage 3 with the recording head 10 mounted thereon, a timing belt 224, which is arranged so as to extend in the main scanning direction (the horizontal direction), is passed around pulleys 224*a*, 224*b* on an upper surface of the second guide member 223 located downstream in the paper transport direction (the direction of arrow A in FIG. 3). A CR (carriage) motor 320 (although the carriage motor is embodied as a DC motor in the embodiment, another motor, such as a stepping motor, may also be employed) for driving the timing belt 224 is fastened to the lower surface of the second guide member 223 with screws. A pulley 224*a* is fixed to the drive shaft of the CR motor 320. A movement unit is constituted of these constituent elements, a drive circuit 312 for driving the CR motor 320, and a control section. The second guide member 223 is equipped with an encoder strip 247, or the like, which is disposed in the vicinity of the guide piece 223*a* so as to extend in the main scanning direction and is intended for detecting the position of the carriage 3 in the lateral direction thereof (the main scanning direction) or movement/stoppage of the same. This elongated encoder strip 247 is provided such that an inspection surface (a face in which slits are formed at given intervals in the horizontal direction) is aligned in the vertical direction.

A partition (lower cover member) 229 made of synthetic resin is formed integrally with the main body frame 1, wherein the partition is provided so as to cover the space above the paper output section 210 from the lower surface of the second guide member 223 located downstream in the paper transport direction of the paper output port 210*a* located at the front edge of the main body frame 1, at a position which is essentially on the same level with the bottom plate 110*a* of the main frame 110.

The upper cover member 230 is disposed so as to be appropriately spaced apart above from the partition (lower cover member) 229 and to cover the space above the carriage 5 and the reciprocal travel path thereof. A rectangular window hole (not shown), by way of which the reciprocal travel path of the carriage 3 is visible from above, is formed in an arbitrary intermediate point in the upper cover member 230. When the recording paper P has caused a paper jam in the recording section 207, or in a like case, a user can remove the recording paper P by way of this window hole by means of upwardly raising the image reader 2 in a pivotal manner from the main frame 1. In this case, the ink supply tubes 14 are not pulled above the platen 226, so that removal of the recording paper P becomes easy.

<Carriage 3, and Unit for Supplying Ink to the Carriage 3>

The carriage 3 with the recording head 10 mounted thereon will now be described by reference to FIGS. 6 and 7. The carriage 3 has the recording head 10, and a plurality of nozzles are formed in a lower surface of the carriage 3. Ink is selectively ejected downward from the nozzles of the recording head 10 while the carriage 3 travels through the recording zone 8 (see FIG. 2), whereby an image is recorded on the recording medium (the recording paper P). In the present embodiment, as mentioned previously, ink of four colors is used, and hence four recording heads 10 are provided, for the respective colors of ink.

A buffer tank 11 is provided on each of the upper surfaces of the recording heads 10. An air-bubble storage chamber 12 is provided in an upper portion of each buffer tank 11, and an ink flow chamber 13 remaining in communication with the recording head 10 is provided in a lower portion of each buffer tank 11. Ink is supplied from the ink tank 5 to the air-bubble storage chamber 12 by way of a tube 14 having flexibility (see FIG. 2). The ink supplied to the inside of the air-bubble storage chamber 12 flows into the ink flow chamber 13 after having passed through a filter 15 and reaches the recording head 10. When the ink passes by the filter 15, the air bubbles contained in the ink are separated from the ink, and the thus-separated air bubbles are stored in an upper portion of the air-bubble storage chamber 12.

A valve case 16 is provided on the carriage 3 so as to situate at a position rightward with reference to the recording head 10. Discharge passages 17 extending from the ceilings of the respective air-bubble storage chambers 12 are opened in the lower surface of the valve case 16 in the form of discharge ports 18. These four discharge ports 18 are arranged in the depthwise direction. The four discharge passages 17 extend vertically within the valve case 16. Each of the vertically-extending portions of the respective discharge passages 17 houses a normally-closed open-and-close valve 19. The open-and-close valve 19 is usually retained in a closed state where a vertically-elongated valve body 20 closes a valve port 22 by means of the spring 21. However, when the valve body 20 is moved upward in defiance of restoration force of a spring 21 by means of an open-close member 50, the open-and-close valve 19 is opened. In relation to discharge resistance of a discharge path (which will be described in detail later) which extends from the air-bubble storage chamber 12 to the discharge port 18 of the discharge passage 17, discharge paths for colors; namely, a cyan discharge path, a yellow discharge path, and a magenta discharge path, are essentially equal to each other. However, the discharge resistance of a black discharge path is made lower than those of the color discharge paths. In order to make comprehension easy, in FIG. 7 the nozzle cap 60 and an air-discharge cap 40 are depicted side by side with respect to the depthwise direction (the recording head 10 and the valve case 16 are also depicted in the same manner). In reality, however, the nozzle cap 60 and the air-discharge cap 40 are arranged alongside each other in the horizontal direction as depicted in other drawings (e.g., FIGS. 10 to 12, and FIGS. 17 to 21). Specifically, the air-discharge cap 40 is provided on the right side of the nozzle cap 60. Similarly, as shown in FIG. 4, the recording head 10 and the valve case 16 are also arranged alongside each other in the horizontal direction. Specifically, the valve case 16 is arranged on the right side of the recording head 10.

The carriage 3 is configured to be able to stop at a home position that is located at the rightmost position in the reciprocal travel path, an idle suction position (i.e., an uncapped position) which is located slightly leftward (closer to the recording zone 8) with reference to the home position and is on the right side of the wiper 90, and a wiping-termination position located slightly leftward with reference to the wiper 90.

<Drive Power Transmission Mechanism of the Maintenance Unit 4>

By reference to FIG. 5, the structure of a drive power transmission mechanism of the maintenance unit 4 will now be described. The main frame 110 is provided with a rotational drive mechanism, which includes a motor 24 disposed at a left end of the main frame 110, as means for rotating the paper feed roller 206*b* of the paper feed unit 206. A rotary shaft 26 of a reduction gear 25 engaged with an output shaft of the motor 24 extends in the rightward direction. A drive gear 27 is provided at the right end of the rotary shaft 26 so as to rotate in an integrated fashion. A slide gear 29, which engages with a large-diameter bevel gear 28 only when the carriage 3 is moved to the maintenance position, is engaged with the drive gear 27. The large-diameter bevel gear 28 is engaged with a small-diameter bevel gear 30 whose axis is oriented vertically.

Figure 8:
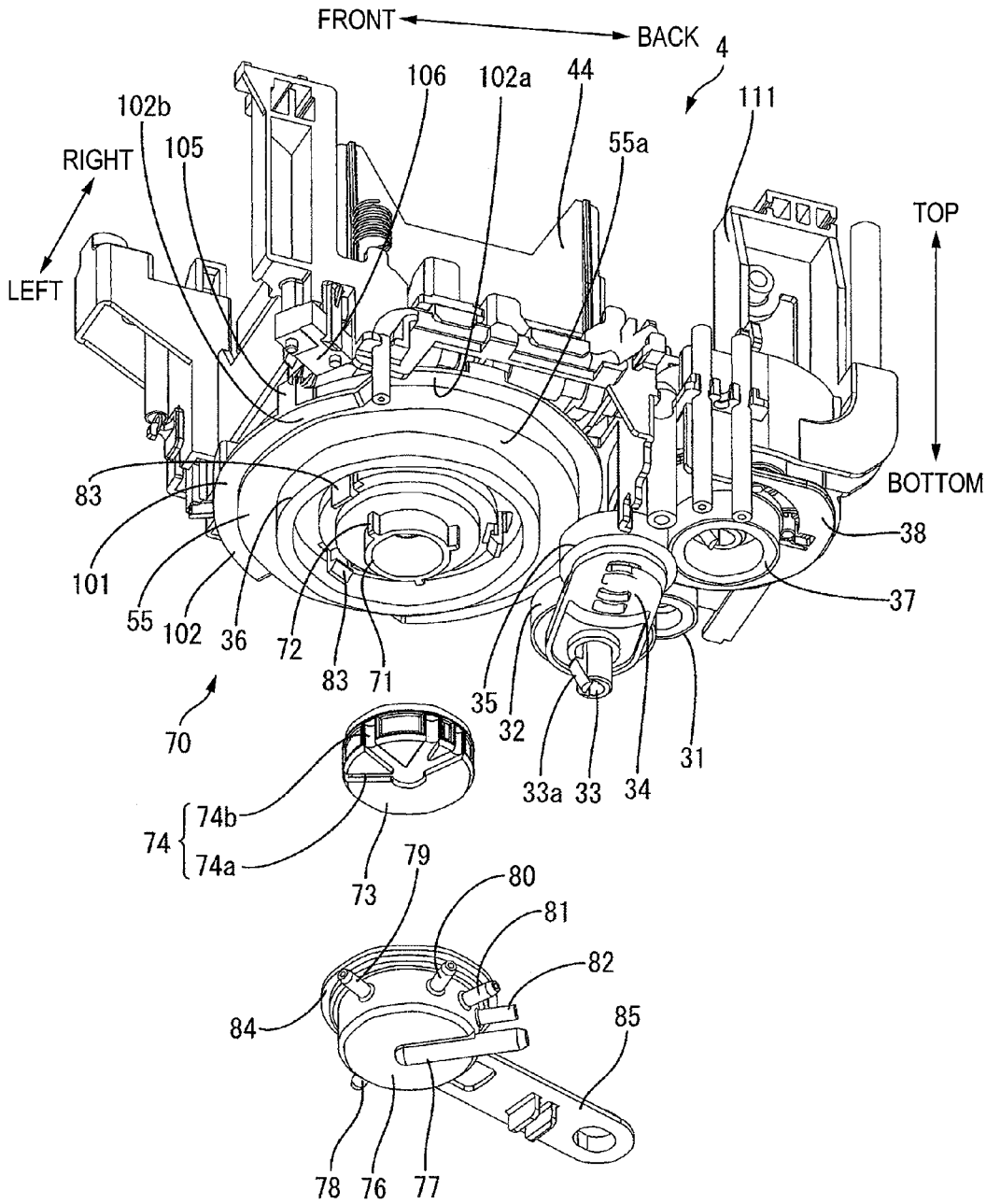
FIG. 8 is a perspective view of a maintenance mechanism when viewed from bottom.
Figure 9:
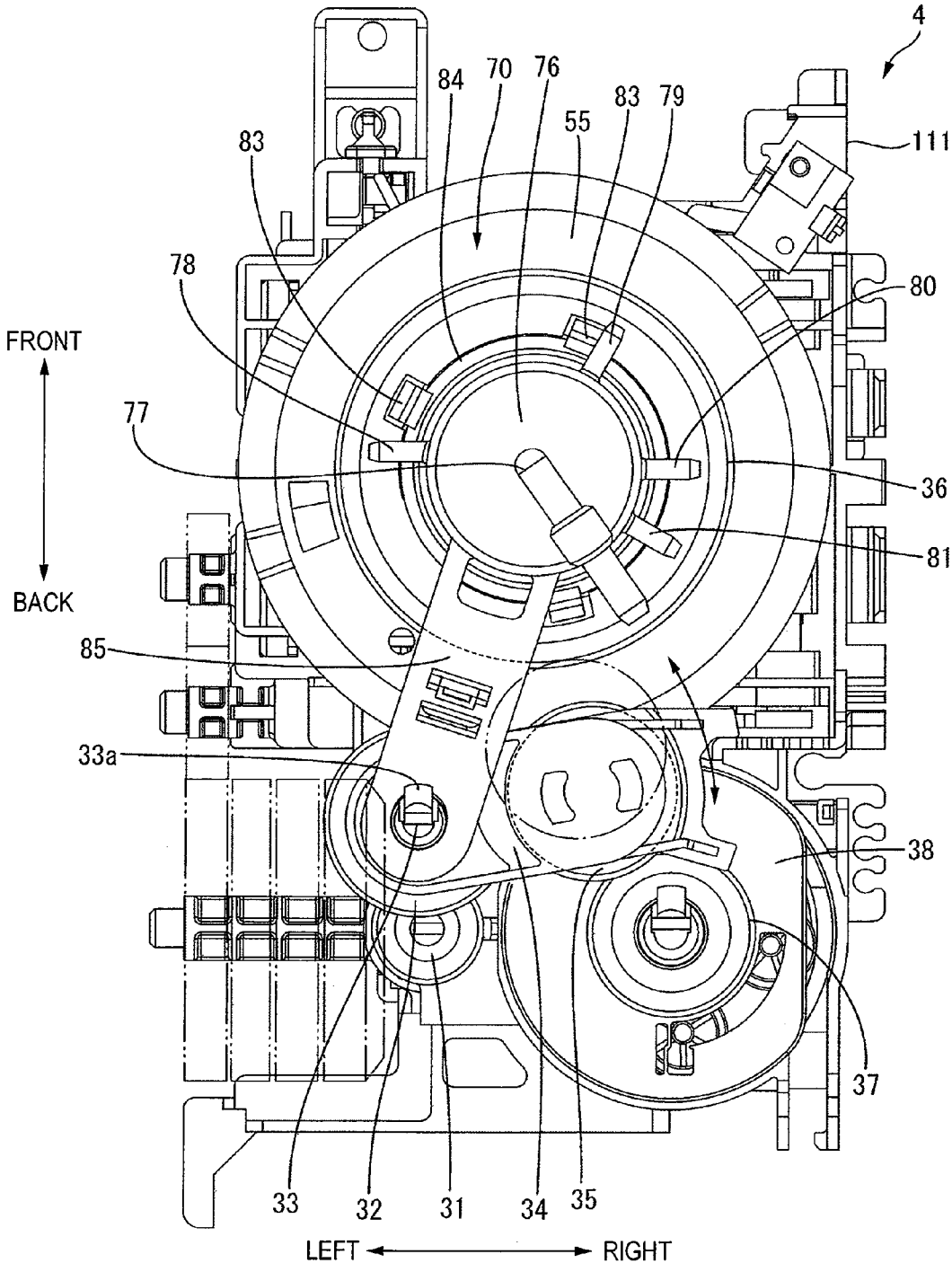
FIG. 9 is a bottom view of the maintenance mechanism.

The small-diameter bevel gear 30 is engaged with a sun gear 32 by way of a reduction gear 31. As shown in FIGS. 8 and 9, one end of a swivel arm 34 is attached to a shaft 33 of the sun gear 32 so as to freely rotate in relation to the shaft 33. A planetary gear 35 is attached to the other end of the swivel arm 34 so as to freely rotate in relation to the swivel arm 34. The planetary gear 35 is engaged with the sun gear 32. Frontward of the planetary gear 35, a disk-shaped cam 55 whose axis is parallel with those of the sun gear 32 and the planetary gear 35; that is, whose axis is oriented vertically, is rotatably supported on a maintenance frame 111. A driven gear 36 remaining flush with the planetary gear 35 is formed integrally with the cam 55. The cam 55 will be described in detail later.

Rearward of the planetary gear 35, a pump gear 37 is rotationally supported by the maintenance frame 111 at the same vertical position as the planetary gear 35. When the pump gear 37 rotates, a rotary pump 38 is driven to thus perform suction operation.

When the sun gear 32 rotates counterclockwise in FIG. 9, which is a bottom view, the planetary gear 35 revolves counterclockwise about the sun gear 32, to thus engage with the driven gear 36 of the cam 55; and the cam 55 is driven to rotate counterclockwise (clockwise when viewed from above). In contrast, when the sun gear 32 rotates clockwise, the planetary gear 35 revolves clockwise about the sun gear 32, to thus engage with the pump gear 37; and the pump 38 is rotationally driven, to thus perform suction operation. Accordingly, the rotational direction of the cam 55 is always counterclockwise in FIG. 9 (clockwise in FIGS. 15 and 16).

<Air-Discharge Cap 40 of the Maintenance Unit 4>

Figure 11:
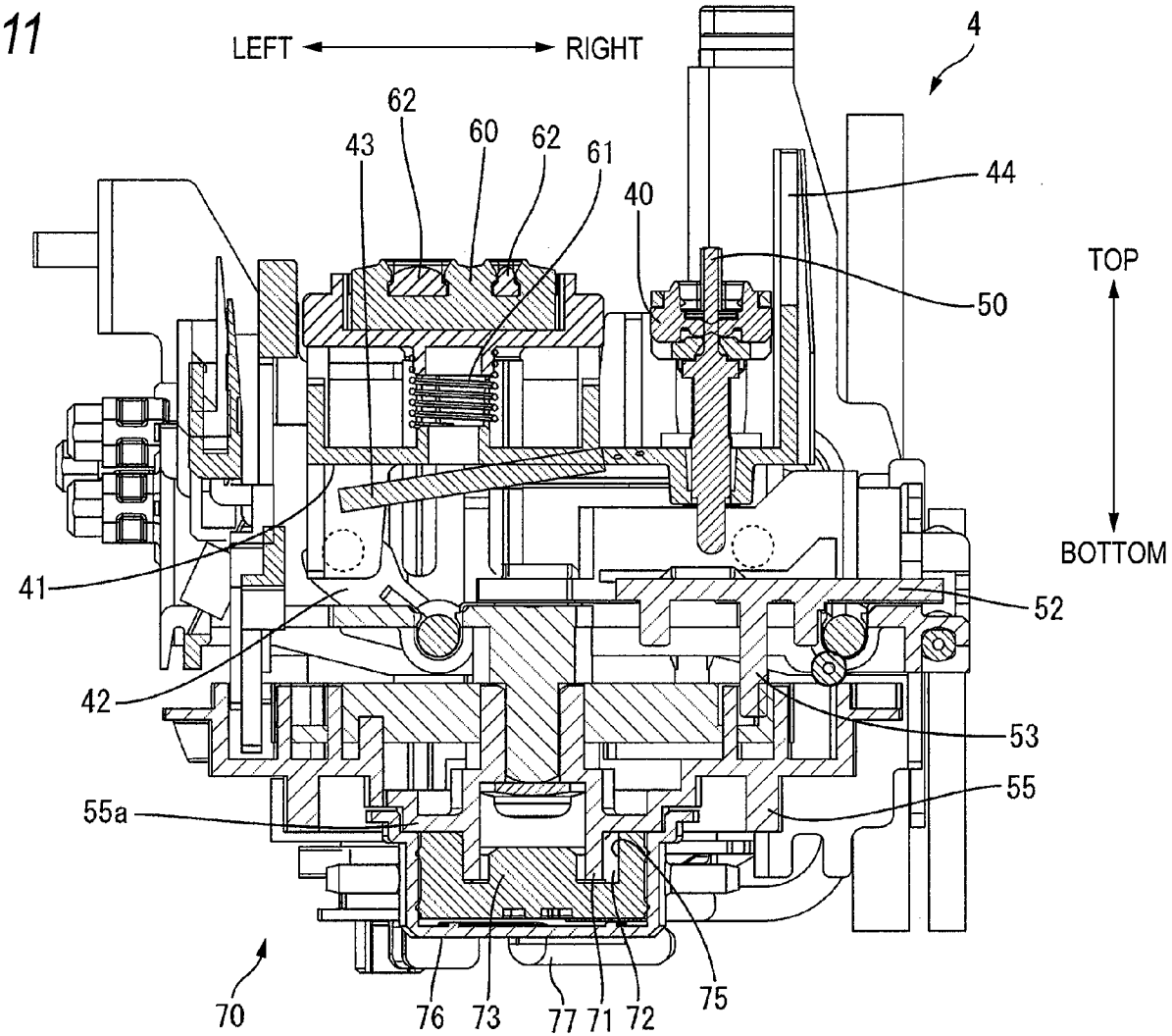
FIG. 11 is a schematic cross-sectional view showing that a cap is situated at a standby position; that an open-close member is situated at a valve-close position; and that a wiper is situated at a receded position.
Figure 12:
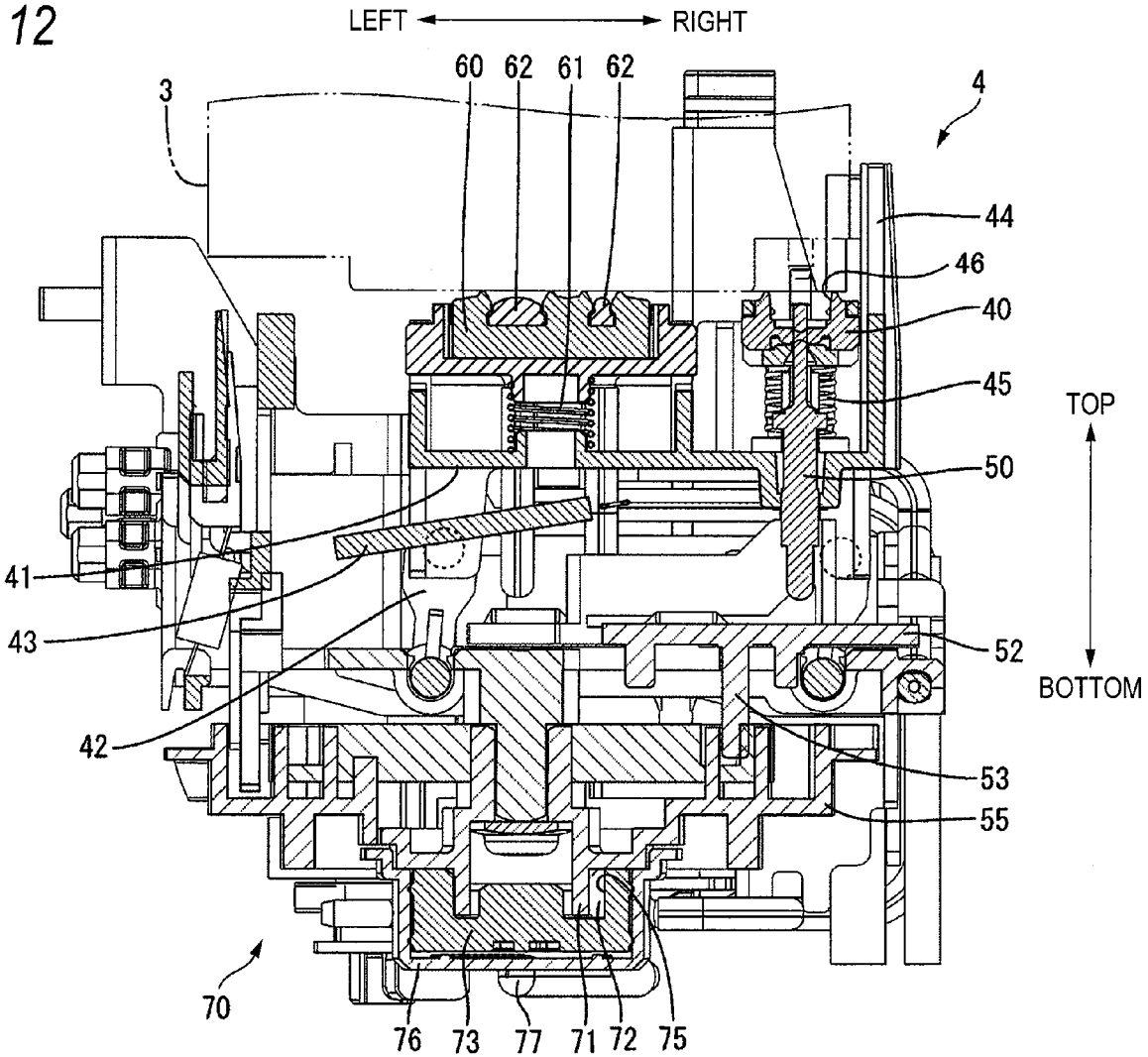
FIG. 12 is a schematic cross-sectional view showing that the carriage is located in a home position, and that the carriage remains in intimate contact with a nozzle cap.
Figure 13:
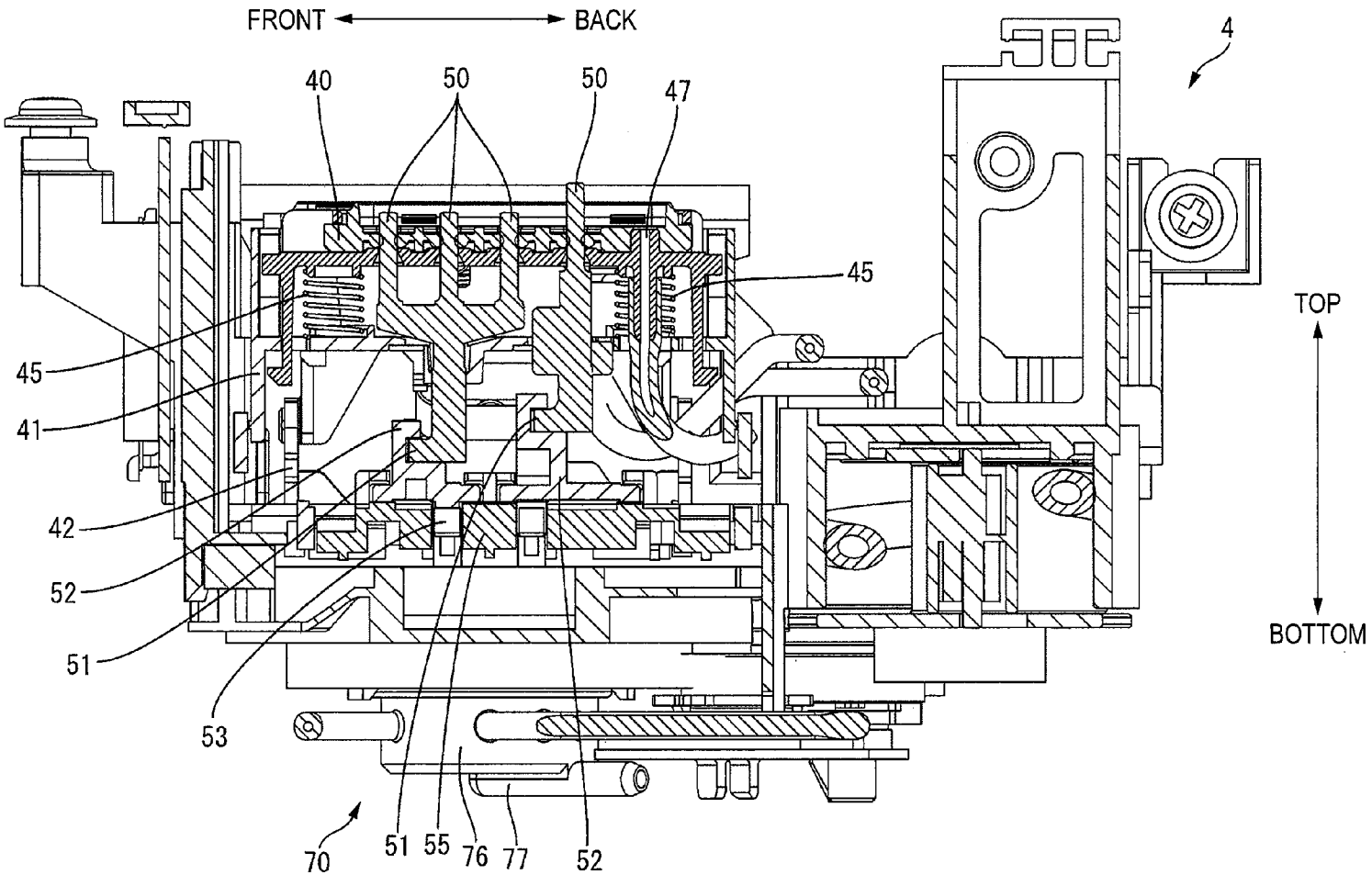
FIG. 13 is a schematic cross-sectional view showing that an open-close member for black color is situated at a valve-open position; and that an open-close member for colors is situated in a value-close position.
Figure 17:
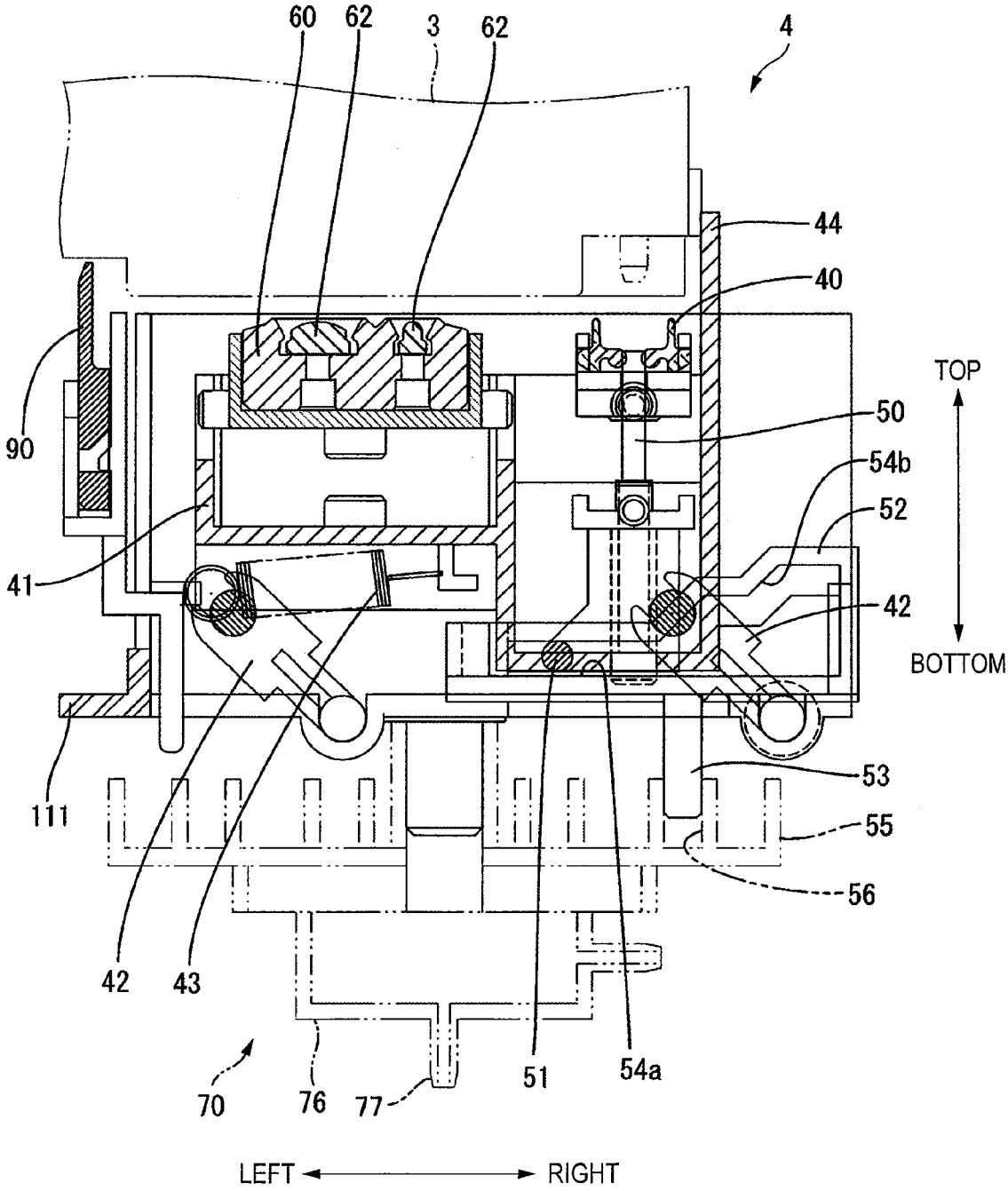
FIG. 17 is a schematic cross-sectional view showing that the carriage is situated at an idle suction position.
Figure 19:
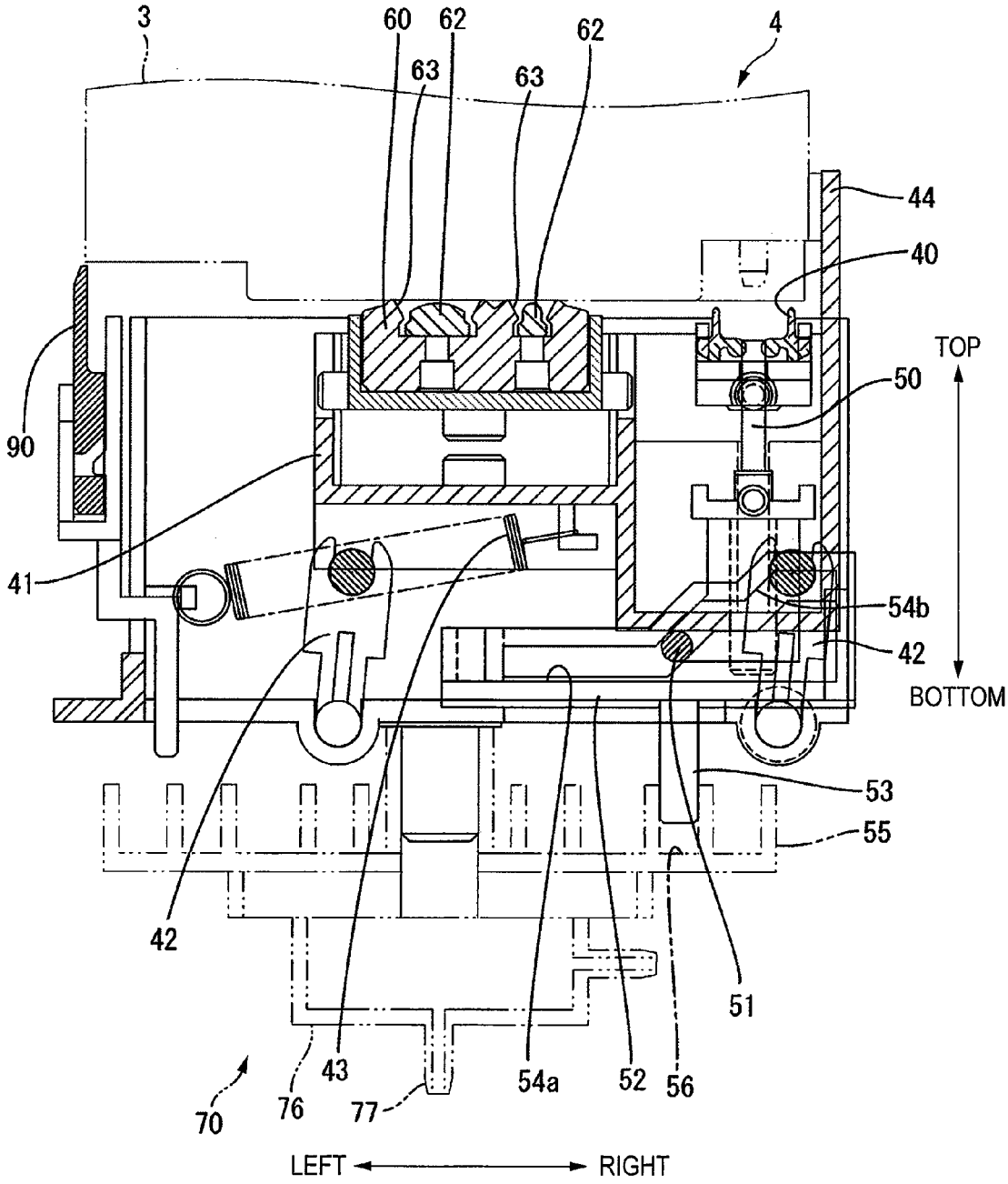
FIG. 19 is a schematic cross-sectional view showing that the carriage has moved further toward the home position from the state shown in FIG. 18, and that the degree of intimate-contact of the nozzle cap with the carriage is increased.
Figure 20:
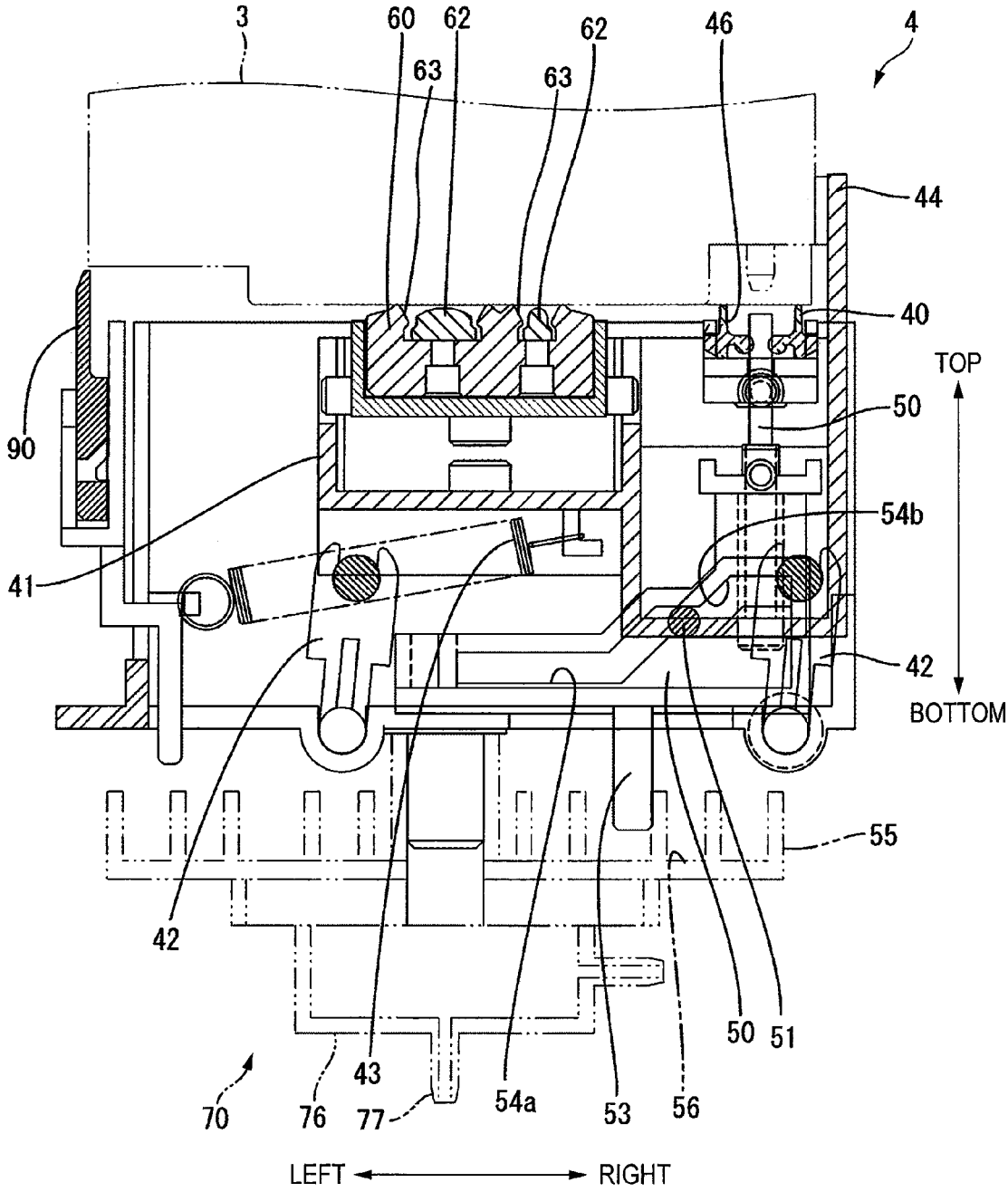
FIG. 20 is a schematic cross-sectional view showing that the carriage has moved from the idle suction position toward the home position, and that an air-discharge cap remains in intimate contact with the carriage.
Figure 21:
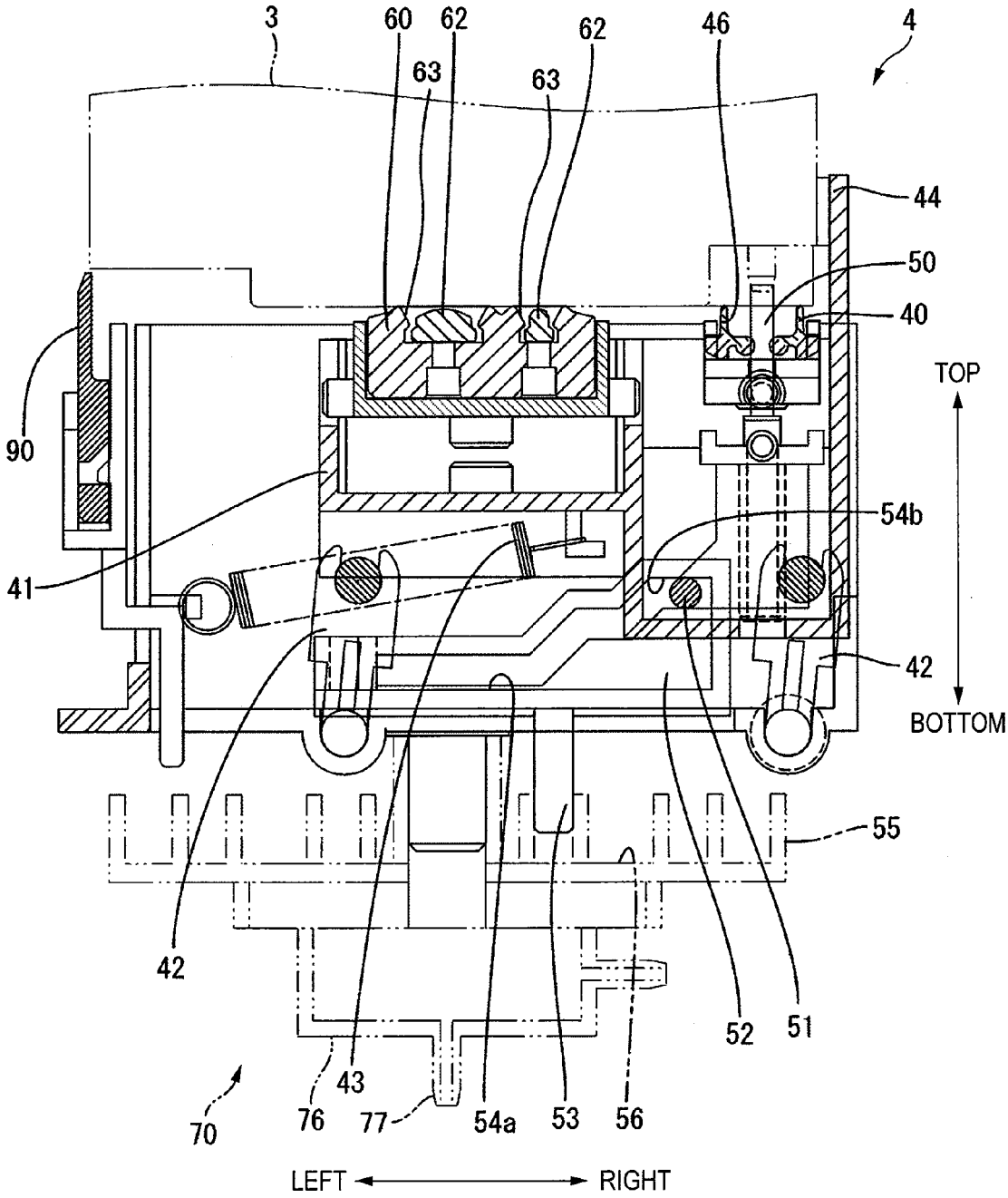
FIG. 21 is a schematic cross-sectional view showing that the open-close member has displaced to the valve-open position.

A cap lift holder 41 is movably disposed in the maintenance frame 111. As shown in FIGS. 11 to 14 and 17 to 21, the cap lift holder 41 is configured so as to be able to horizontally translate along an arc-like path between a standby position and a close-contact position, by means of a four-joint link mechanism consisting of two pairs of parallel isometric links 42, one pair being on the right side and the other pair being on the left side. As shown in FIGS. 11 and 17, the standby position corresponds to a lower left position where the nozzle cap 60 is shunted from the lower surface of the carriage 3 (the nozzle surface of the recording head 10). As shown in FIGS. 12 and 20, the close-contact position corresponds to an upper right position where the nozzle cap 60 comes into intimate contact with the lower surface of the carriage 3 (the nozzle surface of the recording head 10). At this time, the cap lift holder 41 is urged to the standby position by a return spring 43. In addition, a receiving plate 44 standing upright is formed on a right edge of the cap lift holder 41. During the course of the carriage 3 moving from the recording zone 8 to the home position (the maintenance position), the carriage 3 comes into abutment with the receiving plate 44 from the left immediately before reaching the home position. Subsequently, the carriage 3 moves the cap lift holder 41 from the standby position to the close-contact position against restoration force of the return spring 43 while pushing the receiving plate 44 until the carriage 3 reaches the home position.

The air-discharge cap 40 is supported at a right end of the cap lift holder 41 by way of a push-up spring 45 so as to be relatively movable in the vertical direction. The air-discharge cap 40 is made of silicon rubber; assumes an essentially rectangular shape elongated in the depthwise direction; and has a recessed section which has an opening in an upper surface thereof. When the cap lift holder 41 is at the standby position, the air-discharge cap 40 remains on standby at a position lower than a lower surface of the carriage 3 (the nozzle surface of the recording head 10). During the course of the cap lift holder 41 being pushed by the carriage 3 to thus cause upper-right displacement along a circular-arc shaped-path toward the close-contact position, a lip section at the upper edge of the air-discharge cap 40 is brought into intimate, airtight contact with the bottom surface of the carriage 3 (the nozzle surface of the recording head 10), thereby increasing the degree of intimate contact by means of restoration force of the push-up spring 45. By virtue of the intimate contact, an airtight space 46, which is in communication with the four discharge ports 18, is formed from the recessed section of the air-discharge cap 40 and the bottom surface of the carriage 3 (see FIGS. 12, 20, and 21). An air-inlet port 47 (see FIGS. 7 and 10) is opened in a rear end of the bottom wall of the air-discharge cap 40 so as to come into communication with the recessed section. The air-inlet port 47 is connected to an air-discharge port 78 of a switching unit 70, which will be described later, by way of a tube.

<Open-Close Member 50 of the Maintenance Unit 4>

Four rod-shaped open-close members 50, which are aligned in the depthwise direction, pass through the bottom wall of the air-discharge cap 40 in such a manner as to be able to slide vertically while maintaining the airtight state. Of the four open-close members 50, an open-close member 50 for black ink and located at the rearmost position can independently move vertically in relation to the air-discharge cap 40. A laterally-protruding cam follower 51 (see FIGS. 17 to 21) is formed at the lower end of the open-close member 50 for black color. Of the four open-close members 50, the three open-close members 50 for ink of colors located in front positions are connected with each other below the air-discharge cap 40, and are configured so as to move vertically as a unit. Another laterally-protruding cam follower 51 is formed at lower ends of the open-close members 50 for ink of colors, as well. The two cam followers 51 are separately engaged with cam guides of two sliders 52 which are reciprocally driven in the horizontal direction by the cam 55 and consist of a front slider and a rear slider. The sliders 52 will be described in detail later.

Incidentally, the air-discharge cap 40 moves together with the cap lift holder 41 as a unit. The open-close member 50 displaces in conjunction with the air-discharge cap 40 as a unit in the horizontal direction but displaces in relation to the air-discharge cap 40 in the vertical direction. Thus, since the open-close member 50 is allowed to undergo relative movement in the vertical direction, the open-close member 50 always maintains engagement with the sliders 52, irrespective of the position of the cap lift holder 41.

<Drive Mechanism of the Open-Close Member 50>

Figure 15:
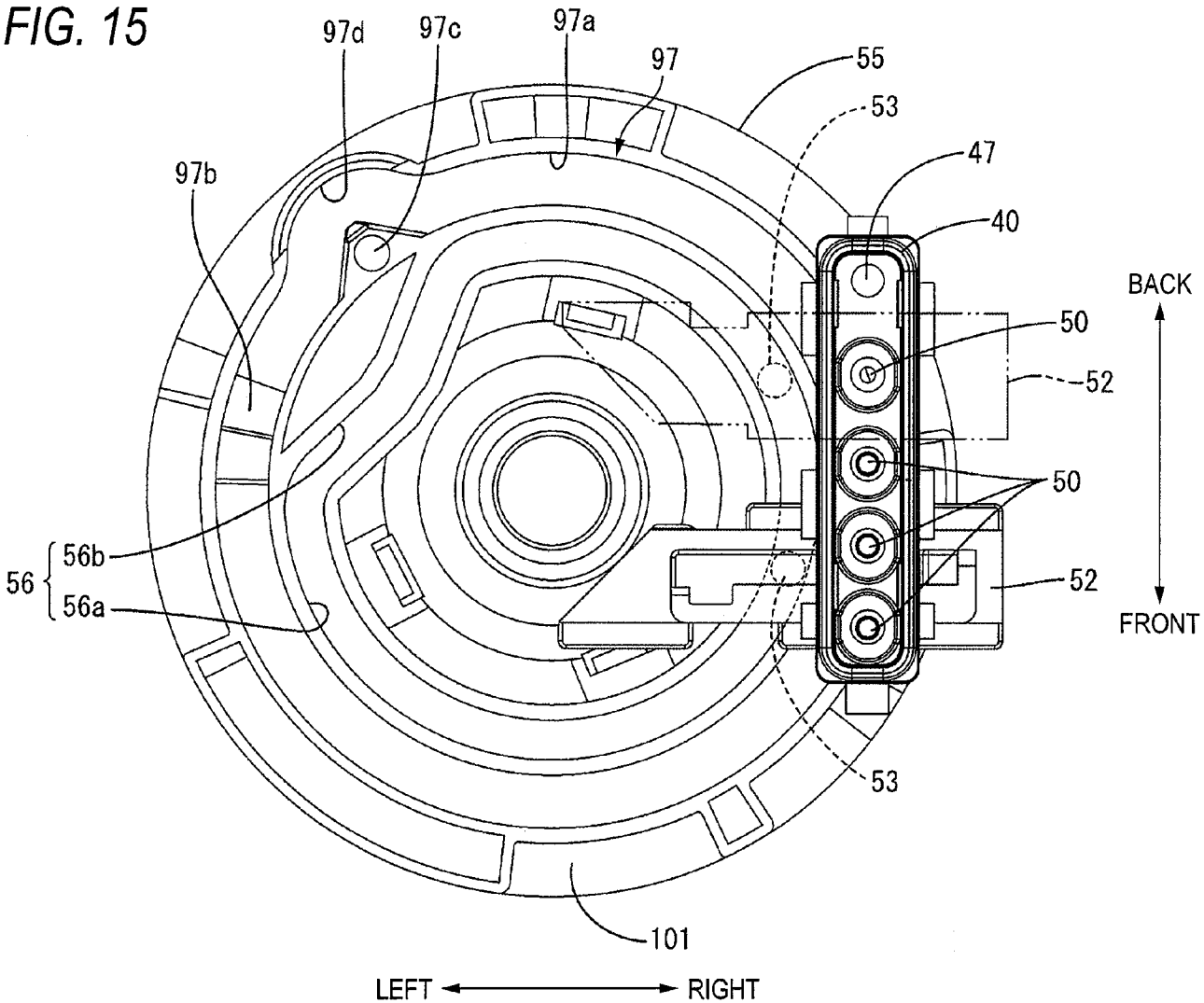
FIG. 15 is a plan view of a cam showing that the open-close member for colors is situated at the valve-close position.
Figure 16:
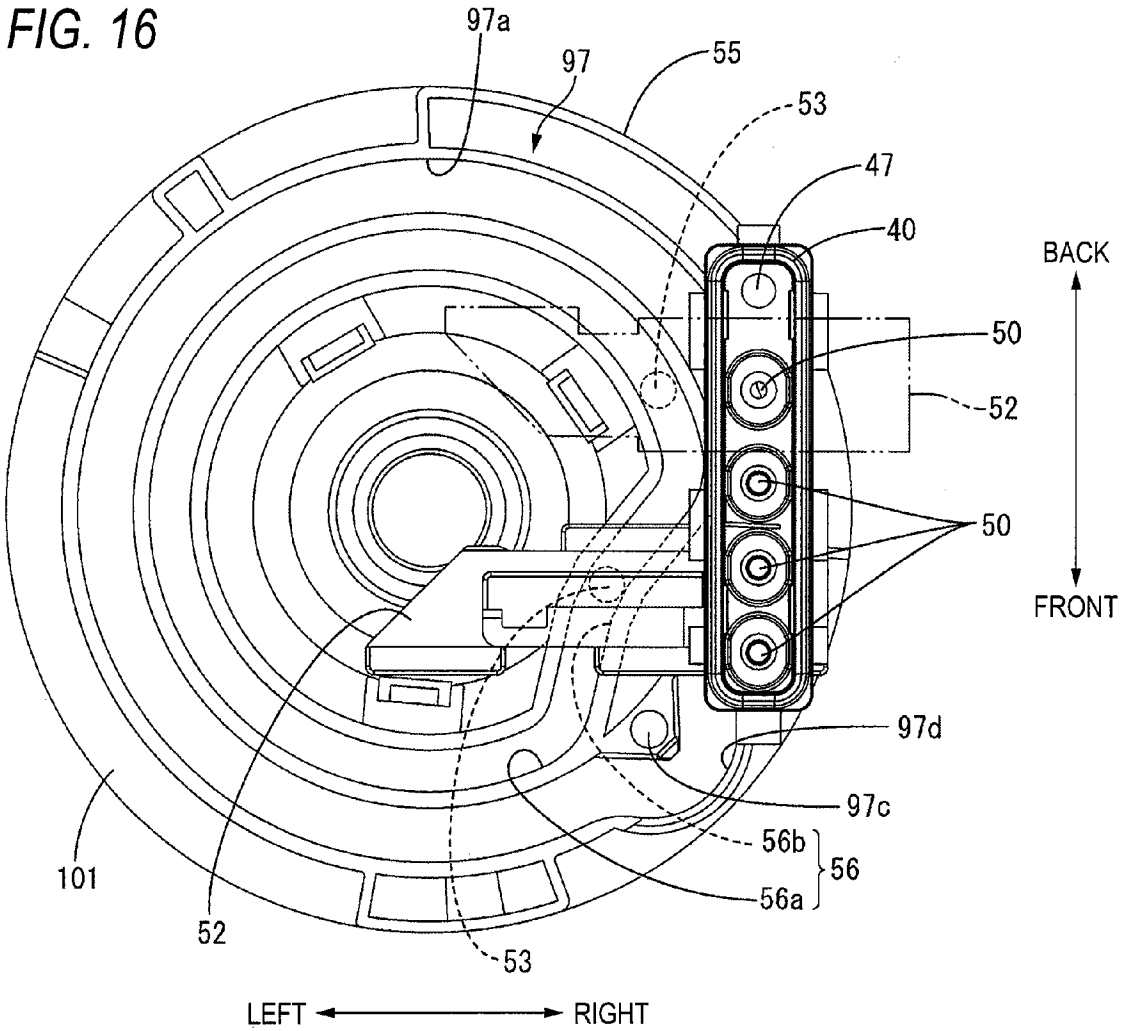
FIG. 16 is a plan view of the cam showing that the open-close member for colors is situated at the valve-open position.

An inner cam groove 56 is formed in the upper surface of the cam 55. As shown in FIGS. 15 and 16, the inner cam groove 56 is formed from a non-drive region 56*a* and a drive region 56*b*. The non-drive region 56*a* assumes an arc-shape concentric with the cam 55. The drive region 56*b* is contiguous with the non-drive region 56*a* and curved closer to a radial center than is the non-drive region 56*a*. In addition, the two sliders 52 consisting of the front slider and the rear slider are supported by the maintenance frame 111 such that the two sliders 52 are capable of individually moving parallel to the horizontal direction (i.e., a direction parallel to the moving direction of the carriage 3) above the cam 55. The cam followers 53 protruding downward from the respective sliders 52 are engaged with the inner cam groove 56 at positions rightward in relation to the center of the cam 55. In a state where the cam followers 53 are engaged with the non-drive region 56*a*, the sliders 52 are on standby in the rightward positions (see FIG. 15). When the cam followers 53 are engaged with the drive region 56*b*, the sliders 52 slide leftward (see FIG. 16). The slider 52 located in a rear position (an upper position in FIG. 15) is for driving the open-close member 50 for black ink; and the slider 52 located in a forward position is for driving the open-close member 50 for ink of colors.

A free guide 54*a* and a cam guide 54*b*, which are for engaging with the cam follower 51 of the open-close member 50, are formed in each of the sliders 52. As shown in FIGS. 17 to 21, the free guide 54*a* has a path which extends linearly in the horizontal direction (i.e., parallel to the moving direction of the sliders 52) and whose right end portion is inclined rightward and upward. The cam guide 54*b* has a slant section which is continuous with the right end of the free guide 54*a* and a stepwise upward slope to the right.

In a state where the cap lift holder 41 is at the standby position, the cam follower 51 of the open-close member 50 always maintains engagement with the free guide 54*a* regardless of whether the slider 52 is engaged with the non-drive region 56*a* or the drive region 56*b* of the cam 55, and will not engage with the cam guide 54*b*. When the carriage 3 moves the cap lift holder 41 to the close-contact position, the slider 52 of the open-close member 50 having been displaced rightward together with the cap lift holder 41 is engaged with the cam guide 54*b* by way of the free guide 54*a*. At this time, if the cam follower 53 of the slider 52 is engaged with the non-drive region 56*a*, the cam follower 51 of the open-close member 50 will mesh with the lowermost left end (flush with the right end of the free guide 54*a*) of the cam guide 54*b*, whereby the open-close member 50 enters a standby condition at the lowest valve-closing position. In this valve-closing position, the upper end of the open-close member 50 is located lower than the lower end of the valve body 20 of the reclosable valve 19. Accordingly, the reclosable valve 19 is maintained in the valve-closed state.

When the cam follower 53 of the slider 52 shifts from the above state to a state where the cam follower 53 engages with the drive region 56*b* of the cam 55, to thus slide leftward, the cam follower 51 of the open-close member 50 climbs the slope section while moving in the rightward direction in relation to the cam guide 54*b*. Accordingly, the open-close member 50 ascends from the valve-closing position and moves to the valve-opening position. When the open-close member 50 has moved to the valve-opening position, the upper end of the open-close member 50 abuts the lower end of the valve body 20, thereby pushing up the valve body 20. Consequently, the reclosable valve 19 enters the valve-open state. More specifically, the open-close member 50 is configured so as to advance from the valve-closing position to the valve-opening position in a direction substantially perpendicular to the moving direction of the carriage 3 while moving into the corresponding discharge passage 17 of the carriage 3, thereby opening the reclosable valve 19.

<Nozzle Cap 60 of the Maintenance Unit 4>

The nozzle cap 60 is supported on a region of the cap lift holder 41 which is on the left side in relation to the air-discharge cap 40 so that the nozzle cap 60 can relatively move in the vertical direction by way of a push-up spring 61 (see FIGS. 11 and 12). The nozzle cap 60 is made of silicone rubber and substantially rectangular, elongated in the depthwise direction, and has two, right and left, recessed sections whose top faces are opened. A spacer 62 having a vault cross-sectional profile with a bulging upper face is disposed in each of the recessed sections. When the cap lift holder 41 is at the standby position, the nozzle cap 60 remains on standby at a position lower than the bottom face of the carriage 3 (the nozzle surface of the recording head 10). During the course of the cap lift holder 41 being displaced in an obliquely upward, rightward direction along an arc-like path toward the close-contact position as a result of the carriage 3 having come into contact with the receiving plate 44 and moved further in the rightward direction, a lip section at the upper edge of the nozzle cap 60 comes into intimate, airtight contact with the lower surface of the carriage 3 (the nozzle surface of the recording head 10), thereby increasing the degree of intimate contact by means of restoration force of the push-up spring 61. By means of the intimate contact, two independent, enclosed spaces 63 remaining in communication with the nozzles of the recording head 10 are formed simultaneously from top surfaces of the spacers of the nozzle cap 60 and the lower surface of the carriage 3 (see FIGS. 19 to 21). A right-side, narrow enclosed space 63 for black color corresponds to the nozzle of black color, and a left-side wide enclosed space 63 for ink of colors corresponds to the nozzles of three colors.

Figure 7:
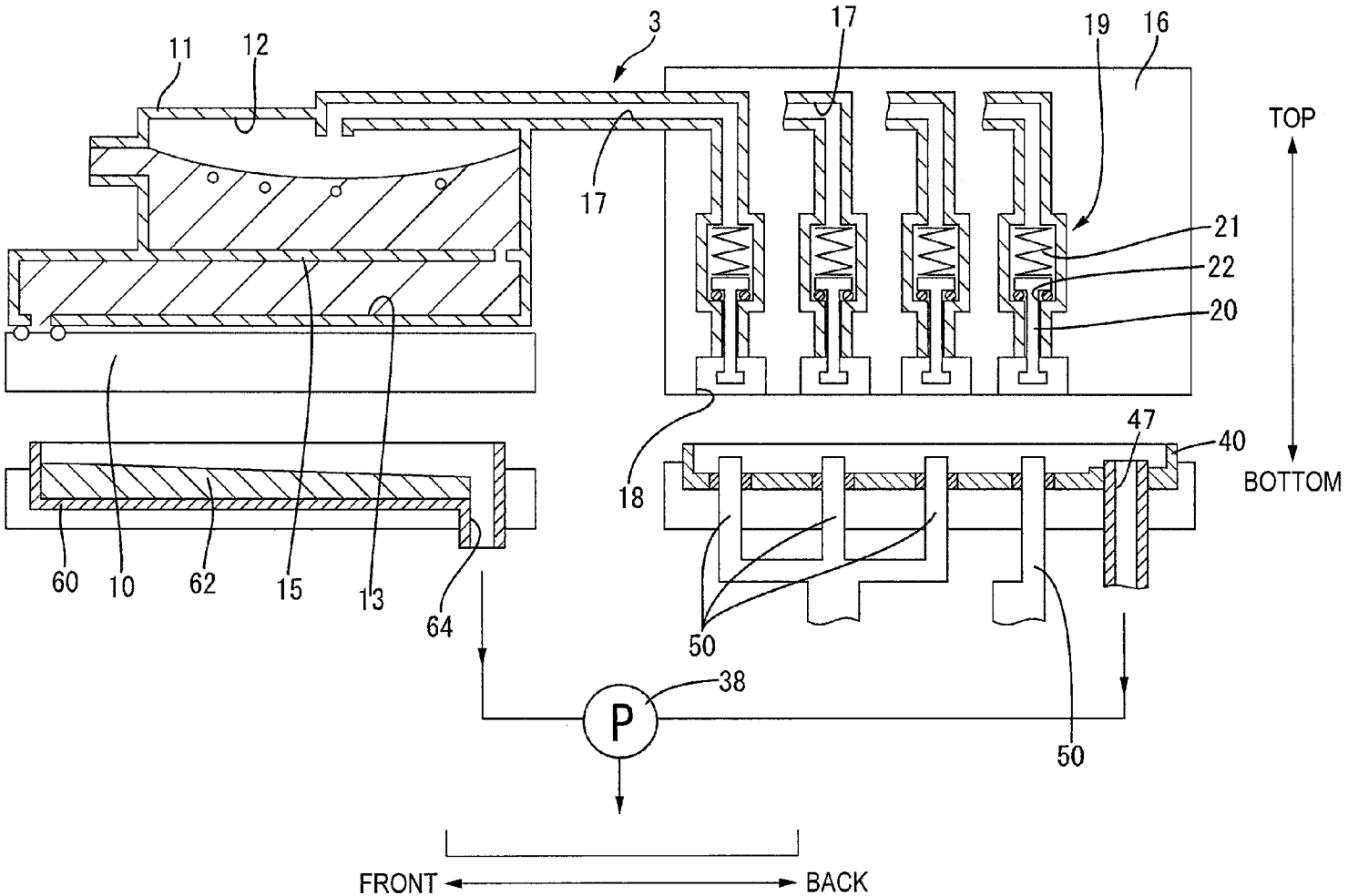
FIG. 7 is a schematic cross-sectional view diagrammatically showing the carriage and a recording head.
Figure 10:
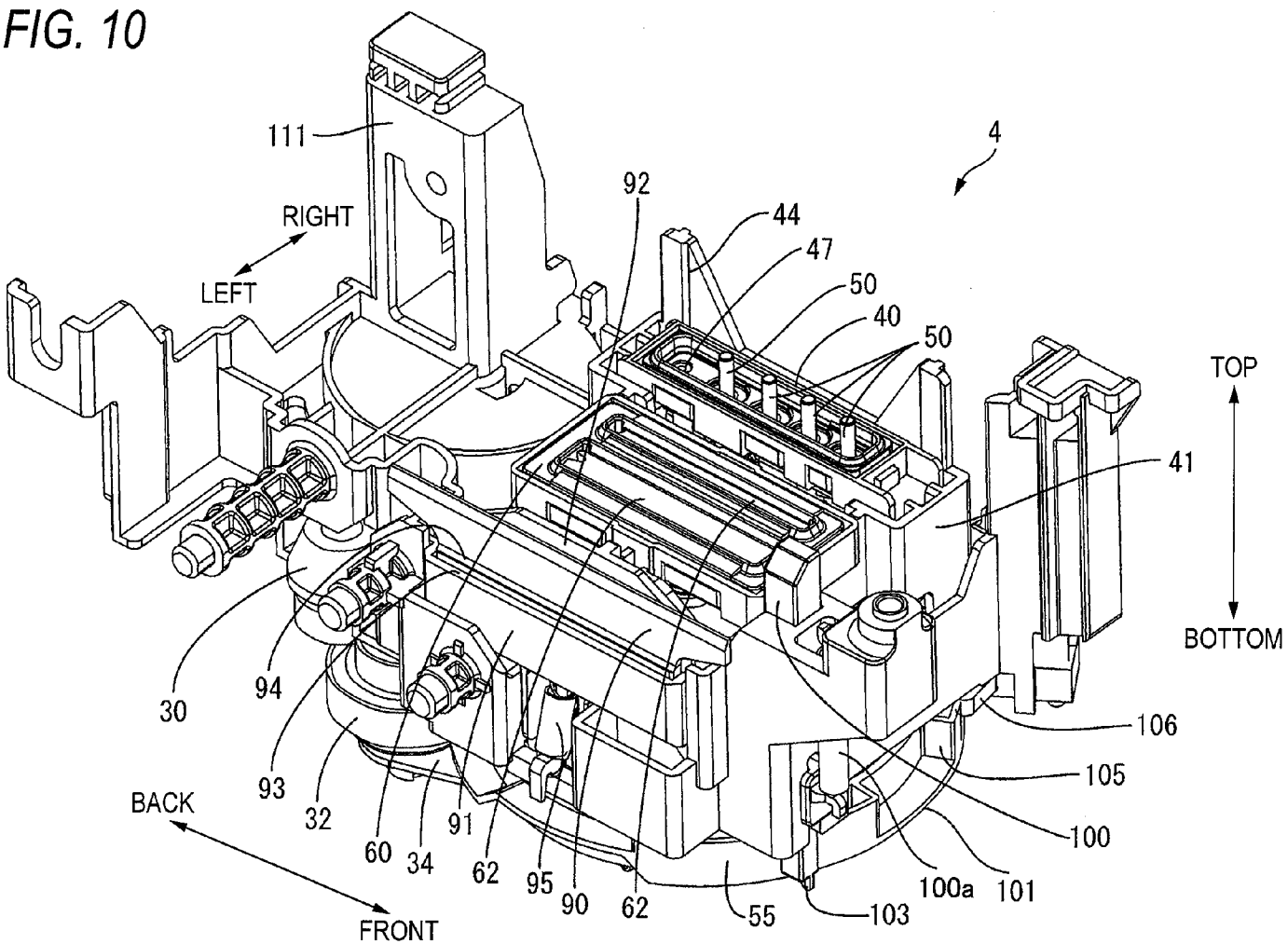
FIG. 10 is a perspective view of the maintenance mechanism when viewed from top.

An air-inlet port 64 is opened in the bottom wall of each the recessed sections of the nozzle cap 60 so as to be situated at the rear end (at one end in the longitudinal direction) of the bottom wall (see FIGS. 7 and 10). The air-inlet port 64 in the narrow recessed section for black ink is connected to a black ink port 79 (hereinafter, referred to as a "Bk port") of the switching unit 70 by way of a tube. The air-inlet port 64 in the wide recessed section for colors of ink is connected to a color ink port 80 (hereinafter, referred to as a "Co port") of the switching unit 70 by way of a tube. Each of the enclosed spaces 63 is of a form whose vertical gap is the narrowest at a center in the horizontal direction (i.e., in the width direction), and is gradually increased to the right and left. Therefore, when negative pressure is built up within the enclosed space 63 so as to suck ink in the nozzles to the air-inlet port 64, an airflow (air-containing ink)—which runs from the center to the right and left sides (toward sides where flow resistance is low) with respect to the horizontal direction—is generated so as to be substantially uniform in the depthwise direction. The airflows meet each other at the respective horizontal ends of the enclosed space 63, to thus form a large flow running to the air-inlet port 64 (in the rearward direction) and be drawn into the air-inlet port 64 by suction. Accordingly, even when the air-inlet port 64 is disposed at the rear end of the depthwise-elongated enclosed space 63, the airflow can be made substantially uniform over the entire region, to thus enable uniform purging of ink from all the nozzles.

<Switching Unit 70 of the Maintenance Unit 4>

The switching unit 70 has the function of switching the airtight space 46 formed by the air-discharge cap 40 between a state where the airtight space 46 is brought in communication with the pump 38 and a state where the airtight space 46 is disconnected from the pump 38; and the function of switching the enclosed space 63 formed by the nozzle cap 60 between a state where the enclosed space 63 is brought into communication with the pump 38 and a state where the enclosed space 63 is disconnected from the pump 38. As shown in FIG. 8, the switching unit 70 comprises an attachment section 71 formed on the lower face of the cam 55, a switching member 73, and a cover 76.

As shown in FIG. 8, the attachment section 71 assumes a circular shape concentric with the cam 55 and the driven gear 36. Positioning protrusions 72 are formed along the outer periphery of the attachment section 71. The switching member 73, which is made of rubber, is of a disk shape. A changeover channel 74 is formed on the outer surface of the switching member 73. The changeover channel 74 comprises four branched grooves 74*a* extending radially from the center of the lower surface of the switching member 73, and communication grooves 74*b* formed in the outer periphery of the changeover member 73 so as to be continuous with the outer peripheral edges of the respective branched grooves 74*a*. The switching member 73 is fit in the attachment section 71 while causing a positioning groove 75 on the top of the switching member 73 to fit over the attachment section 71, including the positioning protrusions 72 (see FIGS. 11 and 12). Thereby, the switching member 73 is attached to the cam 55 and the driven gear 36 so as to rotate concentrically and integrally therewith.

The cover 76 is made of a synthetic resin, and assumes the form of a closed-end cylinder. An air-inlet port 77 is formed in the center of a bottom wall of the cover 76. The air-inlet port 77 is connected to the pump 38 by way of a tube. In view of the nature of FIGS. 17 to 21, accurate depiction of the air-inlet port 77 is not important. In contrast with other drawings (FIGS. 8, 9, and 11 to 14) which accurately illustrate the air-inlet port 77, the air-inlet port 77 is simply depicted so as to extend in the vertical direction in FIGS. 17 to 21. Five ports 78 to 82 are formed in the circular circumferential wall of the cover 76 with predetermined angular intervals therebetween. The first port of the five ports is a discharge port 78 communicating with the airtight space 46 formed by the discharge cap 40. The second port is the Bk port 79 (the port for black ink) communicating with the enclosed space 63 for black ink formed from the nozzle cap 60. The third port is the Co port 80 (the port for colors of ink) communicating with the enclosed space 63 for colors of ink formed by the nozzle cap 60. The remaining two ports are air ports 81, 82 opened to the atmosphere.

The cover 76 is attached to the cam 55 by means of three latch claws 83 formed on the lower surface of the cam 55. More specifically, a flange 84 is formed continuously along the entire outer periphery of the cover 76. The three latch claws 83 are spaced at predetermined angular intervals from each other along a circumference concentric with the cam 55, thereby enabling radial elastic deformation. When the cover 76 is assembled to the lower surface of the cam 55, the three latch claws 83 are hooked on the lower surface of the flange 84 from the outer periphery thereof. As a result, the cover 76 is supported so as to be able to rotate in relation to the cam 55 and the switching member 73 while being restricted in relative displacement in the vertical direction (i.e., in the direction along the rotational axis of the cam 55). In a state where the cover 76 is assembled to the cam 55, the switching member 73 is housed in the cover 76, and a lip section on the outer periphery of the switching member 73 remains in intimate contact with the inner periphery of the cover 76. When relative rotation occurs between the cover 76 and the switching member 73, sliding resistance (frictional resistance) develops between the lip section on the outer periphery of the switching member 73 and the inner periphery of the cover 76.

A radially-extending arm section 85 is integrally formed on the outer periphery of the cover 76. The extended end of the arm section 85 is fitted to the shaft 33 of the sun gear 32 in a relatively rotatable manner. As a result of the arm section 85 being fitted to the shaft 33, the cover 76 is restricted in rotation in relation to the maintenance frame 111, and the ports 78 to 82 of the cover 76 are also fixedly arranged. Meanwhile, a retaining protrusion 33*a* on the shaft 33 prevents the arm section 85 from slipping off in a downward direction. The swivel arm 34 is sandwiched between the arm section 85 and the sun gear 32 located above the arm section 85 while being allowed to rotate in relation to the shaft 33.

During the course of the switching member 73 rotating within the cover 76, switching takes place between a state where none of the four communication grooves 74*b* of the switching paths 74 are in communication with the ports 78 to 82 and a state where any one to three of the four communication grooves 74*b* come in communication with the corresponding ports 78 to 82. In the state where none of the four communication grooves 74*b* correspond to the ports 78 to 82, all of the ports 78 to 82 are disconnected from the pump 38. When the communication grooves 74*b* are in communication with the ports 78 to 82, any of the ports 78 to 82 corresponding to the communication grooves 74*b* are brought into communication with the pump 38 by way of the changeover channels 74, or the plurality of ports 78 to 82 corresponding to the communication grooves 74*b* are brought into communication with one another by way of the changeover channel 74 and also with the pump 38. Specific switching modes will be described in detail later.

<Wiper 90 of the Maintenance Unit 4>

An outer cam groove 97 is formed in the upper surface of the cam 55. The outer cam groove 97 is arranged substantially concentrically outside of the inner cam groove 56 for the open-close member 50. The outer cam groove 97 comprises an arc section 97*a* concentric with the cam 55; a protuberance section 97*b* which is formed in a circumference having substantially the same diameter as the arc section 97*a*; that is, in an arbitrary position on the arc section 97*a*; a release section 97*c* which is arranged on a circumference having substantially the same diameter as the arc section 97*a*; and a recessed relief section 97*d* which is arranged so as to correspond to the release section 97*c* at a radially-outward position.

The wiper 90 is for wiping the ink adhering to the nozzle surface of the recording head 10. The wiper 90 is provided on the maintenance frame 111 so as to situate leftward in relation to the cap lift holder 41; that is, to situate at a position in the travel path of the carriage 3 between the home position (the maintenance position) and the recording zone 8. The entirety of the wiper 90 assumes the shape of a plate which extends in a direction substantially perpendicular to the moving direction of the carriage 3, and is fastened to a wiper holder 90*a*. Since the wiper holder 90*a* is configured so as to be able to vertically move, the wiper 90 is situated above the cam 55 and can move between the receded position (see FIG. 24) where the wiper 90 remains on standby below the travel path of the carriage 3, and the wiping position (see FIG. 22) from which the wiper 90 advances onto the travel path of the carriage 3.

The wiper 90 is disposed between a restriction plate 91 located on the left and a tabular stopper 92 located on the right with predetermined clearances therebetween. By virtue of the above configuration, the wiper 90 is guided so as to be able to ascend and descend without being horizontally displaced to a great extent. A latching section 93 is formed above the restriction plate 91 located on the left of the wiper holder 90*a*, and a leftwardly-protruding latch protrusion 94 is formed on the side surface of the wiper holder 90*a*. The latch protrusion 94 is latched by the latching section 93 from above, whereby the wiper 90 is held in the wiping position. In addition, a spring 95 for urging the wiper holder 90*a* in a downward left direction is provided between a position which is lower than the restriction plate 91 on the wiper 90 and the maintenance frame 111. Furthermore, a downwardly-protruding cam follower 96 is formed on the wiper holder 90*a*. The cam follower 96 is engaged with the outer cam groove 97 at a position leftward in relation to the center of the cam 55.

As mentioned above, the outer cam groove 97 is concentric with the cam 55, and comprises the arc section 97*a*, the protuberance section 97*b*, and the release section 97*c*. The arc section 97*a* can hold the wiper 90 (the wiper holder 90*a*) at the receded position. The protuberance section 97*b* is provided on a circumference whose diameter is substantially identical with that of the arc section 97*a*, and interferes with the wiper 90 (the wiper holder 90*a*) remaining at the receded position, thereby pushing the wiper 90 to the wiping position. The release section 97*c* is provided on the circumference whose diameter is identical with that of the arc section 97*a*, and radially interferes with the cam follower 96 of the wiper 90 remaining at the wiping position.

In a state where the cam follower 96 is engaged with the arc section 97*a*, the cam follower 96 remains in contact with the upper surface of the arc section 97*a* by means of restoration force of the spring 95. At this time, the wiper 90 is held at the receded position. Thereafter, when the protuberance section 97*b* approaches the cam follower 96, the cam follower 96 climbs on the protuberance section 97*b*, whereby the wiper 90 rises to the wiping position. During the above operation, the wiper 90 is pressed against the restriction plate 91 by means of obliquely leftward pulling action of the spring 95. Accordingly, when the wiper 90 has reached the wiping position, the latch protrusion 94 is latched by the latching section 93, and the wiper 90 is held in the wiping position by means of latching action.

A wiping section on the upper end of the wiper 90 remaining at the wiping position protrudes higher than the restriction plate 91. The wiper 90 comes into contact with the restriction plate 91 from the right, and the cam follower 96 is brought into contact with the outer peripheral surface of the arc section 97*a* from the right. In these states, the wiper 90 is pulled by the spring 95 in a downward left direction. Therefore, even when the carriage 3 interferes with the upper end of the wiper 90 from the right [i.e., during the course of the carriage 3 moving from the home position (the maintenance position) to the recording zone 8], the wiper 90 is pressed against the restriction plate 91, so that the latch protrusion 94 remains latched by the latching section 93. At this time, the wiper 90 rubs the nozzle surface of the recording head 10, thereby removing the ink adhering to the nozzle surface.

In contrast, when the carriage 3 interferes with the upper end section of the wiper 90 from the left, the wiper 90 changes its attitude so as to tilt rightward, and the wiper holder 90*a* also changes its attitude so as to tilt rightward in association with the change in the attitude of the wiper 90. Consequently, the latch protrusion 94 is disengaged from the latching section 93 of the restriction plate 91. Accordingly, the wiper holder 90*a* is lowered by means of restoration force of the spring 95. Consequently, the wiper 90 is also lowered from the wiping position to the receded position.

In addition, the wiper 90 remaining at the wiping position is lowered to the receded position by the release section 97*c* of the cam 55. More specifically, when a tapered surface of the release section 97*c* comes into contact with a lower end of the cam follower 96 in accordance with rotation of the cam 55, the lower end of the cam follower 96 is pushed leftward by means of inclination of the tapered surface, to thus be displaced in the recessed relief section 97*d*. Specifically, the release section 97*c* radially interferes with the wiper holder 90*a*. In association with interference, the wiper 90 and the wiper holder 90*a* change their attitudes so as to tilt rightward while taking a lower end edge of the restriction plate 91 as a fulcrum. Consequently, the latch protrusion 94 is rightwardly released from the latching section 93 of the restriction plate 91. For this reason, the wiper holder 90*a* is lowered by restoration force of the spring 95, and the wiper 90 is also lowered from the wiping position to the receded position.

<Carriage Lock 100 of the Maintenance Unit 4>

A circular flange section 101 whose lower surface is formed into a cam face 102 is formed on the outer periphery of the cam 55. A region which is partially upwardly recessed; that is, a partially protruding region, is formed on the cam face 102. The region serves as a lock region 102*a* (see FIG. 8). In addition, a portion of the cam face 102 which is lower than the lock region 102*a* serves as a lock-release region 102*b*. A carriage lock 100, which functions as a regulation unit, is supported in a vertically-movable manner in relation to the maintenance frame 111, as well as being upwardly urged by a spring 100*a* (see FIG. 10). A cam follower 103 formed on the lower end of the carriage lock 100 is held in contact with the cam face 102 from underneath. Accordingly, the majority of the carriage lock 100 is situated higher than the cam 55. When the cam follower 103 remains in contact with the lock release region 102*b*, the carriage lock 100 is held at a lower lock-release position against the restoration force of the spring 100*a*. When the cam follower 103 remains in contact with the lock region 102*a*, the carriage lock 100 is moved upward by means of restoration force of the spring 100*a*, thereby advancing to the travel path of the carriage 3. At this time, if the carriage 3 is located at the home position (or the maintenance position), the upper end of the carriage lock 100 advances to the travel path of the carriage 3, as well as becoming able to latch the front end section on the left side face of the carriage 3. Hence, leftward movement of the carriage 3; that is, movement of the carriage 3 to the recording zone 8, is restricted by means of latching.

<Control Unit for Rotational Position of the Cam 55>

A section to be detected 105 (hereinafter called an "object section") is provided on the flange 101 along the outer periphery of the cam 55 so as to rotate in conjunction with the cam 55. A leaf switch 106, which is switched ON or OFF by the object section 105 in accordance with rotation of the cam 55, is provided on the maintenance frame 111. When the leaf switch 106 is brought into an ON or OFF state (a position A (M), N, O, P, Q, R, S, or K in FIG. 25), counting of the number of revolutions of the motor 24 for driving the cam 55 is started, whereby the stopping position of the cam 55 is accurately controlled. In the following descriptions about processes, such as maintenance processes or the like, explanations about ON/OFF operation of the leaf switch 106 and control of rotational position of the cam 55 based on ON/OFF operation will be omitted.

<Operation of the Cap Lift Holder 41 in Accordance with Movement of the Carriage 3>

Figure 14:
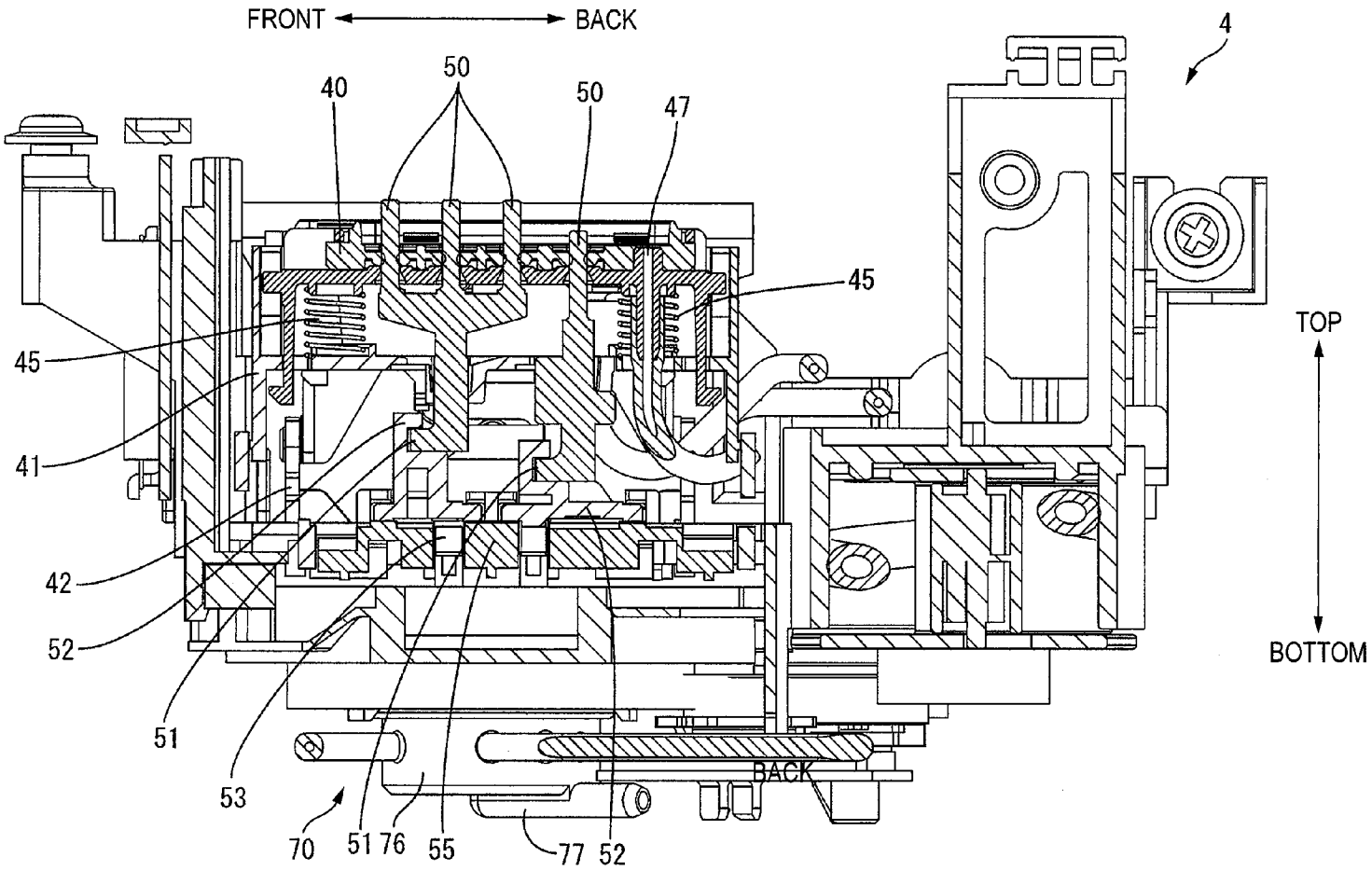
FIG. 14 is a schematic cross-sectional view showing that an open-close member for black color is situated at the valve-close position; and that an open-close member for colors is situated at the value-open position.

When the carriage 3 moves from the recording zone 8 to the home position with the cap lift holder 41 being retained in the receded position by means of restoration force of the return spring 43, the carriage 3 comes into contact with the receiving plate 44 of the cap lift holder 41 when the carriage 3 has reached the idle suction position, as shown in FIG. 14. At this time, both the air-discharge cap 40 and the nozzle cap 60 are located lower than the lower surface of the carriage 3. More specifically, neither the air-discharge cap 40 nor the nozzle cap 60 is in contact with the lower surface of the carriage 3 (i.e., both the air-discharge cap and the nozzle cap are separated or receded from the lower surface of the carriage 3).

Figure 18:
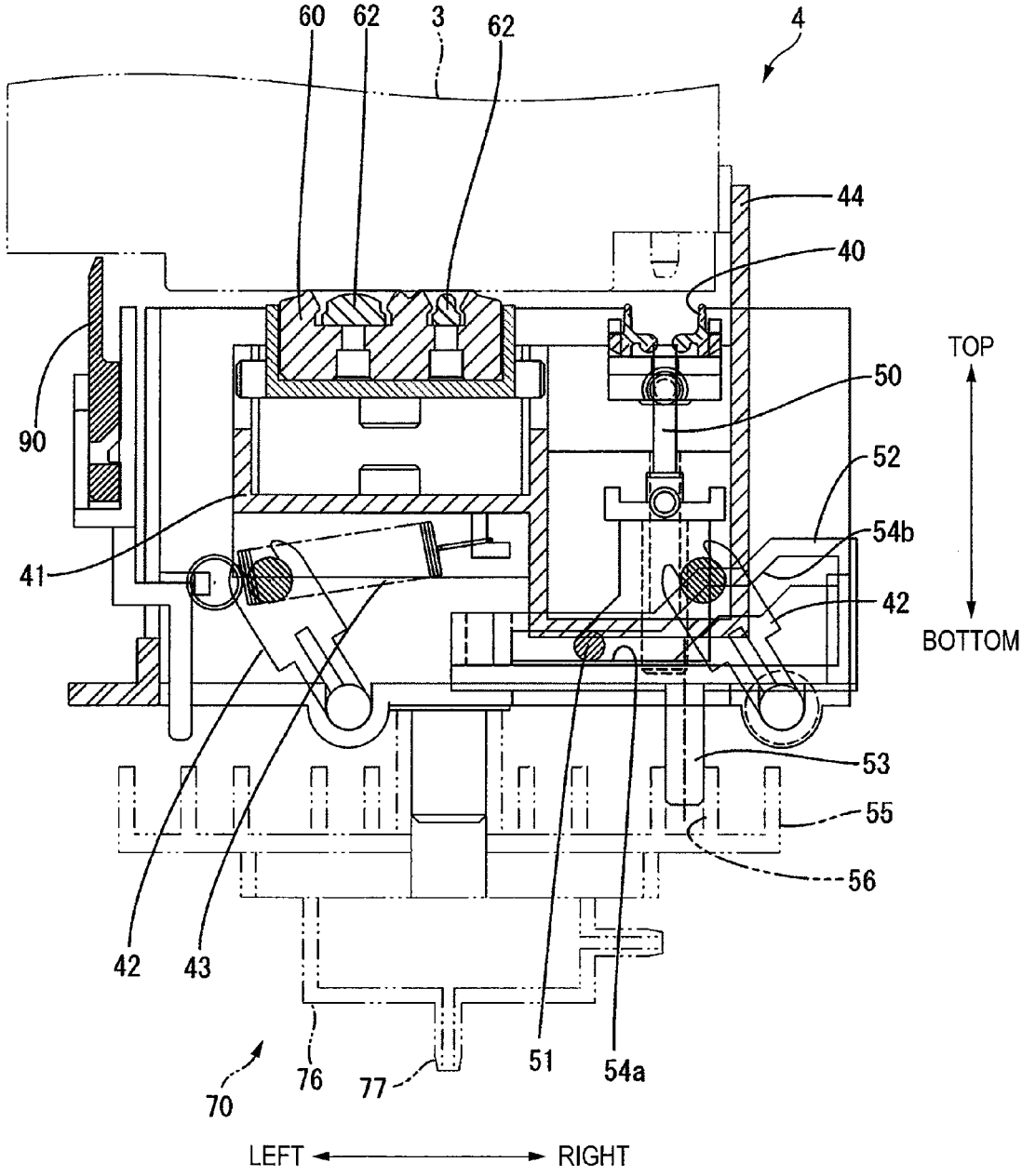
FIG. 18 is a schematic cross-sectional view showing that the carriage has moved toward the home position rather than to the idle suction position, and that the nozzle cap remains in intimate contact with the carriage.

When the carriage 3 moves from the above state to the home position, i.e., in a rightward direction, the cap lift holder 41 is displaced rightward and upward in the manner of an arc, as shown in FIG. 18. Accordingly, the nozzle cap 60 comes into contact with the nozzle surface of the recording head 10 from a lower position. When the carriage 3 further moves rightward, the spring 61, which is located between the upwardly-moving cap lift holder 41 and the nozzle cap 60 remaining in contact with the lower surface of the carriage 3, is elastically compressed, as shown in FIG. 19. Accordingly, the nozzle cap 60 is forcefully pressed against the recording head 10 by means of elastic restoration force of the spring 61, whereby the enclosed spaces 63, which are securely sealed, are formed between the nozzle surface of the recording head 10 and the nozzle cap 60.

When the carriage 3 has further moved rightward from the above state and reached the home position, the air-discharge cap 40 comes into close contact with the lower surface of the carriage 3, as shown in FIG. 20. Moreover, the air-discharge cap 40 is strongly pressed against the lower surface of the carriage 3, by means of elasticity of the spring 45 interposed between the air-discharge cap 40 and the cap lift holder 41. As a result, the airtight space 46, which is securely sealed airtight, is formed between the lower surface of the carriage 3 and the air-discharge cap 40.

<Air-Discharge Process and Air-Suction Process During Maintenance>

In an early stage of a process for discharging the air bubbles stored in the bubble storage chambers 12, the carriage 3 is located at the home position, and the carriage lock 100 is arranged at the elevated position. Therefore, movement of the carriage 3 toward the recording zone 8; that is, movement of the carriage 3 toward the recording zone 8 from the maintenance position, is restricted (a movement restricted state or a locked state). In this restricted state, the air-discharge cap 40 comes into intimate contact with the lower surface of the carriage 3, to thus form the airtight space 46. The cam 55 and the switching member 73 are situated at position "A(M)" in FIG. 25. At this time, the airtight space 46 is disconnected from and comes out of communication with the atmosphere and the pump 38. Furthermore, the enclosed space 63 for black ink and the enclosed space 63 for colors of ink are both opened to the atmosphere by way of the changeover channel 74 of the switching member 73, and come into communication with the pump 38.

Figure 22B:
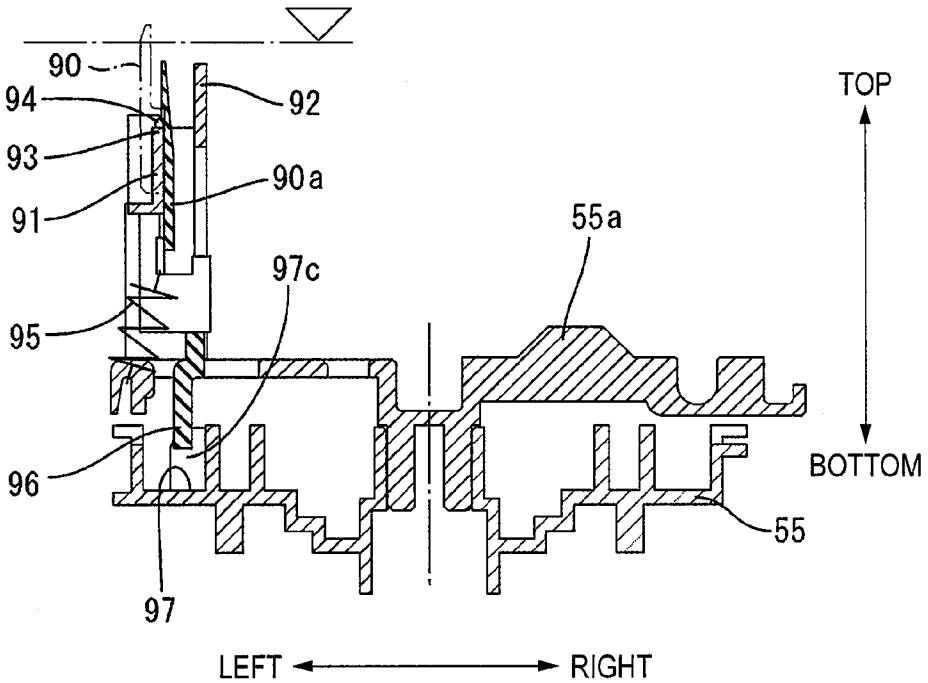
FIG. 22B is a schematic cross-sectional view showing that the wiper is retained in the wiping position.
Figure 22A:
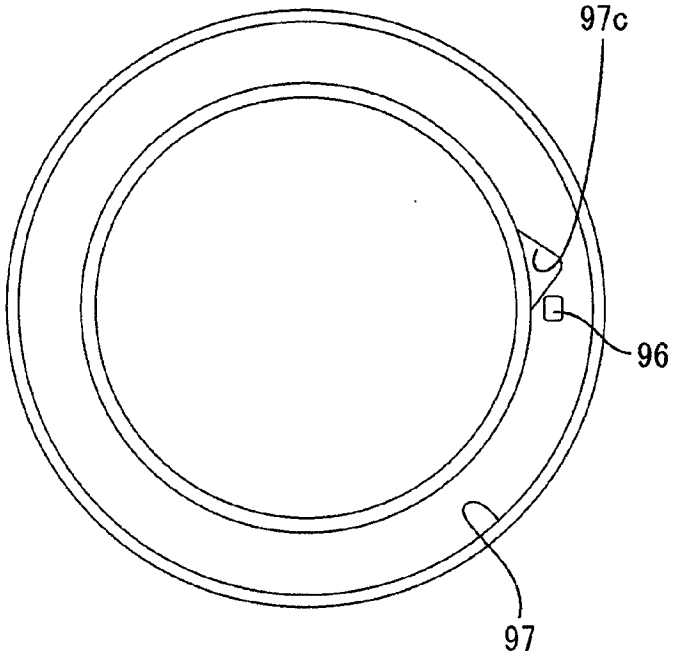
FIG. 22A is a schematic plan view showing a positional relationship between a cam follower of the wiper and a release section of the cam achieved when the wiper is retained in a wiping position.
Figure 23B:
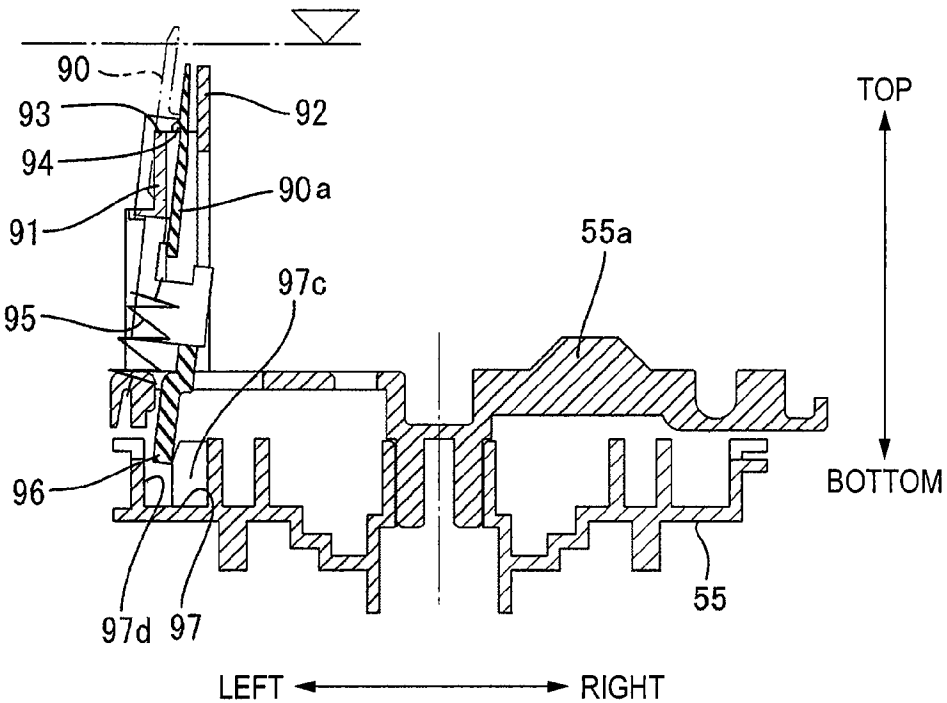
FIG. 23B is a schematic cross-sectional view showing that the wiper located in the wiping position is disengaged from the latch section.
Figure 23A:
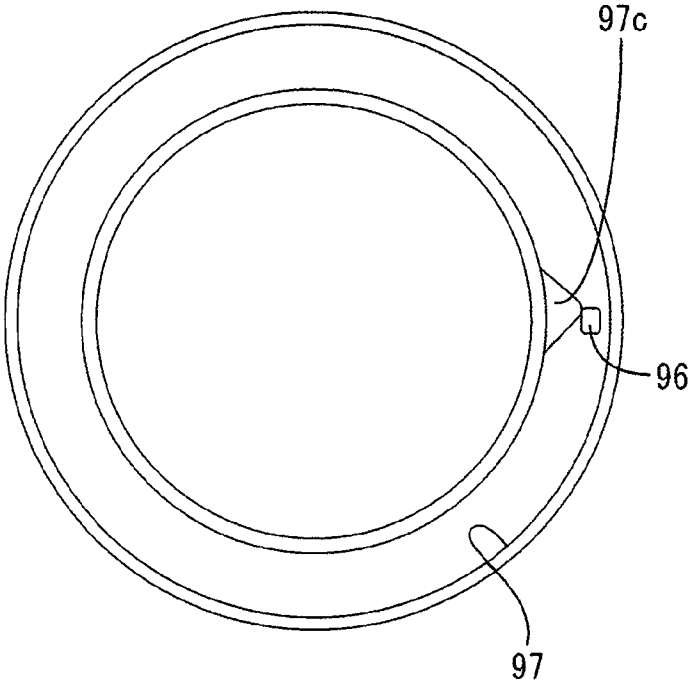
FIG. 23A is a schematic plan view showing a positional relationship between the cam follower of the wiper and the release section of the cam achieved when the wiper located in the wiping position is disengaged from a latch section.
Figure 24A:
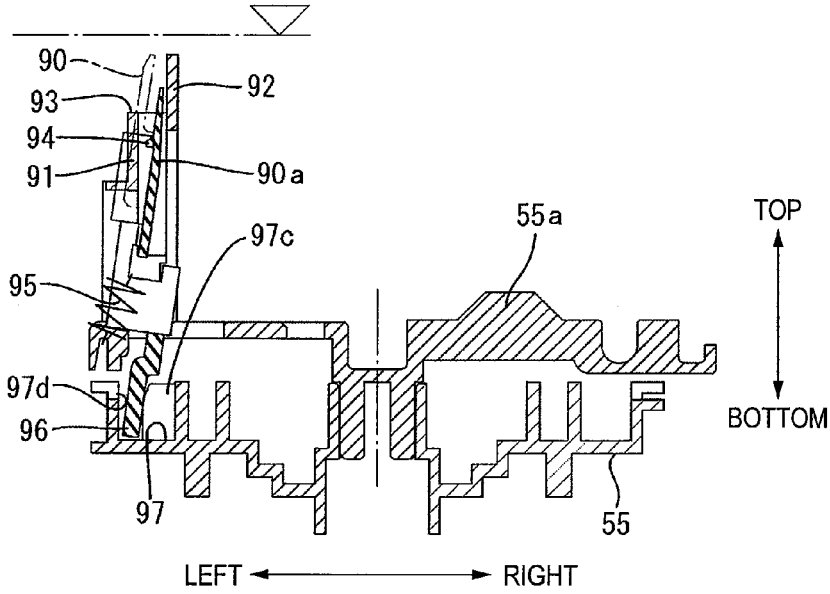
FIG. 24A is a schematic cross-sectional view showing processes during which the wiper is displaced from the wiping position to the receded position.
Figure 24B:
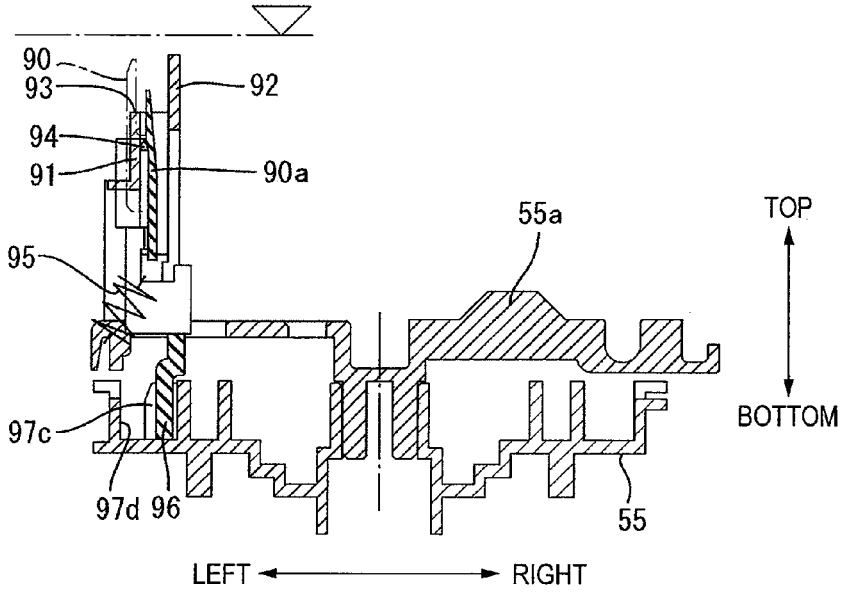
FIG. 24B is a schematic cross-sectional view showing a state in which the wiper has been displaced from the wiping position to the receded position.
Figure 25:
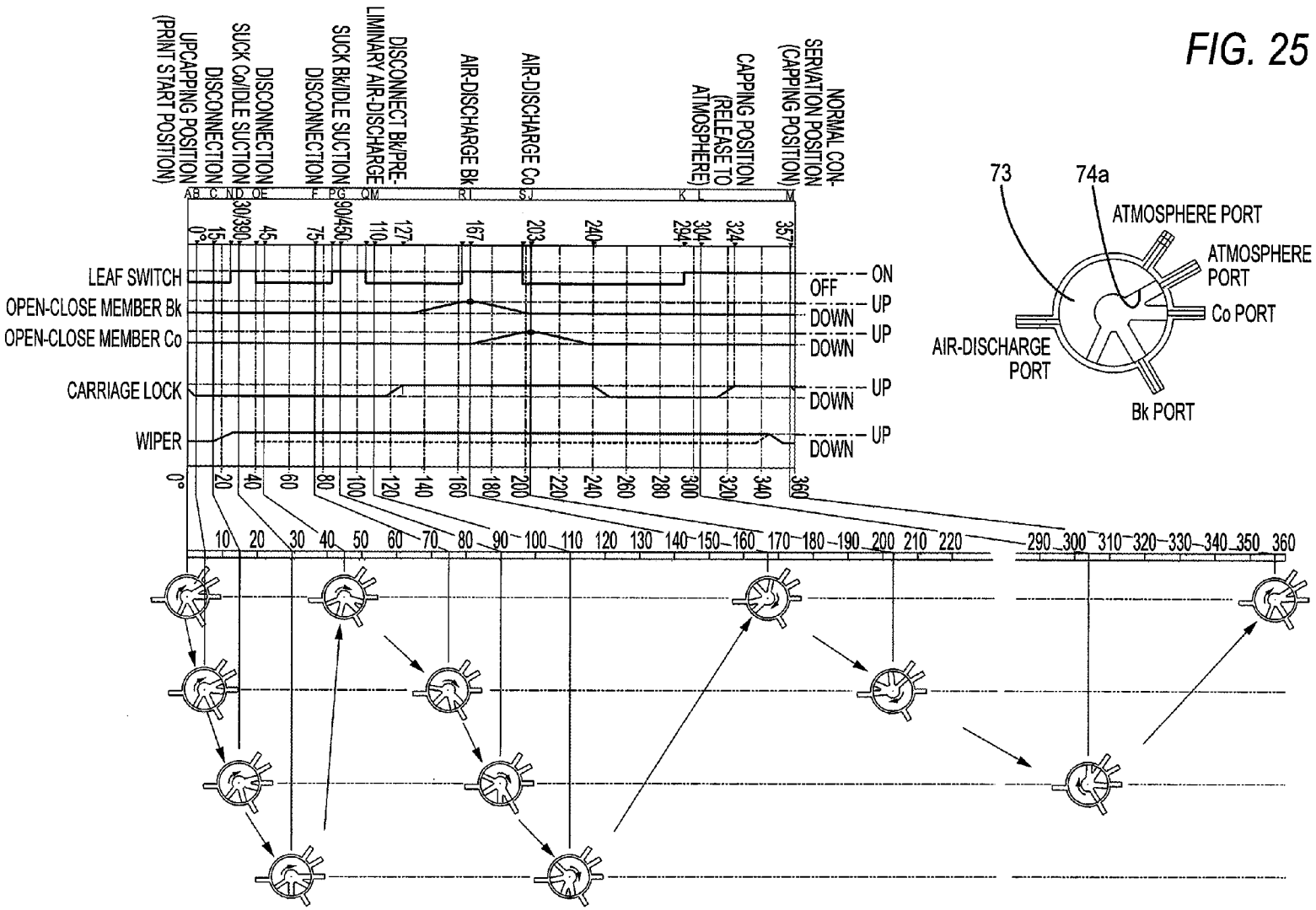
FIG. 25 is a chart the position of the cam and that of a switching member, the displaced state of the open-close member, the displaced state of a carriage lock, and the displaced state of the wiper.

The cam 55 and the switching member 73 rotate from the above-described state to position H shown in FIG. 22 and come to a stop, so that the airtight space 46 comes into communication only with the pump 38 by way of the switching member 73. At this time, both the enclosed space 63 for black ink and the enclosed space 63 for colors of ink are disconnected from and come out of communication with the atmosphere and the pump 38. In this state, the planetary gear 35 revolves toward the pump gear 37, thereby driving the pump 38. As a result, air in the airtight space 46 is discharged, which in turn produces a negative pressure in the airtight space 46.

After preliminary air-discharge has been performed in this manner, the cam 55 and the switching member 73 move to position I. During the course of movement, the slider 52 for black ink is moved leftward as a result of having engaged with the cam 55, whereupon the open-close member 50 for black ink is pushed up from the valve-closing position to the valve-opening position. As a result of pushing-up of the open-close member 50, the open-and-close valve 19 provided in the discharge passage 17 for black ink is brought into an open state. In addition, the airtight space 46 comes into communication solely with the pump 38, whereby the enclosed space 63 for black ink and the enclosed space 63 for colors of ink are disconnected from and come out of communication with the atmosphere and the pump 38. The pump 38 is activated in the state at position I, and the air bubbles stored in the bubble storage chamber 12 for black ink are discharged to the atmosphere by way of the discharge passage 17, the airtight space 46, the changeover channel, and the pump 38. During the above air-discharge process, the enclosed space 63 for black ink and the enclosed space 63 for colors of ink are maintained in the disconnected state, as mentioned previously.

When the air-discharging operation of the bubble storage chamber 12 for black ink performed by the pump 38 has been completed, the cam 55 and the switching member 73 move to position J. During the course of movement, the slider 52 for black ink returns rightward, whereby the open-close member 50 returns to the valve-closing position. As a result, the open-and-close valve 19 for black ink is closed. In addition, the slider 52 for colors of ink moves leftward, and the lower portion of that slider 52 is pushed up from the valve-closing position to the valve-opening position, thereby opening the three open-and-close valves 19 for colors of ink disposed in the discharge paths 17. As in the case of position I, the airtight space 46 comes into communication solely with the pump 38, and the enclosed space 63 for black ink and the enclosed space 63 for colors of ink are disconnected from and come out of communication with the atmosphere and the pump 38. The pump 38 is activated in the state achieved at position J, and the air bubbles stored in the three bubble storage chambers 12 for colors of ink are discharged to the atmosphere by way of the discharge paths 17, the airtight space 46, the changeover channel, and the pump 38. Even during the course of the above air-discharge process, the enclosed space 63 for black ink and the enclosed space 63 for colors of ink are maintained in the disconnected state. Subsequently, the cam 55 and the switching member 73 move to position A. During the course of movement, the slider 52 for colors of ink having remained in the valve-open state returns rightward, whereupon the open-close member 50 returns to the valve-closing position, to thus close the open-and-close valve 19 for colors of ink. The process of discharging the air bubbles in the bubble storage chambers 12 is thus completed. During the air-discharge process, the carriage 3 is still maintained in the home position.

Subsequently, the cam 55 and the switching member 73 rotate to position B, and the carriage lock 100 descends, thereby releasing the carriage 3 from the movement-restricted state (the locked state). Even at position B, the states of communication and disconnection of the airtight space 46 and those of the enclosed spaces 63 are the same as those achieved in position A. When the carriage 3 is released from the movement-restricted state (the locked state) held by the carriage lock 100, the carriage 3 moves from the home position to the idle suction position (see FIG. 17). Consequently, the air-discharge cap 40 and the nozzle cap 60 are separated from the lower surface of the carriage 3. Subsequently, the cam 55 and the switching member 73 rotate to position G, so that the recessed section of the nozzle cap 60 for black ink comes into communication solely with the pump 38, and the recessed section of the air-discharge cap 40 and the same of the nozzle cap 60 for colors of ink are disconnected from the pump 38. During the course of rotation of the cam 55 and the switching member 73 to position G, the wiper 90 ascends from the receded position to the wiping position, and the latch protrusion 94 of the wiper holder 90*a* is latched by the latching section 93 of the restriction plate 91, whereby the wiper 90 is held in the wiping position. At this time, the carriage 3 (the nozzle surface of the recording head 10) is located rightward (closer to the home position) in relation to the wiper 90.

The carriage 3 moves leftward from this state. During the course of movement, the nozzle surface of the recording head 10 located on the lower surface of the carriage 3 comes into slidable contact with the upper edge of the wiper 90, whereby the ink adhering to the nozzle surface is scraped off by the wiper 90. When the wiping operation has finished as a result of the carriage 3 having passed by the wiper 90, the carriage 3 comes to a temporary stop at the wiping-termination position. Thereafter, the carriage 3 again returns to the idle suction position (toward the home position). At this time, the carriage 3 comes into contact with the upper end of the wiper 90 from the left, thereby dropping the wiper 90 from the wiping position to the receded position. After droppage of the wiper 90, the carriage 3 comes to a stop at the idle suction position.

Subsequently, the cam 55 and the switching member 73 rotate to position H. At this time, the carriage 3 is at the idle suction position, and the air-discharge cap 40 is out of contact with the carriage 3. Accordingly, the airtight space 46 is not formed, and the recessed section of the air-discharge cap 40 comes into communication with the pump 38. When the pump 38 is activated, idle air suction is performed. In the air-discharge process, the ink having been sucked in the air-discharge cap 40 together with the air bubbles (air) in the bubble storage chambers 12 is drawn to the pump 38 by suction, to thus be discharged. The idle suction process is now completed.

Then, the switching member 73 rotates to position L. As a result, both the recessed section of the nozzle cap 60 for black ink and the nozzle cap 60 for colors of ink are opened to the atmosphere and come into communication with the pump 38. In addition, the recessed section of the air-discharge cap 40 comes out of communication with the pump 38. In this state, the carriage 3 returns from the idle suction position to the home position located further rightward from the idle suction position. As a result, the air-discharge cap 40 comes into close contact with the carriage 3, to thus form the airtight space 46 (which is disconnected from the atmosphere), and the nozzle cap 60 comes into intimate contact with the carriage 3, to thus form the enclosed spaces 63. Subsequently, the cam 55 and the switching member 73 return to position A (M). The air-discharge process and the idle suction process are thus completed.

<Ink-Purging Process During Maintenance>

At the initial stage of the ink purging process for sucking and discharging the ink clogged in the nozzles of the recording head 10 and the air bubbles contained in that ink, the carriage 3 is located at the home position, whereby the airtight space 46 and the enclosed spaces 63 are formed. In addition, the cam 55 and the switching member 73 are located at position A shown in FIG. 25. The enclosed space 63 for black ink and the enclosed space 63 for colors of ink are opened to the atmosphere by way of the switching member 73, and simultaneously in communication with the pump 38. Furthermore, the airtight space 46 becomes disconnected from and out of communication with the atmosphere and the pump 38.

The cam 55 and the switching member 73 rotate from this state to position F. As a result, both the enclosed space 63 for black ink and the enclosed space 63 for colors of ink are disconnected from the atmosphere and come out of communication with the pump 38. The airtight space 46 also becomes disconnected from both the atmosphere and the pump 38. The pump 38 is activated in this state, whereby a negative pressure is produced in the pump 38 and the changeover channel 74 (i.e., the inside of the pump 38 and that of the changeover channel 74 are decompressed to a level which is equal to or lower than the atmospheric pressure).

The cam 55 and the switching member 73 then rotate to position G. As a result, the enclosed space for black ink 63 is brought into communication with the pump 38 by way of the switching member 73, whereby the black ink stored in the enclosed space 63 for black ink (in the nozzle cap 60) is instantly drawn to the pump 38 by suction. At this time, the airtight space 46 and the enclosed space 63 for colors of ink remain disconnected from both the pump 38 and the atmosphere.

Upon completion of purging of ink from the enclosed space 63 for black ink, the cam 55 and the switching member 73 rotate to position H, whereby only the airtight space 46 comes into communication with the pump 38. Neither the enclosed space 63 for black ink nor the enclosed space 63 for colors of ink comes into communication with the pump 38, and these elements are disconnected from the atmosphere, as well.

Subsequently, the carriage 3 temporarily moves from the home position to the idle suction position shown in FIG. 17, and further moves to the recording zone 8. At this time, during the course of the cam 55 and the switching member 73 rotating from position A to position F as described above, the wiper 90 remaining in the receded position ascends and remains at standby in preparation for wiping operation while being locked in the wiping position. Therefore, during the course of movement of the carriage 3, the nozzle surface of the recording head 10 comes into contact with the wiper 90, whereby the ink adhering to the nozzle surface is wiped off and removed. In addition, after having passed by the wiper 90, the carriage 3 is moved further leftward and subjected to flushing in the flushing position located on the left of the recording zone 8.

The carriage 3 again returns to the idle suction position located on the left of the recording zone 8. However, during the course of return, the carriage 3 comes into contact with the wiper 90, thereby dropping the wiper 90 from the wiping position to the receded position. In addition, in a state where the carriage 3 has returned to the idle suction position, the air-discharge cap 40 and the nozzle cap 60 still remain separated from the lower surface of the carriage 3. Accordingly, the airtight space 46 and the enclosed spaces 63 are not formed.

The cam 55 and the switching member 73 then rotate from position H to position G, so that only the recessed section of the nozzle cap 60 for black ink comes into communication with the pump 38. In this state, the pump 38 is activated, and the black ink remaining in the enclosed space 63 for black ink is sucked to the pump 38 and then removed. Thus, the black-ink purging process is completed.

The cam 55 and the switching member 73 rotate to position L, so that the recessed section of the enclosed space 63 for black ink and the recessed section of the enclosed space 63 for colors of ink are released to the atmosphere and come into communication with the pump 38. The recessed section of the air-discharge cap 40 and the pump 38 are out of communication with each another. In this state, the pump 38 is activated to thus again perform idle suction. As a result, the ink still remaining in channels—among the changeover channels 74 which are in communication with the atmosphere port—is sucked to the pump 38 and then removed.

The carriage 3 remaining at the idle suction position now returns to the home position, whereby the airtight space 46 and the enclosed spaces 63 are formed. Next, the cam 55 and the switching member 73 rotate to position A (M). Thus, the black-ink purging process is completed.

Processing pertaining to a color-ink purging process is performed in the same manner as mentioned above. In the color-ink purging process, the only requirement is to change positions F, G, and H—which range from processing pertaining to a step for charging a negative pressure to processing pertaining to a step of completing suction of ink during the black-color purging process—to "positions C, D, and E"; and to change "position G," which is for idle suction to be performed after idle suction, to "position D."

In the above process, the negative pressure is charged before ink purging to thus suck ink by one operation. However, ink can be purged without producing the negative pressure. In this case, the essential requirement is to omit the step for stopping the cam 55 and the switching member 73 at position F (position C in the case of colors of ink) to suck the pump 38.

<Process where the Carriage 3 Starts Recording Data on a Recording Medium>

When the carriage 3 having undergone maintenance moves from the home position, where the carriage 3 is on standby, to the recording region 8 by passing by the idle suction position and the wiping-termination position in order to record data on the recording medium, wiping of the nozzle face is not required. The reason for this is that unnecessary wiping shortens the service life of the nozzle face of the recording head 10.

In this case, before the carriage 3 is moved, the cam 55 remaining in position A is rotated in advance to a position to be reached after having passed by position J; e.g., a position between positions L and M. During the course of the cam 55 moving from position J to position L, the release section 97*c* of the cam 55 interferes with the cam follower 96 of the wiper holder 90*a*, thereby dropping the wiper 90 locked in the wiping position to the receded position. Even when the carriage 3 is moved from the home position to the recording region 8 in this state, the carriage 3 is prevented from contacting the wiper 90, so that unnecessary wiping is avoided.

Figure 26:
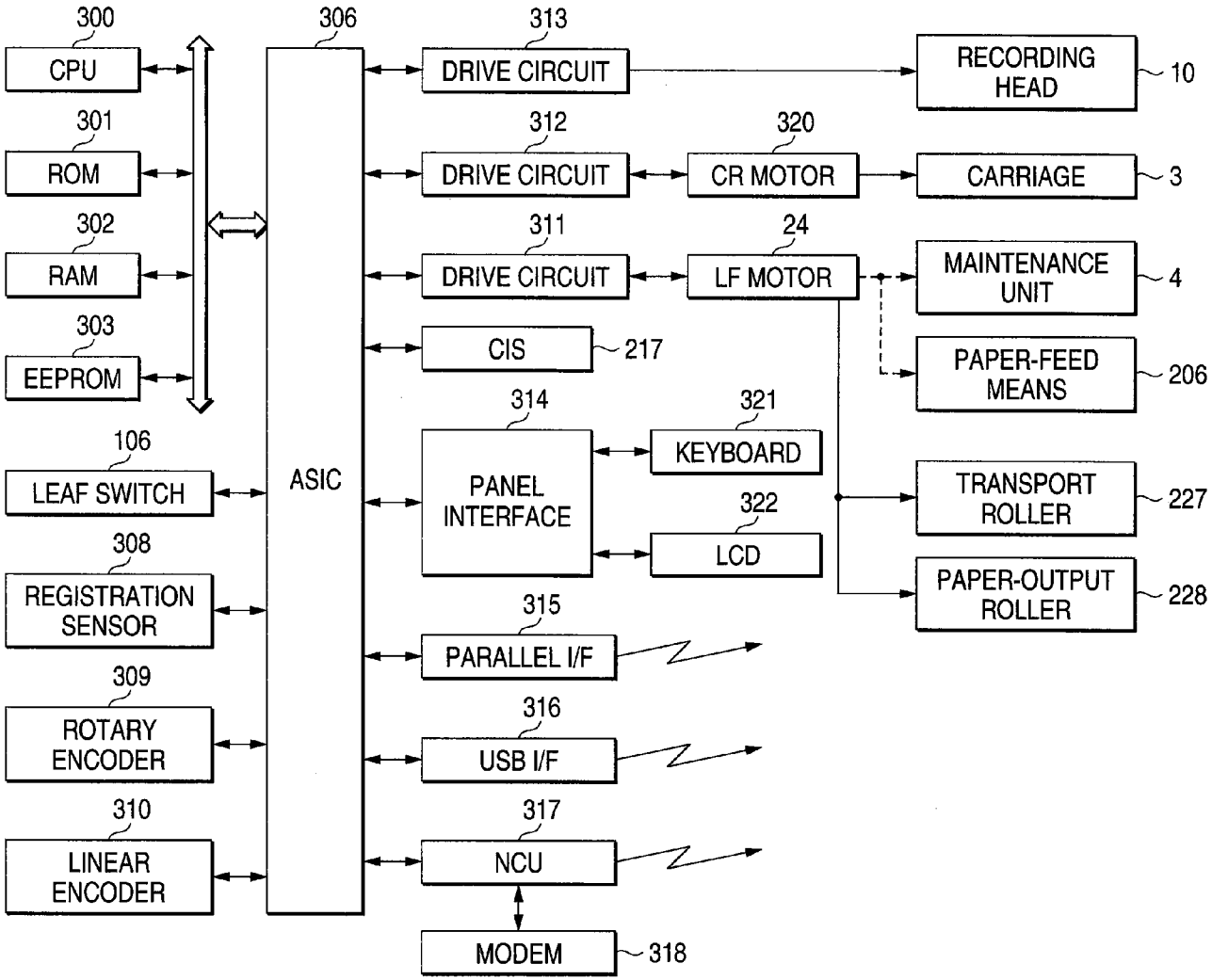
FIG. 26 is a block diagram showing an electrical configuration of the multifunction device.

The control section (the control unit) of the MFD will be described by reference to FIG. 26. The control section controls operation of the overall MFD.

The control section is constituted of a microcomputer predominantly consisting of a CPU 300, ROM 301, RAM 302, and EEPROM 303. The control section is connected to an ASIC (Application-specific Integrated Circuit) 306 by way of a bus 305.

The MFD is equipped with, as a transport unit for transporting recording paper in a sub-scanning direction, a transport roller 227, a paper-output roller 228, and a transport (LF) motor 319 serving as a drive source for driving the transport roller 227 and the paper-output roller 228. The transport roller 227 and the paper-output roller 228 are connected to the transport (LF) motor 319. As a result of rotation of the transport roller 227 and the paper-output roller 228, the recording paper P is transported in a sub-scanning direction (the direction of arrow A).

Further, the MFD is equipped, as a drive level control unit for controlling the drive level of the motor and a correction unit for correcting the drive level of the transport (LF) motor, the CPU 300 for commanding drive level control procedures, the ASIC 306 for generating a control signal on the basis of the drive level control procedures command by the CPU 300, and a drive circuit 311 which forms a pulse signal, or the like, for rotating the transport (LF) motor upon receipt of a PWM signal generated and output by the ASIC 306.

Programs, or the like, for controlling various operations of the inkjet printer are stored in the ROM 301. The RAM 302 is used as a storage area for temporarily storing various data used when the CPU executes the programs, and as a work area.

An NCU (Network Control Unit) 317 is connected to the ASIC 306. A communication signal input from a public line by way of the NCU 137 is demodulated by a MODEM 318, and the thus-demodulated signal is input to the ASIC 306. When the ASIC 306 transmits image data to the outside by means of facsimile transmission, or the like, the image data are modulated into a communication signal by the MODEM 318, and the communication signal is output to the public line by way of the NCU 317.

In pursuant to the command from the CPU 300, the ASIC 306 generates, e.g., a phase excitation signal, or the like, used for applying power to the transport (LF) motor 319; sends the signal to the drive circuit 311 of the transport motor (LF) motor 319 of and the drive circuit 312 of the carriage (CR) motor 320. Power is applied to the transport (LF) motor 319 and the carriage (CR) motor 320 by means of the drive signal by way of the drive circuit 311, the drive circuit 312, or the like.

Further, the ASIC 306 is connected to the image reading section 217 (e.g., a CIS or a CCD) for reading an image or letters on a document supplied from a paper stocker to the inside of the apparatus main body of the MFD; a panel interface 314 having a keyboard 321 used for performing transmission/receiving operation and a liquid-crystal display (LCD) 322; and a parallel interface 315 or an USB interface 316 for sending or receiving data to or from an external device, such as a personal computer, by way of a parallel cable or an USB cable.

The ASIC 306 is further connected to a leaf switch 106 for detecting the rotational position of the cam 55 of the maintenance unit 4; a registration sensor 308 detecting the position of the recording paper P when the recording paper P is fed to the inside of the MFD; a rotary encoder 309 attached to the transport roller 227 or the transport (LF) motor for detecting the number of rotations of the transport roller 227; and a linear encoder 310 for detecting the travel distance of the carriage 3, or the like. A carriage detection unit is constituted of the encoder strip 247, the linear encoder 310, and the control section.

The drive circuit 311 is for driving the transport (LF) motor 24 connected to the transport (LF) roller 227. As a result of the drive circuit 311 driving the transport roller 227, the recording paper P is transported in the sub-scanning direction (the direction of arrow A).

The drive circuit 312 is for driving the carriage (CR) motor 320 for actuating the carriage 3 with the recording head 10 mounted thereon in the main scanning direction. As a result of the drive circuit 312 driving the carriage (CR) motor 320, the carriage 3 moves in the main scanning direction (the horizontal direction). In association with horizontal movement, the recording head 10 mounted on the carriage 3 moves in the main scanning direction.

The drive circuit 313 is for causing the recording head 10 to selectively eject ink to the recording paper P at a predetermined timing. Upon receipt of the signal that is generated and output by the ASIC 306 in accordance with the drive control procedures output from the CPU 300, the drive circuit 313 drives and controls the recording head 10.

By reference to FIGS. 27 to 35, processing of the MFD of the present embodiment for initializing a recording system will now be described in detail. Processing for initializing the recording system is to be performed when power of the MFD is turned on. Powering of the MFD is effected by pressing a software power switch on the control panel section 14 to thus switch the MFD from OFF to ON, or by inserting an unillustrated power cable to power utility. This MFD has two types of recording initialization processing; namely, simple initialization processing which is first initialization processing, and full initialization processing which is second initialization processing. Of the two types of initialization processing, the full initialization processing is performed in the following case. When power is applied to the MFD, the full initialization processing is performed in any one of the following five cases: namely, (1) a case where the leaf switch 106 of the MFD is in OFF position; (2) a case where the registration sensor 308 is in ON position; (3) a case where power was turned off last time because of an error in the MFD; (4) a case where power was turned off last time during the course of purging operation or replacement of ink which is a recording agent; and (5) a case where power is turned on first time. Consequently, the simple initialization processing is performed in a case other than the above-described five cases. Statuses (1) and (2) are determined by means of the control section formed from the CPU 30, or the like, checking the leaf switch 106 or an output from the registration sensor 308 when power of the MFD is turned on. Statuses (3), (4), and (5) are stored in respective flag storage areas within the EEPROM 30. Hence, the statues (3), (4), and (5) are determined by means of the control section checking the respective flag storage areas.

Figure 27:
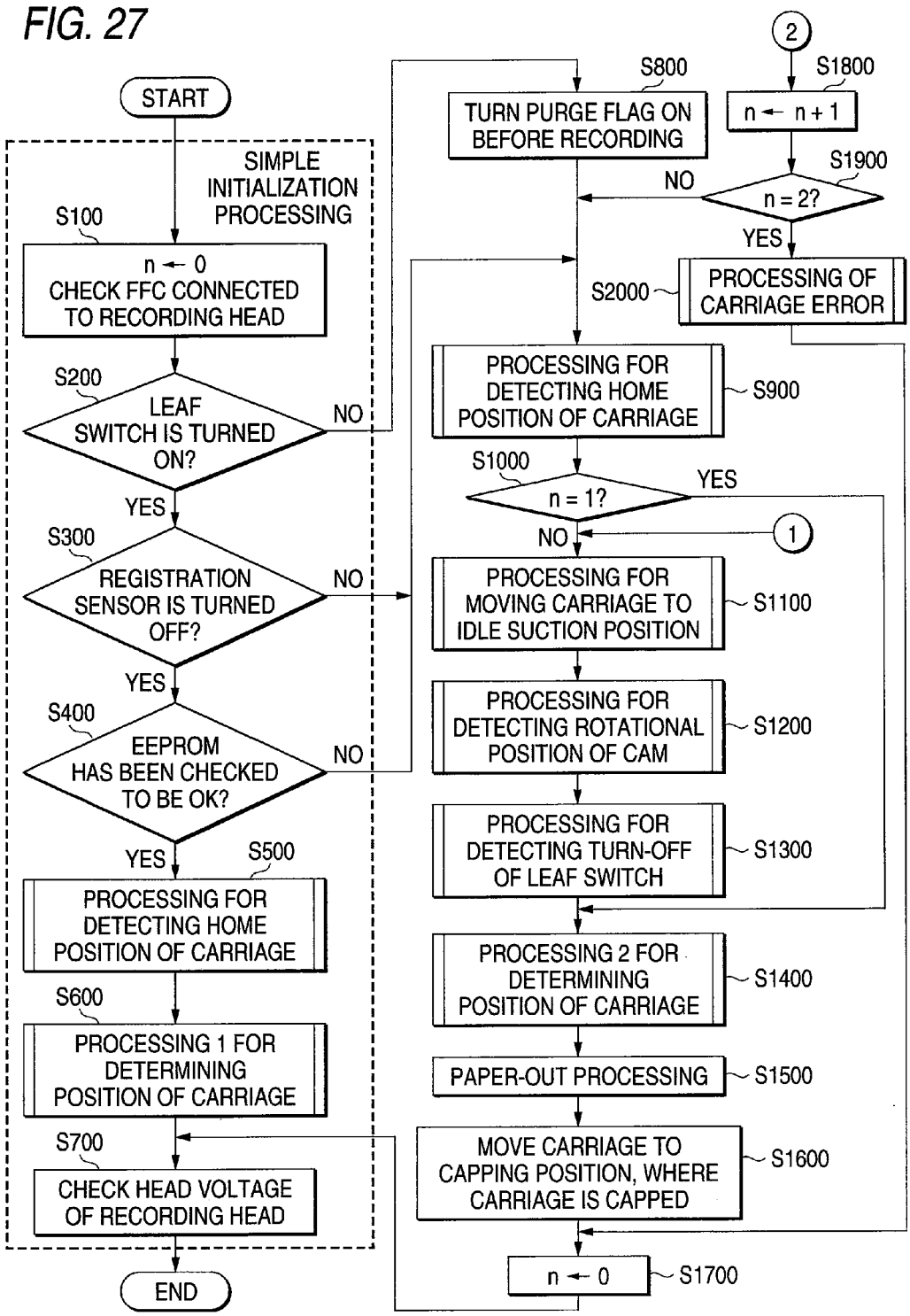

As shown in FIG. 27, when power of the MFD is turned on, the value of "n" (the number of times initialization processing is retried) stored in an initialization-processing retry-count storage area in the EEPROM 30 is cleared to 0. Further, the function of an FFC (Flexible Flat Cable) connected to the recording head 10 is checked (S100). In the event that an error has arisen in connection of the FFC, the error is reported to the user. However, reporting of an error is not important feature of the present invention. Hence, reporting of an error, or the like, is not described in detail later with the assumption that the functional check was OK according to the flowchart.

Next, a determination is made as to whether or not the leaf switch 106 is in ON position (S200). As mentioned previously, the reason for this is that, when the carriage 3 is situated at a capping position (a normal storage position), the leaf switch 106 is inevitably situated in ON position. Consequently, if the leaf switch 106 is determined to be situated in ON position (YES in S200), the carriage 3 is presumed to be situated in the capping position (the normal storage position) Next, a determination is made as to whether or not the registration sensor 308, which is interposed between the paper feed unit 206 and the transport roller 227, is in OFF position (S300). When the registration sensor 308 is determined not to situate in OFF position (NO in S300); that is, in ON position (NO in S300), it means that the recording paper, which serves as a recording medium still remains in the vicinity of the registration sensor 308 at a point in time when power of the MF is turned off. In this case, processing proceeds to full initialization processing (S900) and subsequent steps).

When the registration sensor 308 is situated in OFF position (YES in S300), the EEPROM 303 is now checked (S400). Specifically, as mentioned previously, a determination is made as to (3) whether or not power was turned off last time while the MFD was in error; (4) whether or not power was turned off last time during the course of purging operation or replacement of ink; and (5) whether or not power is applied to the MFD first time. Information about this determination is stored in the respective flag storage areas within the EEPROM 303. Hence, a determination can be readily made by detecting information in the respective flag storage areas. If the EEPROM is checked not to be OK (NO in S400); namely, when an affirmative determination is made as to any one of (3), (4), and (5) [if an affirmative determination is made as to (3), power was turned off last time while the MFD was in error; if an affirmative determination is made as to (4), power was turned off last time during the course of purging operation or replacement of ink; or if an affirmative determination is made as to (5), power of the MFD is turned on first time], processing proceeds to full initialization processing (S900 and subsequent steps).

If the EEPROM is checked to be OK (YES in S400); that is, if a negative determination is made as to all of (3), (4), and (5) [if a negative determination is made as to (3), power was not turned off last time while the MFD was in error; if a negative determination is made as to (4), power was not turned off last time during the course of purging operation or replacement of ink; or if a negative determination is made as to (5), power of the MFD is not turned on first time], processing for detecting the home position of the carriage 3 is performed (S500). Processing pertaining to S200 to S400 functions as a status detection unit.

Figure 28:
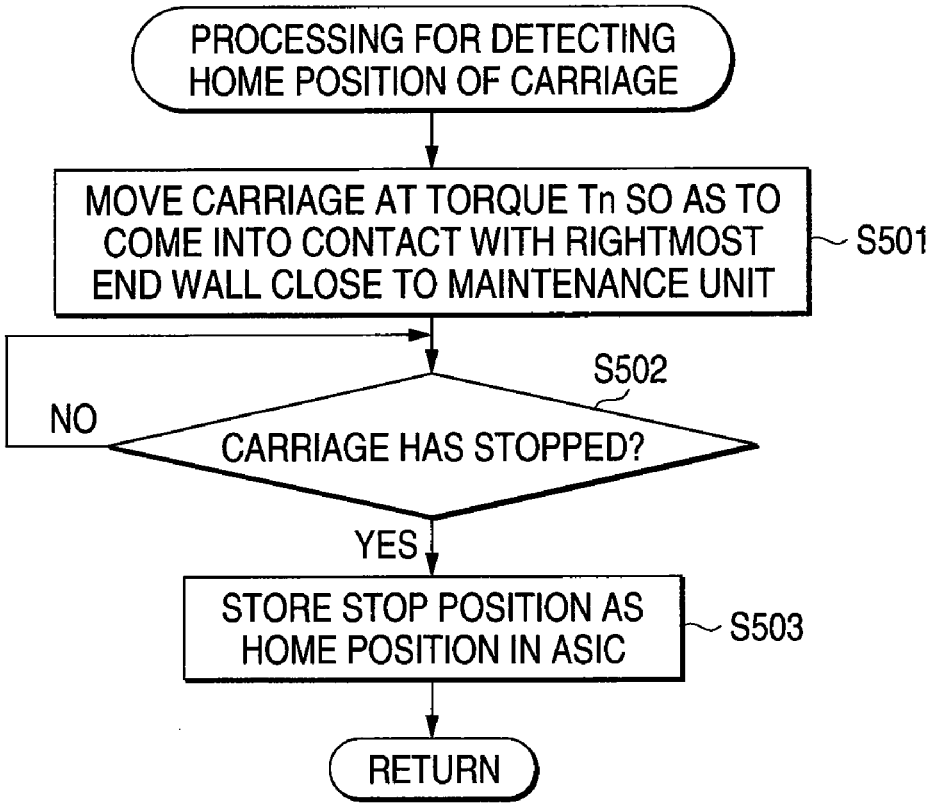
FIG. 28 is a flowchart showing operation of carriage home position detection processing (sub-routine)
Figure 29:
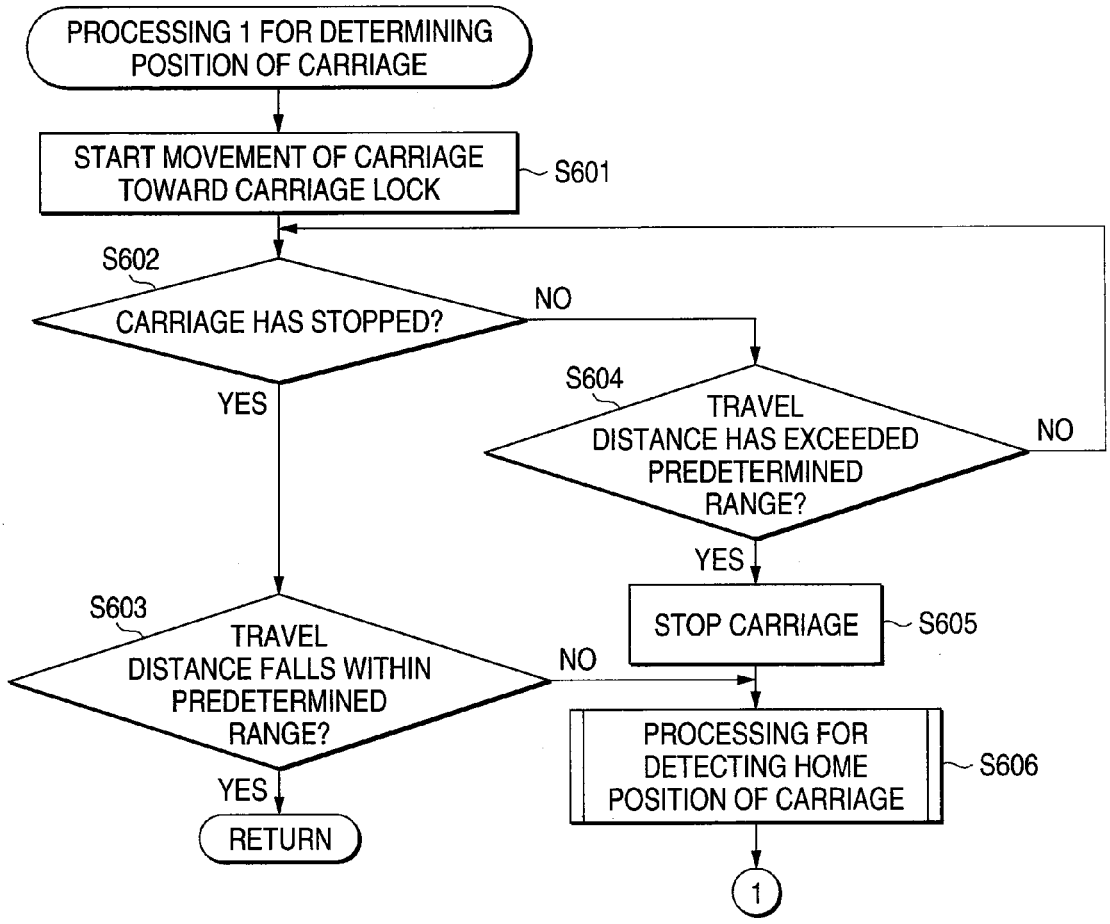
FIG. 29 is a flowchart showing operation of processing 1 for determining the position of a carriage (sub-routine)
Figures 36A, 36B, 36C, 36D, 36E, 36F, 36G:
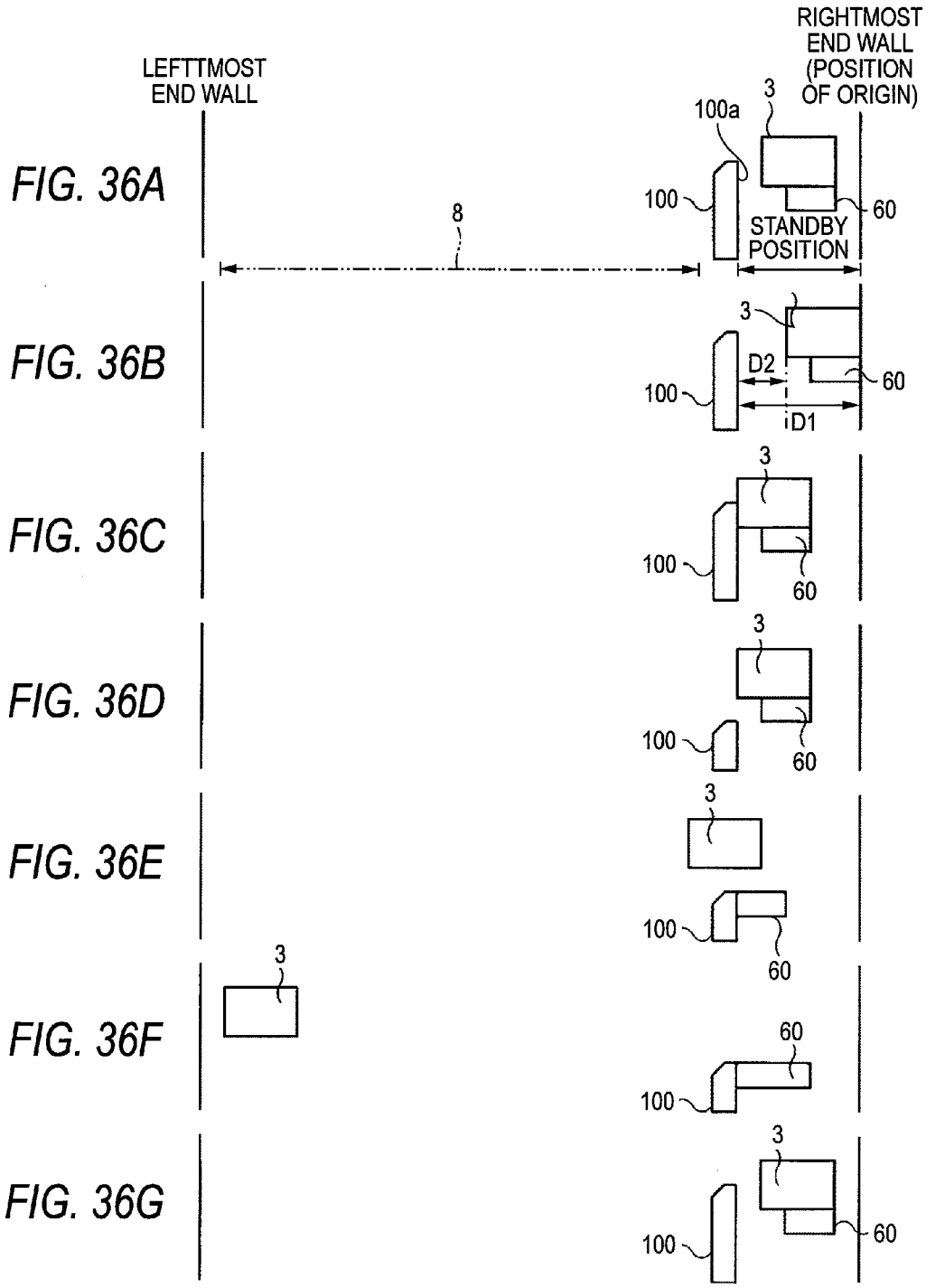
FIGS. 36A to 36G are views diagrammatically showing the operation and position of the carriage.

By reference to FIGS. 28 and 36, carriage home position detection processing is described. During carriage home position detection processing (S500), in order to detect the home position of the carriage 3, the carriage 3 is first started to move with torque Tn toward the rightmost end wall close to the maintenance unit 4 (S501). Specifically, a shift from FIG. 36A to FIG. 36B is achieved. First, since "n" has already been cleared to 0, the carriage 3 is moved with torque T0 which is ordinary torque (the minimum torque used for actuating the carriage 3 in the present embodiment). Next, a determination is made as to whether or not the carriage 3 has stopped (S502). The determination is made on the basis of an output from the linear encoder 310. Since this technique is well known, details about the technique are not provided here. During a period of time in which the carriage 3 has not yet stopped (NO in S502), movement of the carriage 3 is continued. When the carriage 3 has come to a standstill (YES in S502); for instance, when the carriage 3 has come into contact with the rightmost end wall, which is shown in FIG. 36B, the location where the carriage 3 has stopped is stored in the storage area in the ASIC 306 as the tentative home position for the carriage 3 (S503). This carriage home position detection processing (S500) functions as a home position detection unit.

After processing for detecting the home position of the carriage 3 (S500) has been completed, carriage position determination processing 1 is performed (S600). By reference to FIG. 29, the carriage position determination processing 1 will be described hereunder. During the carriage position determination processing 1 (S600), the carriage 3 first starts moving from the stop position (the home position in a normal state) toward the carriage lock 100 (S601). Namely, a shift from FIG. 36B to FIG. 36C is achieved. Next, a determination is made as to whether or not the carriage 3 has stopped (S602). As mentioned previously, this determination is made on the basis of the output from the linear encoder 310.

If the carriage 3 has not yet stopped (NO in S602), a determination is made as to whether or not the travel distance of the carriage 3 has exceeded the predetermined range (S604). The reason for this is that, since a distance (first distance) D1 from the true home position of the carriage 3 to the carriage lock 100 is determined in advance, the carriage 3 should stop upon contact with the carriage lock 100, so long as the carriage 3 moves over only a predetermined travel distance (D2±α), including an error range α, from the true home position toward the carriage lock 100. Here, D2 is a distance (a second distance) determined by subtracting the width of the carriage 3 from D1. Consequently, when the travel distance of the carriage 3 has not exceeded the maximum travel distance (D2+α) of the predetermined range (D±α) (NO in S604), processing returns to S602, where movement of the carriage 3 is continued. For instance, when the carriage 3 is determined to have stopped upon contact with the carriage lock 100; namely, when state (c) shown in FIG. 36 has been achieved (YES in S602), a determination is made as to whether or not the travel distance falls within the predetermined range (D2±α) (S603). If the travel distance falls within the predetermined range (D2±α) (YES in S603), the carriage position determination processing 1 is completed as the tentative home position stored in the storage area in the ASIC 306 in step S500 being true (a true home position). In this case, a head voltage of the recording head 10 is checked (S700), and initialization processing is terminated.

As shown in FIG. 36A, it should be noted that the predetermined range as mentioned above is within a distance 1001 from the position of the point of origin to a contact position 100*a* where the carriage lock 100 is brought in contact with the carriage 3. The position of origin and the contact position 100*a* are outside of the recording area 8 where the recording head 10 records an image on recording paper P.

When the carriage 3 has exceeded the maximum travel distance (D2+α) without stoppage (YES in S604), any error should have arisen. In that case, movement of the carriage 3 is stopped (S605), and processing for detecting the home position of the carriage 3 is performed (S606). Subsequently, processing proceeds to S1100 which pertains to full initialization processing to be described later. Since processing for detecting the home position of the carriage 3 (S606) is identical with processing pertaining to S500, processing is not described here in detail.

Even when the carriage 3 has stopped out of the predetermined range (D2±α) (NO in S603), processing for detecting the home position of the carriage 3 (S606) is performed. Subsequently, processing proceeds to S1100 which pertains to full initialization processing to be described later. Here, "any error" includes a case where the carriage 3 has stopped before coming into contact with the rightmost end wall for reasons of any extraneous matter, or the like, rather than having stopped upon contact with the rightmost end wall, so that the tentative home position stored as the home position of the carriage 3 is determined to be faulty; or a case where, although the leaf switch 106 was in ON when power was turned on, the carriage lock 100 is actually set in a lowered position.

As mentioned above, a shortest series of operations (S100→S200→S300→S400→S500→S600→S700) from checking of the FFC connected to the recording head performed by means of clearing the value of "n" to 0 (S100) to checking the voltage of the recording head 10 (S700) correspond to the simple initialization processing. In the case of this simple initialization processing, the carriage 3 is not moved toward the flushing position. Hence, the initialization time can be shortened, and no inconvenience is given to the user. Since the recording head 10 is kept capped with the nozzle cap 60 during a period of time in which the simple initialization processing is performed, there is no necessity for performing capping operation again.

Processing proceeds to full initialization processing any one of the cases: namely, a case where the leaf switch 106 is in OFF position in S200 (NO in S200); a case where the registration sensor 308 is in ON position in S300 (NO in S300); a case where the EEPROM is checked not to be OK in S400 (NO in S400); and a case where any error is determined to have arisen during the carriage position determination processing 1 (NO in S603→YES in S606 or S604→S605→S606). Depending on situations in respective stages, selection of processing changes; that is, full initialization processing is performed from the beginning (S900) or in midstream (S1100).

As mentioned previously, when the carriage 3 is located in the capping position (an ordinary conservation position) when power of the MFD is turned off, the leaf switch 106 is inevitably in ON position. Therefore, when the leaf switch 106 is in OFF position (NO in S200), the carriage 3 should be out of the capping position (the ordinary conservation position) Namely, at a point in time when power of the MFD is turned on this time, the nozzle surface of the recording head 10 is determined not to have been capped with the nozzle cap 60. Consequently, there may be a case where the respective nozzles of the recording head 10 are dried and clogged with ink, and hence a record purge flag is brought into ON position (S800), and full initialization processing is performed. Therefore, setting the recording purge flag in ON position means that "1" is stored in the record purge flag storage area in the EEPROM 303. On condition that the record purge flag is in ON position, when the initialization processing is completed and a recording command is input to the MFD remaining in standby condition, the recording head 10 is subjected to purging operation before recording operation is started. Accordingly, even when the nozzles of the recording head 10 are clogged with ink or the like, purging operation is performed before recording operation. Therefore, recording of an image or letters is performed properly.

When the record purge flag is set in ON position (S800), processing for detecting the home position of the carriage 3 (S900) is performed. Processing is identical with processing pertaining to S500, which has already been described, and hence details of processing are not described here.

Figure 30:
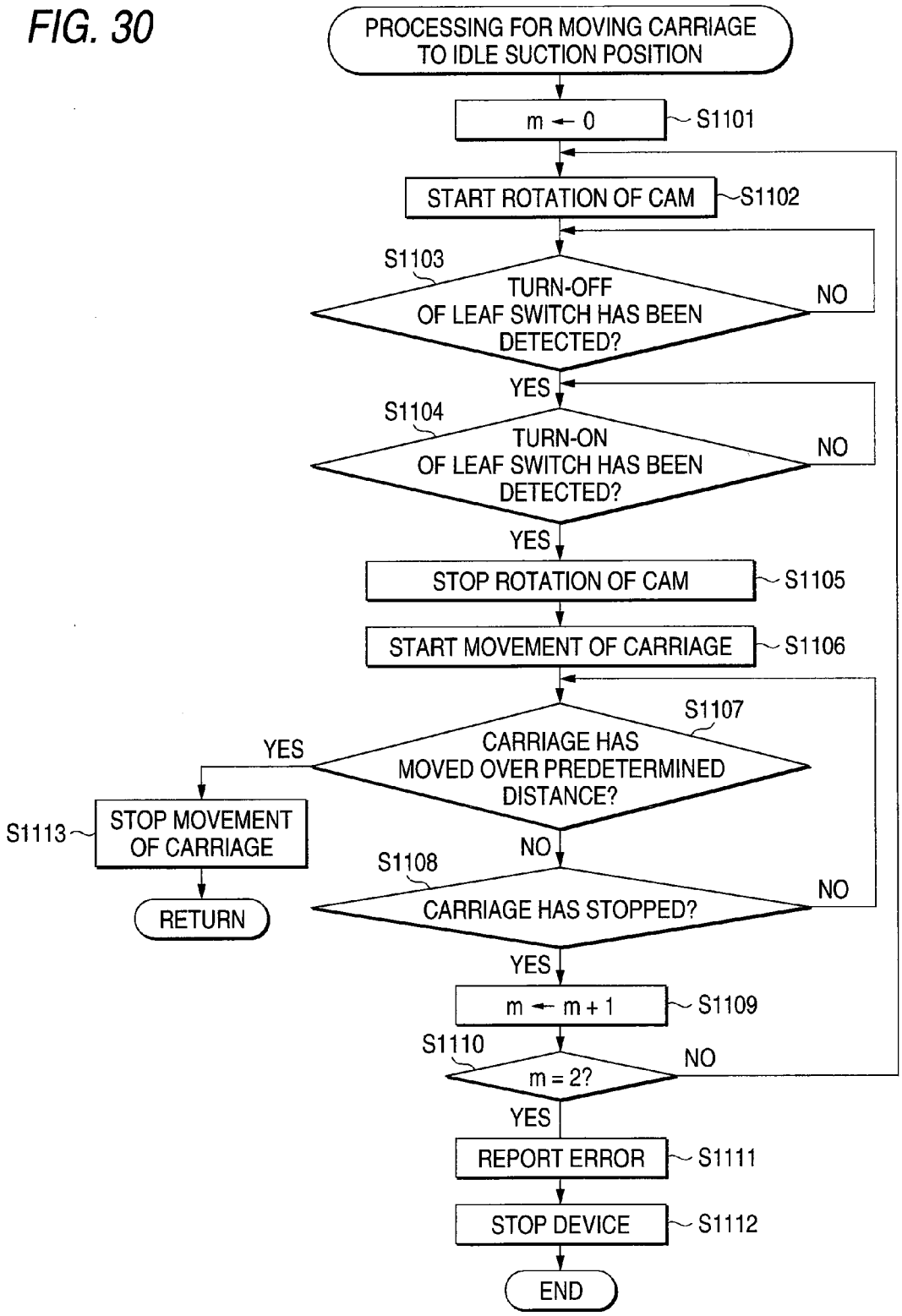
FIG. 30 is a flowchart showing operation of processing for moving a carriage to an idle suction position (sub-routine)

When processing for detecting the home position of the carriage 3 (S900) has been completed, a determination is made as to whether or not the value of "n" stored in the initialization processing retry count storage area in the RAM 302 is one (S1000) First, when n=0 (NO in S1000), processing for moving the carriage 3 to the idle suction position is continually performed (S1100) Processing for moving the carriage 3 to the idle suction position (S1100) will be described hereinbelow by reference to FIGS. 30 and 36. The idle suction position is a position determined by returning the position of the carriage 3 from the rightmost end wall of the maintenance unit 4 toward the recording zone 8 over a predetermined distance; namely, a position where the nozzle cap 60 does not contact the nozzle surface of the recording head 10. Consequently, when the pump 38 is rotated, waste ink still remaining in the nozzle cap 60 is drawn by suction. However, the ink is not drawn from the respective nozzles by suction, and hence wasteful consumption of ink can be suppressed.

During processing for moving the carriage to the idle suction position (S1100), the value of "m" stored in an idle suction position movement processing retry count storage area in the RAM 30 is cleared to 0 (S1101). Next, rotation of the cam 55 is started (S1102). The reason why the cam 55 is rotated is that, since there may be a case where the carriage lock 100 is arranged not in a lowered position but in an elevated position, the carriage 3 is moved to the idle suction position by arranging the carriage lock 100 in the lowered position, as shown in FIG. 36D. In the embodiment, there are four locations where the leaf switch 106 is switched from OFF position to ON position during one rotation of the cam 55. In three positions of the four positions, the carriage lock 100 is arranged in the lowered position without fail. However, even when the leaf switch 106 is switched from OFF to ON position in the remaining one position, the carriage lock 100 is arranged in the elevated position. In this case, even when an attempt is made to move the carriage 3 to the idle suction position, the carriage 3 cannot be moved to the idle suction position because it remains in contact with the carriage lock 100. Therefore, so long as at least two positions—where the leaf switch 106 is switched from OFF position to ON position—are detected, the carriage lock 100 can be arranged in the lowered position. Accordingly, the carriage 3 can be moved to the idle suction position without fail. For these reasons, only one idle suction position movement processing retry operation is allowed in this sub-routine. As mentioned previously, the reason why the carriage 3 is moved to the idle suction position is that, when the LF motor 24 is rotated to drive the pump 38 with the nozzle cap 60 remaining in intimate contact with the nozzle surface of the recording head 10, ink is drawn by suction by way of the respective nozzles of the recording head 10. Hence, the carriage 3 has been moved to the idle suction position beforehand.

When the cam 55 has started rotating (S1102), a determination is made as to whether or not an output from the leaf switch 106 has become inactive (S1103). If the output from the leaf switch 106 is not inactive (NO in S1103), processing pertaining to S1103 is continued until the output from the leaf switch 106 becomes inactive. When the output from the leaf switch 106 has become inactive (YES in S1103), a determination is made as to whether or not the output from the leaf switch 106 becomes active (NO in S1104). If the output from the leaf switch 106 is not active (NO in S1104), processing pertaining to S1104 is continued until the output from the leaf switch 106 becomes active. If the output from the leaf switch 106 has become active (YES in S1104), rotation of the cam 55 is stopped (S1105). Movement of the carriage 3 is then started from the home position to the idle suction position (S1106). Specifically, a shift from FIG. 36B to FIG. 36E is achieved. Next, a determination is made as to whether or not the carriage 3 has moved over only a predetermined distance (S1107). When the carriage 3 is determined to have moved over a predetermined distance (YES in S1107), movement of the carriage 3 is stopped (S1113), and processing for moving the carriage 3 to the idle suction position is terminated (FIG. 36E).

In contrast, when the carriage 3 is determined not to have moved over only the predetermined distance (NO in S1107), a determination is made as to whether or not the carriage 3 has stopped (S1108). When the carriage 3 is determined not to have stopped (NO in S1108), processing returns to S1107, where movement of the carriage 3 is continued. When the carriage 3 is determined to have stopped (YES in S1108), the value of "m" stored in the idle suction position movement processing retry count storage area in the RAM 302 is incremented by one (S1109). The carriage 3 has stopped before having moved from the home position over the predetermined distance. As shown in FIG. 36C, this means that the carriage 3 is arranged in the elevated position. In that case, the idle suction position movement processing is retried only once. As mentioned previously, a determination as to the travel distance and stoppage of the carriage 3 is also made on the basis of an output from the linear encoder 310.

When the value of "m" stored in the idle suction position movement processing retry count storage area in the RAM 302 is incremented by only one (S1109), a determination is made as to whether or not the value of "m" is 2 or more (S1110). At this time, in the case of a normal state, "m" assumes a value of 1 (NO in S1110). Hence, processing returns to S1102, where processing for moving a carriage to idle suction position is again performed. As mentioned previously, even when the carriage lock 100 is situated at the elevated position during first processing for moving a carriage to an idle suction position (FIG. 36C), the carriage lock 100 is arranged in the lowered position, so long as processing pertaining to steps S1102 to S1108 is again performed. Therefore, movement of the carriage 3 is usually stopped (S1113), and processing for moving a carriage to an idle suction position is completed (FIG. 36E). During first processing for moving a carriage to an idle suction position, the carriage 3 has already moved from the home position to the location where the carriage 3 comes into contact with the carriage lock 100. For this reason, it goes without saying that, during retry operation, the predetermined distance employed in S1107 corresponds to a distance from the position where the carriage comes into contact with the carriage lock 100 to the idle suction position (i.e., a shift from FIG. 36C to 36E is achieved).

However, when the carriage 3 has stopped before moving over the predetermined distance in spite of processing pertaining to S1102 to S1108 having been performed again (YES in S1108), the value of "m" stored in the idle suction position movement processing retry count storage area in the RAM 302 is incremented by only one (S1109). In this case, "m" assumes a value of 2 (YES in S1110), and hence an error is reported to the user by way of the LCD 322 on the control panel or an unillustrated speaker (S1111), and operation of the MFD is stopped (S1112). When the error is simple and can be corrected by the user, the user who has ascertained the error is to recover the image reading device 2 by way of the main body frame 1, to thus eliminate a cause for the error. In contrast, when the error is profoundly serious and cannot be recovered by the user, the MFD must be subjected to repair performed by a specialist.

Movement of the carriage 3 is stopped (S1113), and movement of the carriage to the idle suction position is terminated (FIG. 36E). Then, processing for detecting the rotational position of the cam 55 (S1200) is then performed.

Figure 31:
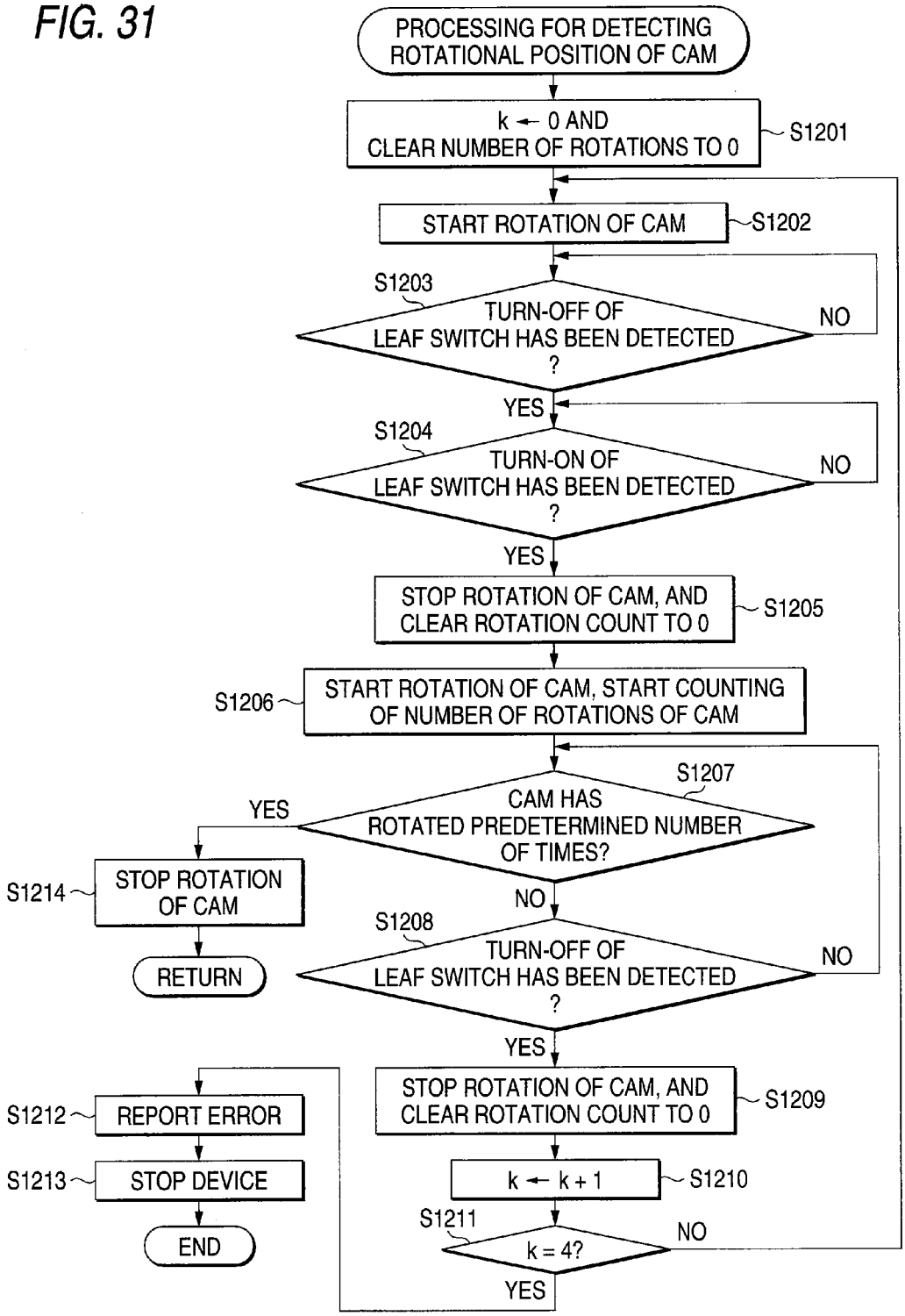
FIG. 31 is a flowchart showing operation of (a sub-routine) processing for detecting the rotational position of a cam.

Processing for detecting a rotational position of the cam 55 (S1200) will be described hereinbelow by reference to FIG. 31. By means of processing for detecting a rotational position of the cam 55 (S1200), the value of "k" stored in the rotational position detection processing retry count storage area in the RAM 302 is cleared to 0. Further, a count value—which is obtained by counting the number of rotations of the cam 55 and stored in a predetermined area in the EEPROM 303—is also cleared to 0 (S1201). Rotation of the cam 55 is started (S1202). When the cam 55 has started to rotate (S1202), a determination is made as to whether or not the output from the leaf switch 106 has become inactive (S1203). If the output from the leaf switch 106 is not inactive (NO in S1203), processing pertaining to S1203 is continued until the output from the leaf switch 106 becomes inactive. If the output from the leaf switch 106 has become inactive (YES in S1203), a determination is made as to whether or not the output from the leaf switch 106 has become active (S1204). If the output from the leaf switch 106 is not active (NO in S1204), processing pertaining to S1204 is continued until the output from the leaf switch 106 becomes active. When the output from the leaf switch 106 has become active (YES in S1204), rotation of the cam 55 is stopped temporarily, and the count value obtained by counting the number of rotations of the cam 55 is also cleared to 0 (S1205). The rotation of the cam 55 is restarted, and counting of the number of rotations of the cam 55 is initiated (S1206). A determination is made as to whether or not the cam 55 has rotated a predetermined number of times (S1207). If the cam 55 has not yet rotated a predetermined number of times (NO in S1207), the leaf switch 106 is determined to have become inactive (S1208). In contrast, if the leaf switch 106 has not become inactive (NO in S1208), processing returns to S1207, where rotation of the cam 55 is continued.

When the leaf switch 106 has become inactive before the cam 55 rotates a predetermined number of times (YES in S1208), rotation of the cam 55 is stopped, and the count value obtained by counting the number of rotations of the cam 55 is also cleared to 0 (S1209). The rotational position of the cam 55 detected through processing is located in the vicinity of the position where the active state of the leaf switch 106 is continued for the longest period of time. Therefore, the fact that the leaf switch 106 becomes inactive before the cam 55 rotates a predetermined number of times indicates that the current rotational position of the cam 55 is not a target rotational position. The value of "k" is incremented by only one (S1210), and a determination is made as to whether or not "k" has assumed a value of 4 or more (S1211). The reason for this is that, since there are four places where the leaf switch 106 changes from inactive to active before one rotation of the cam 55, the target rotational position can be inevitably detected, so long as the rotational position detection processing is repeated four times or more. If the value of "k" is not four or more (NO in S1211), processing returns to S1202, where processing for detecting the rotational position of the cam 55 is again performed.

When the value of "k" is four or more (YES in S1211), an error is reported to the user by way of the LCD 322 on the control panel or an unillustrated speaker (S1212), and operation of the MFD is terminated (S1213).

When the cam 55 has rotated a predetermined number of times before the leaf switch 106 becomes inactive (YES in S1207), rotation of the cam 55 is stopped (S1214), and processing for detecting the rotational position of the cam 55 (S1200) is terminated.

When processing for detecting the rotational position of the cam 55 (S1200) is completed, processing for detecting turn-off of the leaf switch 106 (S1300) is performed.

Figure 32:
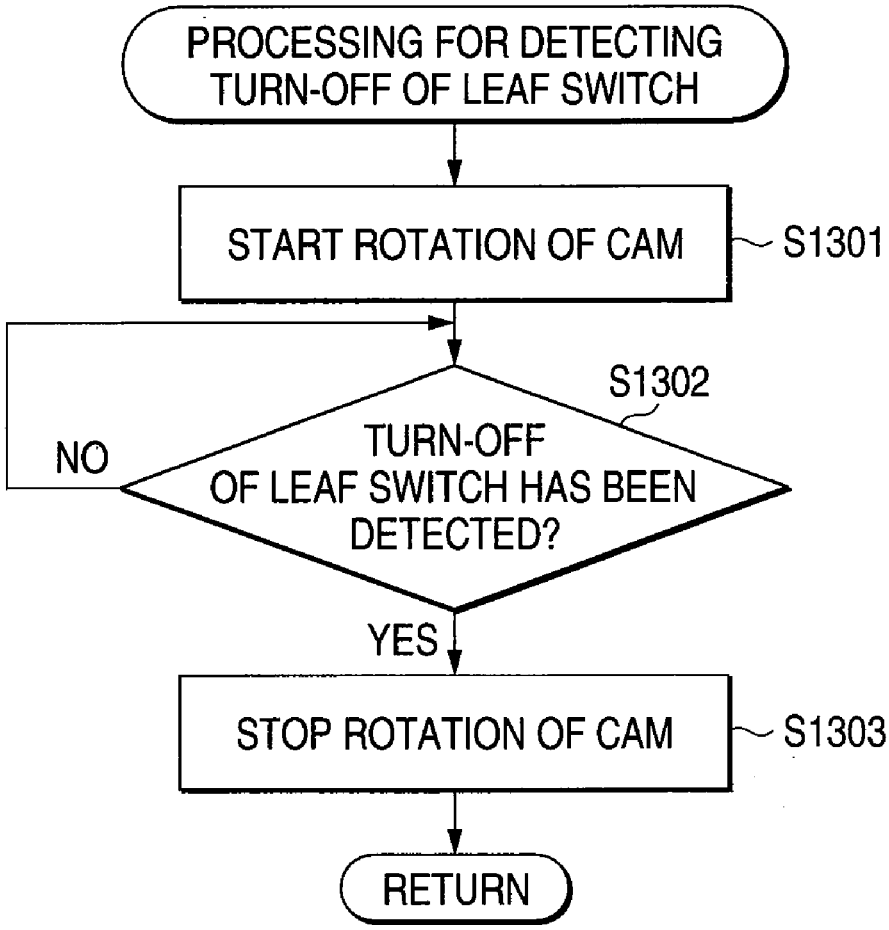
FIG. 32 is a flowchart showing operation of (a sub-routine) processing for detecting turn-off of a leaf switch.

Processing for detecting turn-off of the leaf switch 106 (S1300) will be described hereunder by reference to FIG. 32. During processing for detecting turn-off of the leaf switch 106 (S1300), rotation of the cam 55 is first started (S1301). A determination is then made as to whether or not the leaf switch 106 has been turned off (S1302). If the leaf switch 106 has not been turned off (NO in S1302), rotation of the cam 55 is continued until the leaf switch 106 is turned off. When the leaf switch 106 has been turned off (YES in S1302), rotation of the cam 55 is stopped (S1303). Processing for detecting turn-off of the leaf switch 106 (S1300) is completed. Accordingly, the rotational position of the cam 55, where the carriage lock 100 is situated at the elevated position without fail, has been detected through processing for detecting the rotational position of the cam 55 (S1200), and hence the carriage lock 100 is placed in the lowered position without fail by means of subsequent processing for detecting turn-off of the leaf switch 106 (S1300).

When processing for detecting turn-off of the leaf switch 106 (S1300) is completed, carriage position determination processing 2 (S1400) is performed.

Figure 33:
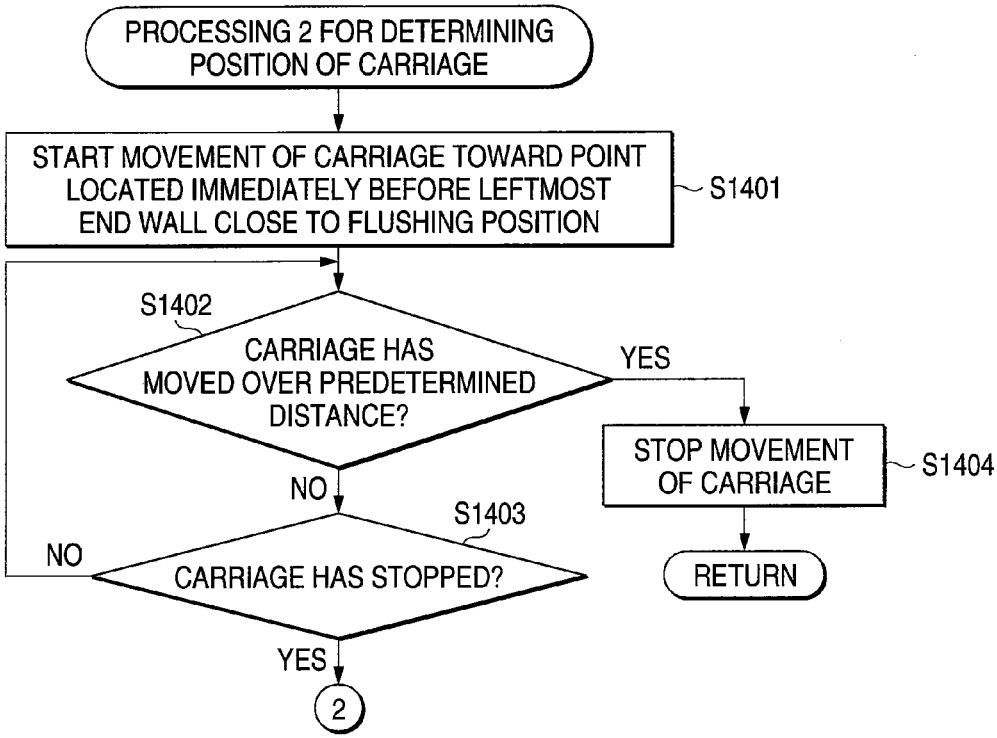
FIG. 33 is a flowchart showing operation of (a sub-routine) processing 2 for determining the position of a carriage.

The carriage position determination processing 2 (S1400) is described hereinbelow by reference to FIGS. 33 and 36. At a point in time when the carriage position determination processing 2 (S1400) is started, the carriage lock 100 is placed in the lowered position. Hence, the carriage 3 does not come into contact with the carriage lock 100 and starts moving toward the leftmost end wall close to the flushing position (S1401). A determination is then made as to whether or not the carriage 3 has moved over only a predetermined distance (S1402). In this case, the term "predetermined distance" (a predetermined range) means a distance (third distance) over which the carriage 3 can move from the idle suction position (FIG. 36E) to a point (FIG. 36F) located immediately before the leftmost end wall close to the flushing position. When the carriage 3 is determined not to have moved over the predetermined distance (NO in S1402), a determination is made as to whether or not the carriage 3 has stopped (S1403). When the carriage 3 is determined not to have stopped (NO in S1403), processing returns to S1402, where movement of the carriage 3 is continued. In contrast, when the carriage 3 is determined to have moved over only the predetermined distance (YES in S1402), movement of the carriage 3 is stopped (S1404), and processing 2 for determining the position of the carriage 3 (S1400) is terminated (FIG. 36F).

When processing 2 for determining the position of the carriage 3 (S1400) is completed, a chance of the recording paper still remaining in the vicinity of the registration sensor 308 cannot be denied, and hence paper output processing (S1500) is performed. During paper output processing, only one piece of, e.g., A4-size recording paper, is separated from the paper feed tray by means of the paper feeding units 206, and there is performed processing for transporting the quantity of recording paper which can be output to the paper output tray by means of the paper transport roller 227 and the paper output roller 228.

After completion of paper output processing (S1500), the carriage 3 is moved to the capping position so that the recording head 10 can be capped with the nozzle cap 60, whereby the recording head 10 is capped with the nozzle cap 60 (S1600). Specifically, a shift from FIG. 36F to FIG. 36G is achieved. Additionally, the value of "n" stored in the initialization processing retry count storage area in the RAM 302 is cleared to 0 (S1700). Finally, the voltage of the recording head 10 (S700) is carried out, whereupon full initialization processing, including reciprocal movement of the carriage 3, is completed.

When the carriage 3 has stopped (YES in S1403) before moving over the predetermined distance (NO in S1402), processing proceeds to S1800 on condition that any error has arisen through carriage position determination processing 2 (S1400). First, the value of "n" stored in the initialization processing retry count storage area in the RAM 302 is incremented by one (S1800). Next, a determination is made as to whether or not "n" assumes a value of 2 (S1900). When the value of "n" is determined not to be 2 (NO in S1900), processing returns to S900, where processing for detecting the home position of the carriage 3 is again performed. After processing for detecting the home position of the carriage 3 (S900) has been completed, a determination is made as to whether or not the value of "n" is one (S1000). Since "n" assumes one in this case (YES in S1000); that is, full initialization processing is retried, processing pertaining to S1100 to S1300 is not performed, and processing 2 for determining the position of the carriage 3 in step S1400 is performed.

During the first full initialization processing, the carriage 3 has already moved to the idle suction position at a point in time when processing 2 for determining the position of the carriage 3 in S1400 is performed, and hence the predetermined distance employed in S1402 corresponds to a travel distance over which the carriage 3 moves from the idle suction position to a point located immediately before the leftmost end wall close to the flushing position. However, the carriage 3 is situated, in this case, at the home position through processing pertaining to S900, the predetermined distance employed in S1402 corresponds to a travel distance over which the carriage 3 moves from the home position (FIG. 36B) to the point located immediately before the leftmost end wall close to the flushing position (FIG. 36F).

The reason why processing pertaining to S1100 to S1300 is not performed through retry of full initialization processing is that the excessive ink still remaining in the nozzle cap 60 has already been drawn by first idle suction operation, and the carriage clock 100 is currently located in the lowered position.

When movement of the carriage 3 is stopped after the carriage 3 has moved over only the predetermined distance by means of retry operation (YES in S1402), as shown in FIG. 36F (S1404), processing 2 for determining the position of the carriage 3 is completed, and processing proceed to paper output processing pertaining to S1500.

However, when the carriage 3 has stopped (YES in S1403) before moving a predetermined distance (NO in S1402), processing proceeds to S1800 on condition that any error has arisen, and the value of "n" is again incremented by only one. As a result, "n" assumes a value of 2 (YES in S1900). In the present embodiment, the number of times full initialization processing is retried is only once. Therefore, "n" having a value of 2 means that any error is determined to have again arisen in processing 2 for determining the position of the carriage 3 in spite of retry having been performed once. Accordingly, processing of an error in the carriage 3 (S2000) is performed.

Figure 34:
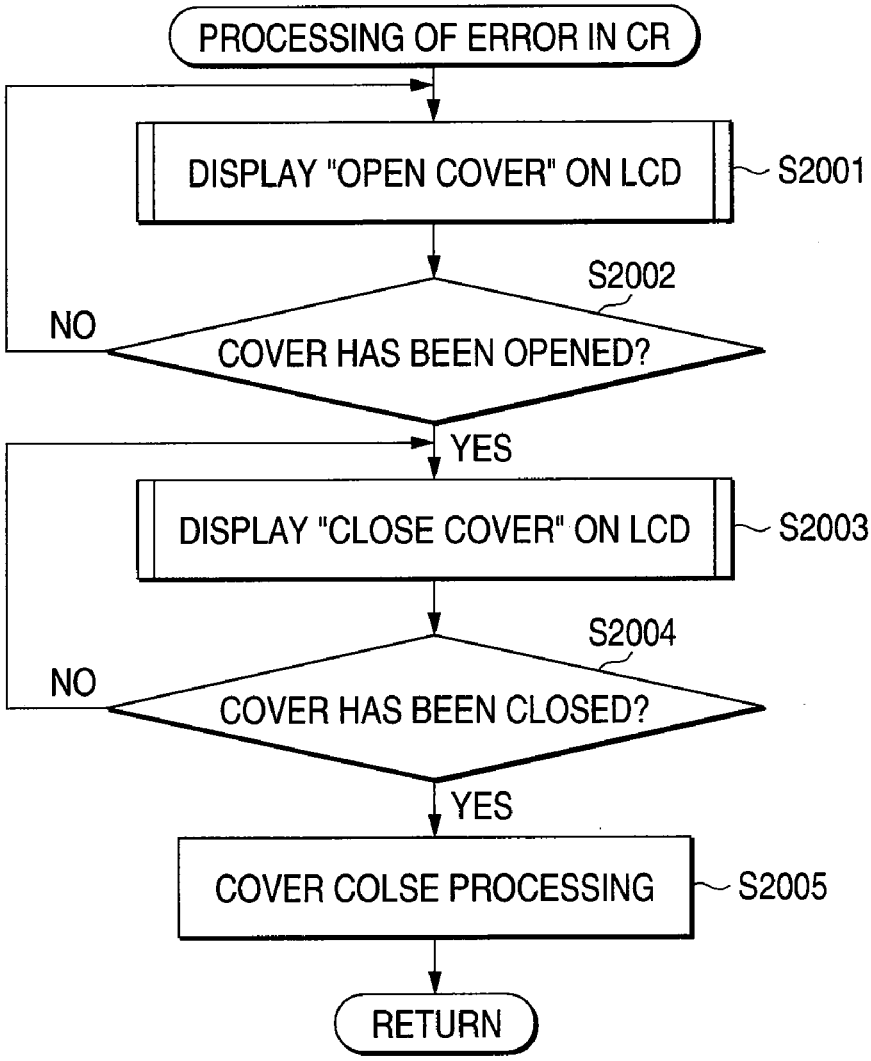
FIG. 34 is a flowchart showing operation of (a sub-routine) carriage error processing.

Processing of an error in the carriage 3 (S2000) will now be described hereinbelow by reference to FIG. 34. During the course of processing of an error in of the carriage 3 (S2000), "OPEN COVER" appears on the LCD 322, which is a display device, on the control panel (S2001). The reason for this is that, since processing for recovering the MFD from any error having arisen therein is left for the user, the user is informed of occurrence of an error in the MFD and that the document reader 2 is opened from the main body frame 1. Since the document reader 2 is equipped with an unillustrated cover open sensor, the open/close of the document reader 2 in relation to the main body frame 1 is detected by the cover open sensor (S2002). Accordingly, display of the message "OPEN COVER" on the LCD 322 is continued until the user opens the document reader 2 in relation to the main body frame 1 (NO in S2002). When the user has opened the document reader 2 in relation to the main body frame 1 (YES in S2002), a message "CLOSE COVER" is displayed on the LCD 322 (S2003). This is intended for informing the user that the document reader 2 is closed after the user has completed recovery of the MFD from the error. As mentioned previously, the open/close of the document reader 2 in relation to the main body frame 1 is detected by the cover open sensor (S2004). Therefore, the message "CLOSE COVER" on the LCD 322 is continued until the user closes the document reader 2 in relation to the main body frame 1 (NO in S2004). When the user closes the document reader 2 in relation to the main body frame 1 (YES in S2004), processing for closing the cover of the document reader 2 (S2005) is performed.

Figure 35:
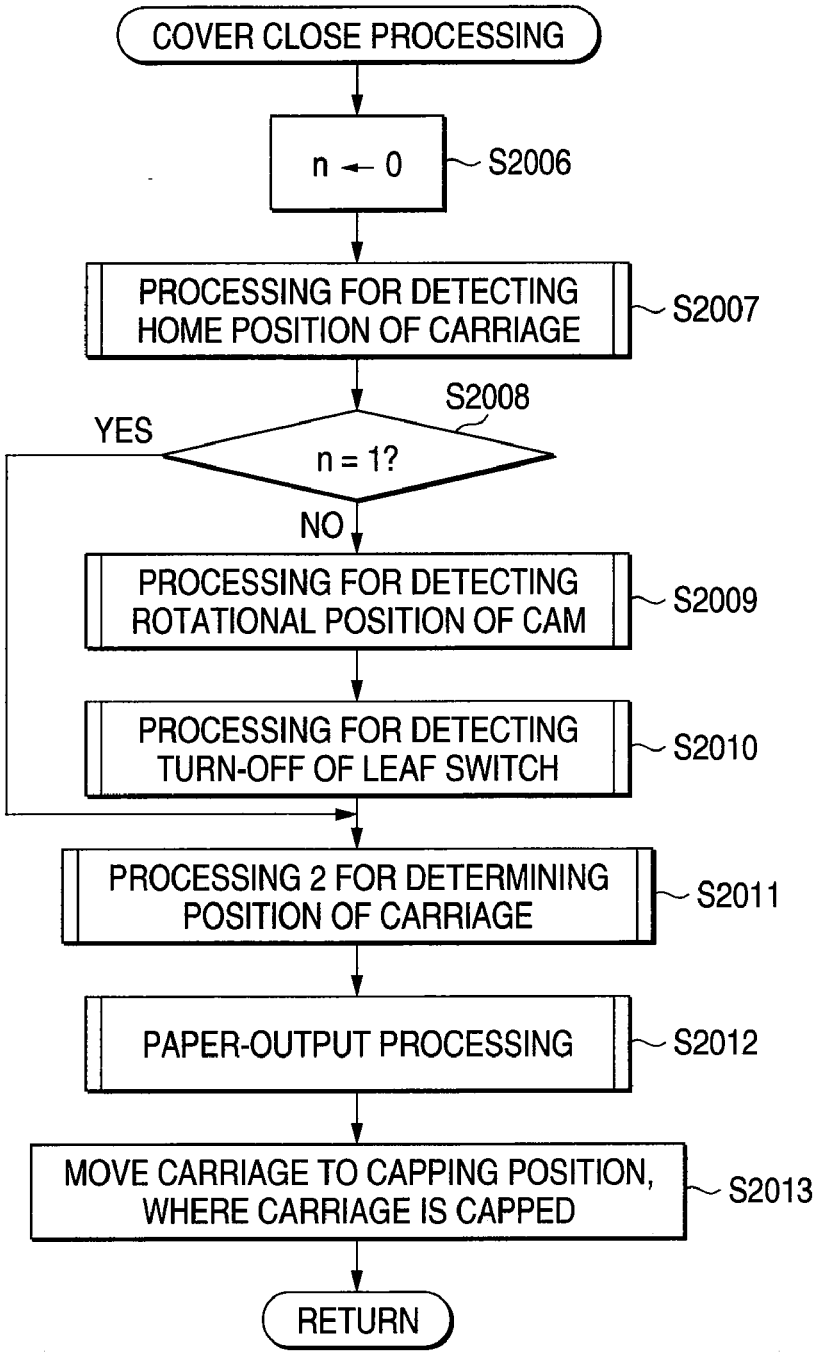
FIG. 35 is a flowchart showing operation of (a sub-routine) cover close processing.

By reference to FIG. 35, processing for closing a cover of the document reader 2 (S205) will now be described. Through processing for closing the document reader 2 (S2005), the value of "n" stored in the initialization retry count storage area in the RAM 302 is cleared to 0 (S2006). Next, processing for detecting the home position of the carriage 3 (S2007) similar to that pertaining to S900 is performed. After completion of processing for detecting the home position of the carriage 3 (S2007), a determination is made as to whether or not the value of "n" is one (S2008). Since "n" assumes a value of 0 this time (NO in S2008), processing for detecting the rotational position of the cam 55 analogous to that pertaining to S1200 is performed (S2009). After completion of processing for detecting the rotational position of the cam 55 (S2009), processing for detecting turn-off of the leaf switch 106 analogous to S1300 (S2010) is performed. After completion of processing for detecting turn-off of the leaf switch 106 (S2010), processing for determining the position of the carriage 3 analogous to processing pertaining to S1400 (S2011) is performed. Processing pertaining to S2007 to S2011 is analogous to that pertaining to S900 to S1400, which has already been described, and hence details of processing are not described here. When, through processing 2 for determining the position of the carriage 3 (S2011), the carriage 3 has stopped after having moved from the home position to the point located immediately before the leftmost end wall close to the flushing position (YES in S1402→S1404), paper output processing analogous that pertaining to S1500 is performed. Subsequently, as in the case of S1600, the carriage 3 is moved to the capping position, and the recording head 10 is capped with the nozzle cap 60 (FIG. 36G). The cover close processing (S2005) is terminated. Although not illustrated, a determination is always made, during the cover close processing, as to whether or not the carriage position is correct, on the basis of information about the position of the carriage 3 output from the linear encoder 310. Consequently, when an error is detected on the basis of the position of the carriage 3, processing returns to S2001 pertaining to processing of an error in the carriage 3.

Completion of cover close processing (S2005) ends in completion of carriage error processing (S2000). Therefore, processing proceeds to S1700. After the value of "n" stored in the initialization processing retry count storage area in the RAM 302 has been cleared to 0 (S1700), the head voltage of the recording head 10 is checked (S700), and initialization processing is completed.

When, during processing 2 for determining the position of the carriage 3 (S2011), the carriage 3 has stopped (YES in S1402) before moving over a predetermined distance (NO in S1402), processing proceeds to S1800 on condition that any error has arisen. Details of subsequent processing have already been described above, and hence their explanations are omitted.

As has been described in detail, according to the recording apparatus of the embodiment, when the movement unit has moved the carriage from the position of a point of origin toward the regulation unit after the point-of-origin detection unit has detected the position of the point of origin, the control unit performs first initialization processing serving as simple initialization processing, or second initialization processing (complete initialization processing) requiring a longer time than that required by the first initialization processing, on the basis of whether or not movement of the carriage is restricted, as well as on the basis of whether or not a travel distance of the carriage corresponds to a second distance determined by subtracting a width of the carriage from the first distance. Hence, the initialization processing operation is simplified, depending on the status of the recording apparatus at power-on, thereby shortening wait time for the user.

According to the embodiment, when the carriage has moved from the position of the point of origin over the second distance and movement of the carriage is then restricted (stopped) by the regulation unit, the recording apparatus can be determined to be normal when power of the recording apparatus has been turned on. Hence, the control unit can shorten the wait time for the user by performing the first initialization processing.

According to the embodiment, the movement of the carriage is not restricted despite the travel distance of the carriage having exceeded the second distance, or when the travel distance of the carriage does not correspond to a second distance despite the movement of the carriage having been regulated. For this reason, any anomaly can be determined to have arisen in the recording apparatus. Hence, the control unit performs second initialization processing, so that the recording apparatus can be automatically returned to a normal condition despite involving consumption of a much longer time than that for the first initialization process.

According to the embodiment, the recording apparatus further comprises status detection unit which, when power of the recording apparatus is turned on, detects a status of the recording apparatus acquired at the time of the last power turn-off operation before the point-of-origin detection unit detects a position of point of origin. Therefore, in the event of occurrence of any anomaly in the recording apparatus, the anomaly can be detected more quickly. Consequently, the second initialization processing, which requires a long time, can be commenced quickly.

According to the embodiment, the status of the recording apparatus acquired when power is turned off is specified. Accordingly, the status detection unit can readily detect the status of the recording apparatus.

According to the embodiment, when the status detection unit has detected that the nozzle surface of the recording head is not covered with a cover member at the time of last turning-off of power, there may be a chance of the recording head being clogged with ink. Normal recording can be performed by performing maintenance of the recording head before the next recording operation.

According to the embodiment, when power of the recording apparatus is first turned on, second initialization processing is performed. Accordingly, the recording apparatus can be quickly set to a usable condition.

According to the embodiment, since the carriage can be moved over a long distance, processing for detecting the point of origin can be performed more accurately with greater precision.

According to the embodiment, processing for detecting the point of origin can be performed more accurately with greater precision, and the recording head can be set in a standby condition.

According to the embodiment, when the carriage detection unit has detected an anomaly, the second initialization processing is repeated. Hence, the recording apparatus is not stopped by one error that has suddenly arisen, and hence the user is not given inconvenience.

According to the embodiment, when the second initialization processing is repeated, the control unit increases the power of the movement unit used for moving the carriage, in accordance with the number of times the second initialization processing is repeated. Hence, processing for detecting the position of a point of origin can be performed more accurately.

According to the embodiment, the recording apparatus is equipped with report unit for reporting a problem of the carriage when the second initialization processing has been repeated a predetermined number of times. When the carriage cannot be automatically recovered from the problem, the user ascertains the problem of the carriage for the first time. Thus, inconvenience given to the user can be lessened.

According to the embodiment, the maintenance unit which performs maintenance of the recording head and covers the recording head with a cover member at standby is disposed at the same end in the movable range of the carriage where the position of the point of origin is situated. Hence, processing for detecting the point of origin can be performed quickly.

The present invention is not limited to the embodiment which has been described by reference to descriptions and drawings, and can be practiced while being modified variously within the scope of the gist of the invention.

For instance, in the above-described embodiment, the number of retry operations performed in the event of occurrence of an error shown in FIG. 27 is set to twice. The number of retry operations can also be increased.

While the invention has been described in conjunction with the specific embodiments described above, many equivalent alternatives, modifications and variations may become apparent to those skilled in the art when given this disclosure. Accordingly, the exemplary embodiments of the invention as set forth above are considered to be illustrative and not limiting. Various changes to the described embodiments may be made without departing from the spirit and scope of the invention.

What is claimed is:

1. A recording apparatus, comprising:

a carriage including a recording head that records an image on a recording medium;

a movement unit that reciprocally moves the carriage in a main scanning direction with reference to a position of a point of origin provided at one end within a movable region of the carriage;

a carriage detection unit that detects at least one of a travel distance and movement/stoppage of the carriage;

a point-of-origin detection unit that detects the position of a point of origin of the carriage;

a regulation unit provided at a first distance away from the point of origin within the movable region of the carriage, wherein the regulation unit is displaceable between a contact position where movement of the carriage is restricted as a result of coming into contact with the carriage and a spaced position where movement of the carriage is allowed as a result of being spaced apart from the carriage; and a control unit that selectably performs one of a first initialization processing and a second initialization processing requiring a longer time than that required by the first initialization processing, after the point-of-origin detection unit detects the position of origin;

wherein the control unit selects one of the first initialization processing and the second initialization processing on the basis of whether movement of the carriage is restricted and whether a travel distance of the carriage is within a predetermined range, when the movement unit moves the carriage from a position of origin, if the movement of the carriage is restricted and if the control unit selects the first initializing processing, the movement unit does not move the carriage back to the position of origin during the first initialization processing, the predetermined range is within a distance from the point of origin to the contact position, wherein the predetermined range corresponds to a range between a position determined by subtracting a specific distance from a second distance and a position determined by adding the specific distance to the second distance, and wherein the second distance is determined by subtracting a width of the carriage from the first distance.

2. The recording apparatus according to claim 1, wherein the control unit performs the first initialization processing when movement of the carriage is restricted and when the travel distance of the carriage corresponds to the predetermined range.

3. The recording apparatus according to claim 1, wherein the control unit performs the second initialization processing when the movement of the carriage is not restricted despite the travel distance of the carriage having exceeded the predetermined range.

4. The recording apparatus according to claim 1, wherein the control unit performs the second initialization processing when the travel distance of the carriage is not within the predetermined range despite the movement of the carriage is regulated.

5. The recording apparatus according to claim 1, further comprising: a status detection unit that detects a status of the recording apparatus acquired at the time of the last power turn-off operation before the point-of-origin detection unit detects the position of origin, when power of the recording apparatus is turned on.

6. The recording apparatus according to claim 5, wherein the control unit performs the second initialization processing when the status detection unit detects a status of the recording apparatus acquired at the time of the last power turn-off operation as being a specific status.

7. The recording apparatus according to claim 5, wherein the control unit allows the point-of-origin detection unit to detect the position of origin when the status detection unit detects a status of the recording apparatus acquired at the time of the last power turn-off operation as not being a specific status.

8. The recording apparatus according to claim 5, wherein the status detection unit detects at least one of a status where a nozzle surface of the recording head is not covered with a cover member, a status where the recording medium is located in an anomalous position, a status where an error arises in the recording apparatus, a status where maintenance is being performed on the recording head, and a status where a recording agent used for recording an image on the recording medium is in the process of being replaced.

9. The recording apparatus according to claim 5, wherein the control unit effects control processing so as to perform maintenance on the recording head before the recording apparatus performs the next recording operation when the status detection unit detects that a nozzle surface of the recording head was not covered with a cover member at the time of the last power turn-off operation.

10. The recording apparatus according to claim 5, wherein the control unit performs the second initialization processing when the status detection unit detects a current power turn-on operation as being the first power-on operation of the recording apparatus.

11. The recording apparatus according to claim 1, wherein the second initialization processing includes an operation for causing the movement unit to move the carriage to the vicinity of the other end opposite to the one end where the point of origin is provided within the movable range of the carriage.

12. The recording apparatus according to claim 11, wherein, in a case where the carriage detection unit detects that the carriage is moved more than a third distance that exceeds the predetermined range when the movement unit moves the carriage to the vicinity of the other end, the control unit causes the movement unit to stop the carriage and to move the carriage toward the point of origin until the nozzle surface of the recording head is covered with the cover member.

13. The recording apparatus according to claim 11, wherein, in a case where the carriage detection unit detects that movement of the carriage is restricted despite the carriage not having moved more than a third distance that exceeds the predetermined range when the movement unit moves the carriage to the vicinity of the other end, the control unit causes the movement unit to stop the carriage and to repeat the second initialization processing.

14. The recording apparatus according to claim 13, wherein, when the second initialization processing is repeated, the control unit increases power of the movement unit used for moving the carriage, in accordance with the number of times the second initialization processing is repeated.

15. The recording apparatus according to claim 13, further comprising: a report unit that reports a failure in the carriage when the second initialization processing is repeated a predetermined number of times.

16. The recording apparatus according to claim 1, wherein the point of origin and the contact position are outside of a recording area where the recording head records the image on the recording medium.

17. The recording apparatus according to claim 1, wherein, if the movement of the carriage is restricted and if the control unit selects the first initialization processing, the movement unit maintains the carriage at the regulation unit during the first initialization processing.

18. The recording apparatus according to claim 1, wherein the movement unit stops the movement of the carriage from the position of origin in the opposite direction if the travel distance of the carriage exceeds the position determined by adding the specific distance to the second distance.

* * * * *

UNITED STATES PATENT AND TRADEMARK OFFICE

CERTIFICATE OF CORRECTION

PATENT NO. : 7,632,030 B2
APPLICATION NO. : 11/190126
DATED : December 15, 2009
INVENTOR(S) : Morikawa et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1010 days.

Signed and Sealed this

Second Day of November, 2010

David J. Kappos

David J. Kappos
*Director of the United States Patent and Trademark Office*